US011482359B2

(12) United States Patent
Eliason et al.

(10) Patent No.: US 11,482,359 B2
(45) Date of Patent: Oct. 25, 2022

(54) DETACHABLE MAGNET DEVICE

(71) Applicant: Magnetic Mechanisms L.L.C., Shoreview, MN (US)

(72) Inventors: Jeffery M. Eliason, Shoreview, MN (US); Mitchell Porch, Grand Rapids, MI (US); Joseph Funk, St. Paul, MN (US); Braden J. Eliason, Minneapolis, MN (US); Benjamin J. Larsen, St. Paul, MN (US)

(73) Assignee: Magnetic Mechanisms L.L.C., Shoreview, MN (US)

( * ) Notice: Subject to any disclaimer, the term of this patent is extended or adjusted under 35 U.S.C. 154(b) by 0 days.

(21) Appl. No.: 17/176,486

(22) Filed: Feb. 16, 2021

(65) Prior Publication Data

US 2021/0265089 A1 Aug. 26, 2021

Related U.S. Application Data

(60) Provisional application No. 62/979,148, filed on Feb. 20, 2020.

(51) Int. Cl.
*H01F 7/02* (2006.01)

(52) U.S. Cl.
CPC ..... *H01F 7/0252* (2013.01)

(58) Field of Classification Search
CPC ..... H01F 7/0252; H01F 7/04
See application file for complete search history.

(56) References Cited

U.S. PATENT DOCUMENTS

| | | | |
|---|---|---|---|
| 3,014,751 | A | 12/1961 | Smith |
| 7,012,495 | B2 | 3/2006 | Underwood et al. |
| 7,172,079 | B1 | 2/2007 | Shiao |
| 7,746,205 | B2 | 6/2010 | Fullerton et al. |

(Continued)

FOREIGN PATENT DOCUMENTS

| | | | |
|---|---|---|---|
| AU | 753496 | B2 | 6/2001 |
| AU | 2002325077 | B2 | 3/2003 |

(Continued)

OTHER PUBLICATIONS

Notification of Transmittal of the International Search Report and the Written Opinion of the International Searching Authority, or the Declaration for Application No. PCT/US2021/018587, dated Aug. 6, 2021 21 pages).

(Continued)

*Primary Examiner* — Mohamad A Musleh
(74) *Attorney, Agent, or Firm* — Christensen, Fonder, Dardi & Herbert PLLC; John P. Fonder

(57) ABSTRACT

Devices for detachable attachment to a ferromagnetic object and/or surface are disclosed. The device may comprise a core housing defining a pocket, a magnet disposed in the pocket, and a baseplate fixed to the magnet sheet assembly. The baseplate may include a pivot portion that engages a corresponding portion of the core housing to form a hinge joint such that the baseplate and the magnetic sheet assembly selectively pivot about a pivot axis of the hinge joint relative to the core housing. The camming mechanism may apply a camming force to a portion of the baseplate and the camming force may urge the magnet and the baseplate to pivot about the pivot axis of the hinge joint.

20 Claims, 50 Drawing Sheets

(56) References Cited

U.S. PATENT DOCUMENTS

| | | | | |
|---|---|---|---|---|
| 7,750,774 | B2 | 7/2010 | Fullerton et al. | |
| 7,750,777 | B2 | 7/2010 | Fullerton et al. | |
| 7,750,778 | B2 | 7/2010 | Fullerton et al. | |
| 7,750,780 | B2 | 7/2010 | Fullerton et al. | |
| 7,750,781 | B2 | 7/2010 | Fullerton et al. | |
| 7,755,462 | B2 | 7/2010 | Fullerton et al. | |
| 7,772,952 | B2 | 8/2010 | Fullerton et al. | |
| 7,800,471 | B2 | 9/2010 | Fullerton et al. | |
| 7,800,472 | B2 | 9/2010 | Fullerton et al. | |
| 7,800,473 | B2 | 9/2010 | Fullerton et al. | |
| 7,808,348 | B2 | 10/2010 | Fullerton et al. | |
| 7,808,349 | B2 | 10/2010 | Fullerton et al. | |
| 7,808,350 | B2 | 10/2010 | Fullerton et al. | |
| 7,834,728 | B2 | 11/2010 | Fullerton et al. | |
| 7,834,729 | B2 | 11/2010 | Fullerton et al. | |
| 7,839,247 | B2 | 11/2010 | Fullerton et al. | |
| 7,839,248 | B2 | 11/2010 | Fullerton et al. | |
| 7,843,294 | B2 | 11/2010 | Fullerton et al. | |
| 7,855,624 | B2 | 12/2010 | Fullerton et al. | |
| 7,868,721 | B2 | 1/2011 | Fullerton et al. | |
| 7,889,038 | B2 | 2/2011 | Fullerton et al. | |
| 7,982,568 | B2 | 7/2011 | Fullerton et al. | |
| 8,035,260 | B2 | 10/2011 | Fullerton et al. | |
| 8,098,122 | B2 | 1/2012 | Fullerton et al. | |
| 8,115,581 | B2 | 2/2012 | Fullerton et al. | |
| 8,174,347 | B2 | 5/2012 | Fullerton et al. | |
| 8,179,219 | B2 | 5/2012 | Fullerton et al. | |
| 8,279,031 | B2 | 10/2012 | Fullerton et al. | |
| 8,279,032 | B1 | 10/2012 | Fullerton et al. | |
| 8,314,671 | B2 | 11/2012 | Fullerton et al. | |
| 8,314,672 | B2 | 11/2012 | Fullerton et al. | |
| 8,350,663 | B1 * | 1/2013 | Michael | B23Q 3/1546 338/288 |
| 8,354,909 | B2 | 1/2013 | Fullerton et al. | |
| 8,356,400 | B2 | 1/2013 | Fullerton et al. | |
| 8,368,495 | B2 | 2/2013 | Fullerton et al. | |
| 8,373,527 | B2 | 2/2013 | Fullerton et al. | |
| 8,461,952 | B1 | 6/2013 | Fullerton et al. | |
| 8,502,630 | B2 | 8/2013 | Richards et al. | |
| 8,570,129 | B2 | 10/2013 | Fullerton et al. | |
| 8,570,130 | B1 | 10/2013 | Fullerton et al. | |
| 8,576,036 | B2 | 11/2013 | Fullerton et al. | |
| 8,593,242 | B2 | 11/2013 | Fullerton et al. | |
| 8,643,454 | B2 | 2/2014 | Fullerton et al. | |
| 8,648,681 | B2 | 2/2014 | Roberts et al. | |
| 8,692,637 | B2 | 4/2014 | Richards et al. | |
| 8,698,583 | B2 | 4/2014 | Fullerton et al. | |
| 8,702,437 | B2 | 4/2014 | Fullerton et al. | |
| 8,704,626 | B2 | 4/2014 | Fullerton et al. | |
| 8,717,131 | B2 | 5/2014 | Fullerton et al. | |
| 8,760,250 | B2 | 6/2014 | Fullerton et al. | |
| 8,760,251 | B2 | 6/2014 | Roberts et al. | |
| 8,760,252 | B2 | 6/2014 | Fullerton et al. | |
| 8,779,877 | B2 | 7/2014 | Fullerton et al. | |
| 8,779,879 | B2 | 7/2014 | Roberts et al. | |
| 8,810,348 | B2 | 8/2014 | Fullerton et al. | |
| 8,816,805 | B2 | 8/2014 | Fullerton et al. | |
| 8,841,981 | B2 | 9/2014 | Fullerton et al. | |
| 8,844,121 | B2 | 9/2014 | Fullerton et al. | |
| 8,848,973 | B2 | 9/2014 | Fullerton et al. | |
| 8,857,044 | B2 | 10/2014 | Fullerton et al. | |
| 8,872,608 | B2 | 10/2014 | Fullerton et al. | |
| 8,878,639 | B2 | 11/2014 | Kocijan | |
| 8,917,154 | B2 | 12/2014 | Fullerton et al. | |
| 8,937,521 | B2 | 1/2015 | Fullerton et al. | |
| 8,947,185 | B2 | 2/2015 | Fullerton et al. | |
| 8,957,751 | B2 | 2/2015 | Fullerton et al. | |
| 8,963,380 | B2 | 2/2015 | Fullerton et al. | |
| 8,963,668 | B2 | 2/2015 | Fullerton et al. | |
| 9,082,539 | B2 | 7/2015 | Fullerton | |
| 9,093,207 | B2 | 7/2015 | Fullerton et al. | |
| 9,105,380 | B2 | 8/2015 | Roberts et al. | |
| 9,105,384 | B2 | 8/2015 | Fullerton et al. | |
| 9,111,672 | B2 | 8/2015 | Fullerton et al. | |
| 9,111,673 | B2 | 8/2015 | Fullerton et al. | |
| 9,202,615 | B2 | 12/2015 | Fullerton et al. | |
| 9,202,616 | B2 | 12/2015 | Fullerton et al. | |
| 9,219,403 | B2 | 12/2015 | Evans | |
| 9,245,677 | B2 | 1/2016 | Fullerton et al. | |
| 9,257,219 | B2 | 2/2016 | Fullerton et al. | |
| 9,269,482 | B2 | 2/2016 | Fullerton | |
| 9,275,783 | B2 | 3/2016 | Fullerton et al. | |
| 9,298,281 | B2 | 3/2016 | Fullerton et al. | |
| 9,312,634 | B2 | 4/2016 | Fullerton et al. | |
| 9,365,049 | B2 | 6/2016 | Fullerton | |
| 9,367,783 | B2 | 6/2016 | Fullerton et al. | |
| 9,371,923 | B2 | 6/2016 | Fullerton et al. | |
| 9,404,776 | B2 | 8/2016 | Fullerton et al. | |
| 9,406,424 | B2 | 8/2016 | Fullerton et al. | |
| 9,412,506 | B2 | 8/2016 | Fullerton et al. | |
| 9,536,650 | B2 | 1/2017 | Fullerton | |
| 9,588,599 | B2 | 3/2017 | Fullerton et al. | |
| 9,689,527 | B2 * | 6/2017 | Franklin | F16B 1/00 |
| 9,711,268 | B2 | 7/2017 | Fullerton et al. | |
| 10,008,817 | B2 | 6/2018 | Fullerton et al. | |
| 10,173,292 | B2 | 1/2019 | Fullerton et al. | |
| 10,194,246 | B2 | 1/2019 | Morgan et al. | |
| 10,204,727 | B2 | 2/2019 | Fullerton et al. | |
| 10,903,030 | B2 | 1/2021 | Morton et al. | |
| 10,906,606 | B2 | 2/2021 | Ball et al. | |
| 11,097,401 | B2 | 8/2021 | Morton et al. | |
| D930,354 | S | 9/2021 | Morton et al. | |
| 2005/0216125 | A1 * | 9/2005 | Huston | B62D 57/024 700/258 |
| 2013/0222091 | A1 | 8/2013 | Fullerton et al. | |
| 2013/0320686 | A1 | 12/2013 | Morton | |
| 2016/0289046 | A1 | 10/2016 | Norton et al. | |
| 2017/0053725 | A1 | 2/2017 | St. Onge | |
| 2020/0148303 | A1 | 5/2020 | Ball et al. | |
| 2020/0169126 | A1 | 5/2020 | Morton et al. | |
| 2021/0154881 | A1 | 5/2021 | Klein et al. | |
| 2021/0268615 | A1 | 9/2021 | Morton et al. | |
| 2021/0323634 | A1 | 10/2021 | Ball et al. | |
| 2022/0045594 | A1 | 2/2022 | Morton et al. | |
| 2022/0072698 | A1 | 3/2022 | Morton et al. | |

FOREIGN PATENT DOCUMENTS

| | | | |
|---|---|---|---|
| AU | 200629443 3 | A1 | 3/2007 |
| AU | 2007224996 | B2 | 9/2007 |
| CN | 102217026 | | 10/2011 |
| CN | 102369582 | | 3/2012 |
| CN | 102804291 | | 11/2012 |
| CN | 110901793 | | 3/2020 |
| DE | 10 2012 223 976 | A1 | 6/2014 |
| DE | 20 2016 006 696 | U1 | 1/2017 |
| DE | 10 2016 225 750 | A1 | 6/2018 |
| DE | 10 2016 225 893 | A1 | 6/2018 |
| EP | 1 425 763 | B1 | 2/2017 |
| EP | 2 438 601 | B1 | 3/2017 |
| EP | 3 166 749 | B1 | 8/2021 |
| EP | 3 746261 | A4 | 11/2021 |
| GB | 444786 | A * | 3/1936 |
| JP | H09 92525 | A | 4/1997 |
| JP | 5559770 | | 9/2011 |
| JP | 2012-513997 | | 6/2012 |
| JP | 2012-530950 | | 12/2012 |
| JP | 5604715 | | 10/2015 |
| JP | 2018-510790 | | 4/2018 |
| KR | 10-2004-0065521 | A | 7/2004 |
| KR | 100839166 | B1 | 6/2008 |
| KR | 10-2008-0094328 | | 10/2008 |
| KR | 10-863560 | | 10/2008 |
| KR | 10-2008-0098705 | | 11/2008 |
| KR | 10-1919096 | B1 | 11/2008 |
| KR | 10-1243599 | | 3/2013 |
| KR | 10-1460840 | | 11/2014 |
| KR | 10-2015-0005071 | | 1/2015 |
| KR | 10-2015-0053576 | | 5/2015 |
| KR | 10-1672986 | B1 | 11/2016 |
| KR | 10-1715922 | | 3/2017 |
| KR | 10-2017-0096643 | | 8/2017 |
| KR | 10-2017-0126532 | | 11/2017 |
| KR | 10-2018-0037615 | | 4/2018 |

(56) References Cited

FOREIGN PATENT DOCUMENTS

| | | | |
|---|---|---|---|
| KR | 10-1847297 | B1 | 5/2018 |
| KR | 10-2018-0060185 | | 6/2018 |
| KR | 10-2020-0017717 | | 2/2020 |
| KR | 10-2200860 | B1 | 1/2021 |
| KR | 10-2200861 | B1 | 1/2021 |
| WO | WO 2005/012757 | A1 | 2/2005 |
| WO | WO 2009/000008 | A1 | 12/2008 |
| WO | WO 2009/000599 | A1 | 12/2008 |
| WO | WO 2009/140750 | A2 | 11/2009 |
| WO | WO 2010/020006 | A1 | 2/2010 |
| WO | WO 2010/135788 | A1 | 12/2010 |
| WO | WO 2018/008993 | A1 | 1/2018 |
| WO | WO 2018/227140 | A1 | 12/2018 |
| WO | WO 2019165228 | A1 | 8/2019 |

OTHER PUBLICATIONS

Supplementary European Search Report for Application No. EP 15 85 21 27, dated Aug. 16, 2018, 2 pages.

* cited by examiner

DETACHABLE MAGNET DEVICE

CROSS-REFERENCE TO RELATED APPLICATION

This application claims the benefit of U.S. Provisional Application No. 62/979,148, filed Feb. 20, 2020, the disclosure of which is incorporated by reference herein.

BACKGROUND

This disclosure relates generally to devices having one or more magnets which generate magnetic attraction forces with ferromagnetic objects.

BRIEF SUMMARY

A device for detachable attachment to a ferromagnetic surface is disclosed. In some example embodiments, the device comprises a core housing defining a pocket, a magnet disposed in the pocket, and a baseplate fixed to the magnet. In some embodiments, the baseplate includes a tab portion that extends beyond a periphery of the magnet. In some embodiments, the baseplate also includes a pivot portion that engages a corresponding portion of the core housing to form a hinge joint such that the baseplate and the magnet selectively pivot about a pivot axis of the hinge joint relative to the core housing.

In some embodiments, an annular body is disposed about the core housing such that the annular body is rotatable about a rotational axis relative to the core housing. In some embodiments, the annular body defines a cavity and the annular body includes a camming rib that extends radially inward into the cavity. In some embodiments, the camming rib applies a camming force to the tab portion of the baseplate upon rotation of the annular body relative to the core housing and the camming force urges the magnet and the baseplate to pivot about the pivot axis of the hinge joint.

In some embodiments, the device includes a cap member that is fixed to the core housing with the camming rib disposed between the cap member and a flange portion of the core housing. In some embodiments, the annular body defines a counterbore and the flange portion of the core housing is disposed at least partially in the counterbore defined by the annular body. In some embodiments, the annular body defines a relief and a portion of the cap member is disposed in the relief defined by the annular body. In some embodiments, the annular body has a counterbore opening in a first direction, a relief opening in a second direction, and a camming rib disposed between the counterbore and the relief. In some embodiments, the cap member has a disk-shaped body. In some embodiments, the cap member has a circular shape when viewed as an orthographic projection.

In some embodiments, the magnet of the detachable magnet device comprises a magnetic sheet fixed to a baseplate. In some embodiments, the baseplate comprises a baseplate wall having a forward facing surface, a rearward facing surface, and a wall thickness extending between the forward facing surface and the rearward facing surface. In some embodiments, the magnetic sheet is positioned to overlay the rearward facing surface of the baseplate wall. In some embodiments, the magnetic sheet has a forward face, a rearward face, and a sheet thickness extending between the forward face and the rearward face. In some embodiments, the magnetic sheet comprises a plurality of island portions with interstitial portions of the magnetic sheet disposed about each island portion. In some embodiments, each island portion has a north pole and a south pole and magnetic flux flows through the north pole and the south pole of each island portion. In some embodiments, the poles of each island portion defining a magnetic axis extending through the island portion. In some embodiments, each magnetic axis is generally orthogonal to the faces of the magnetic sheet. In some embodiments, the north pole and the south pole of each island portion are positioned so that each island portion has a first magnetic polarity and the interstitial portions of the magnetic sheet have a second magnetic polarity that is opposite the first magnetic polarity. In some embodiments, the baseplate comprises a ferromagnetic material so that a first portion of the magnet flux flows through the baseplate. In some embodiments, a second portion of the magnetic flux flows through an effective zone opposite a forward face of the magnetic sheet, the second portion of the magnetic flux having a shape that is a mirror image of a first shape of the first portion of the magnetic flux. In some embodiments, the effective zone has an effective zone thickness and ferromagnetic items located outside the effective zone are not attracted to the magnetic sheet. In some embodiments, the effective zone has an effective zone thickness and ferromagnetic items located partially or completely in the effective zone are attracted to the magnetic sheet.

In some additional example embodiments, a device for detachable attachment to a ferromagnetic surface comprises a drive body assembly including a ring-shaped drive body. In some embodiments, the drive body includes a plurality of raised portions, a plurality of recessed portions, and an undulating surface extending over the plurality of raised portions and the plurality of recessed portions. In some embodiments, the mating body assembly of the device comprises a ring-shaped mating body that includes a plurality of peak portions, a plurality of valley portions, and an undulating surface extending over the plurality of peak portions and the plurality of valley portions. The mating body assembly may further include a magnet that is coupled to the mating body. The mating body may have a face that defines a face plane. In some example embodiments, the mating body of the device has an attachment position in which each peak portion of the mating body is received in a corresponding recessed portion of the driving body and each raised portion of the drive body is received in a valley portion of the mating body. In these example embodiments, the mating body may also have a maximum displacement position in which each peak portion of the mating body is outside of the corresponding recessed portion of the drive body and each raised portion of the drive body is outside of the corresponding valley portion of the mating body. Upon relative rotation between the drive body and the mating body, the mating body may move toward the maximum displacement position and the magnet is displaced by a displacement distance relative to the face plane. In some example embodiments, the distance traveled by the magnet is greater than an effective zone thickness of a magnetic field produced by the magnet. In some example embodiments, distance traveled by the magnet is greater than a baseplate wall thickness of a shunt of the magnet.

A feature and/or benefit of embodiments is a system including a cam, wherein upon movement of the cam, the magnitude of a magnetic force varies. In some embodiments, the magnitude of the magnetic force varies in an analog fashion. In some embodiments, the magnitude of the magnetic force is increased and decreased as the cam moves through a range of motion. In some embodiments, the magnetic force has a minimum magnitude that is greater than zero.

A feature and/or benefit of embodiments is a detachable magnet device that is repositionable on a ferromagnetic object or surface. In some embodiments, the detachable magnet device re-useable (e.g, it can be removed from one object and placed on anther object).

A feature and/or benefit of embodiments is a detachable magnet device including an interface member having an outer surface that generates friction between itself and the object. In some embodiments the interface member has an outer surface configured to reduce the likelihood that the ferromagnetic will be damaged.

A feature and/or benefit of embodiments is a detachable magnet device includes a baseplate portion having a thickness dimension selected to provide a relatively low level of torque and a relatively high level of parallel shear. In some embodiments, the baseplate portion of the hanging system has a thickness of about 0.013 inch thick. A feature and/or benefit of embodiments is a detachable magnet device has an overall thickness dimension configured to minimize torque and maximize parallel shear forces.

A feature and/or benefit of embodiments is a detachable magnet device having an overall thickness dimensioned and configured to allow framed photographs, framed artwork and other décor items to lay flat or nearly flat against a ferromagnetic object or surface.

A feature and/or benefit of embodiments is a detachable magnet device including a baseplate portion and an object engaging member (e.g., a hook). A feature and/or benefit of embodiments is a detachable magnet device including a baseplate portion and an object engaging member that is centered relative to the baseplate portion.

A feature and/or benefit of embodiments is a detachable magnet device comprising a magnetic sheet that produces a magnetic flux, a portion of the magnetic flux extending through an effective zone, the effective zone having an effective zone thickness, wherein ferromagnetic items located outside the effective zone are not attracted to the magnetic sheet and ferromagnetic items located inside the effective zone are not attracted to the magnetic sheet. In some embodiments, the effective zone has a thickness that is selected such that the detachable magnet device functions with a ferromagnetic object comprising ferromagnetic paint.

The above summary is not intended to describe each illustrated embodiment or every implementation of the present disclosure.

DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figures 1A, 1B, 1C:
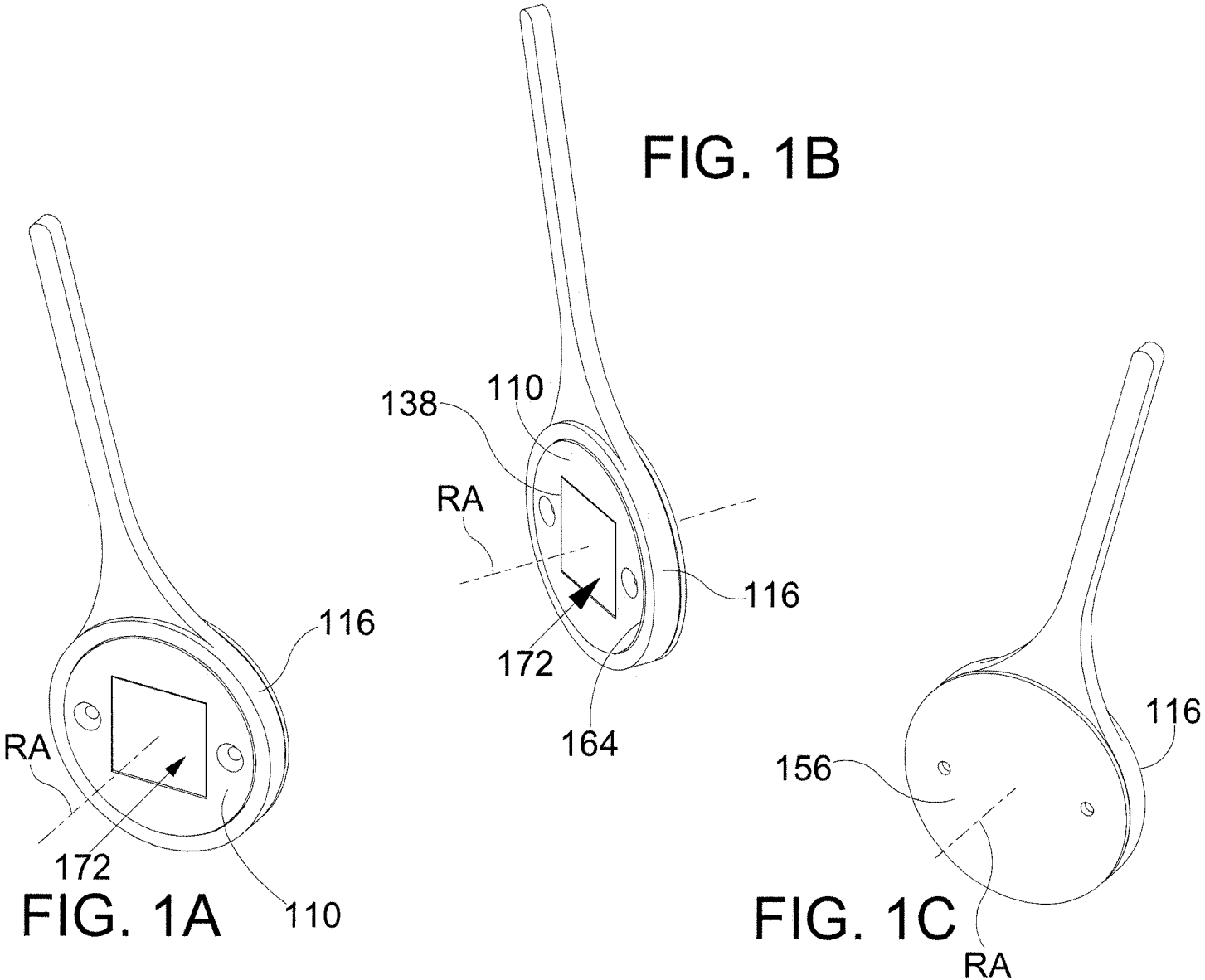
FIGS. 1A through 1C are perspective views showing a detachable magnet device in accordance with an example embodiment.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

FIGS. 1A through 1C are perspective views showing a detachable magnet device in accordance with an example embodiment. FIGS. 1A through 1C may be collectively referred to as FIG. 1. The detachable magnet device of FIG. 1 comprises a core housing 110 defining a pocket 138 and a magnet assembly 172 that is received in the pocket 138. In the example embodiment of FIG. 1, an annular body 116 is disposed about the core housing 110 such that the annular body 116 is rotatable about a rotational axis RA relative to the core housing 110. Also in the example embodiment of FIG. 1, the device includes a cap member 156 that can be fixed to the core housing 110 with a camming rib of the annular body 116 disposed between the cap member 156 and a flange portion 164 of the core housing 110.

Figure 2:
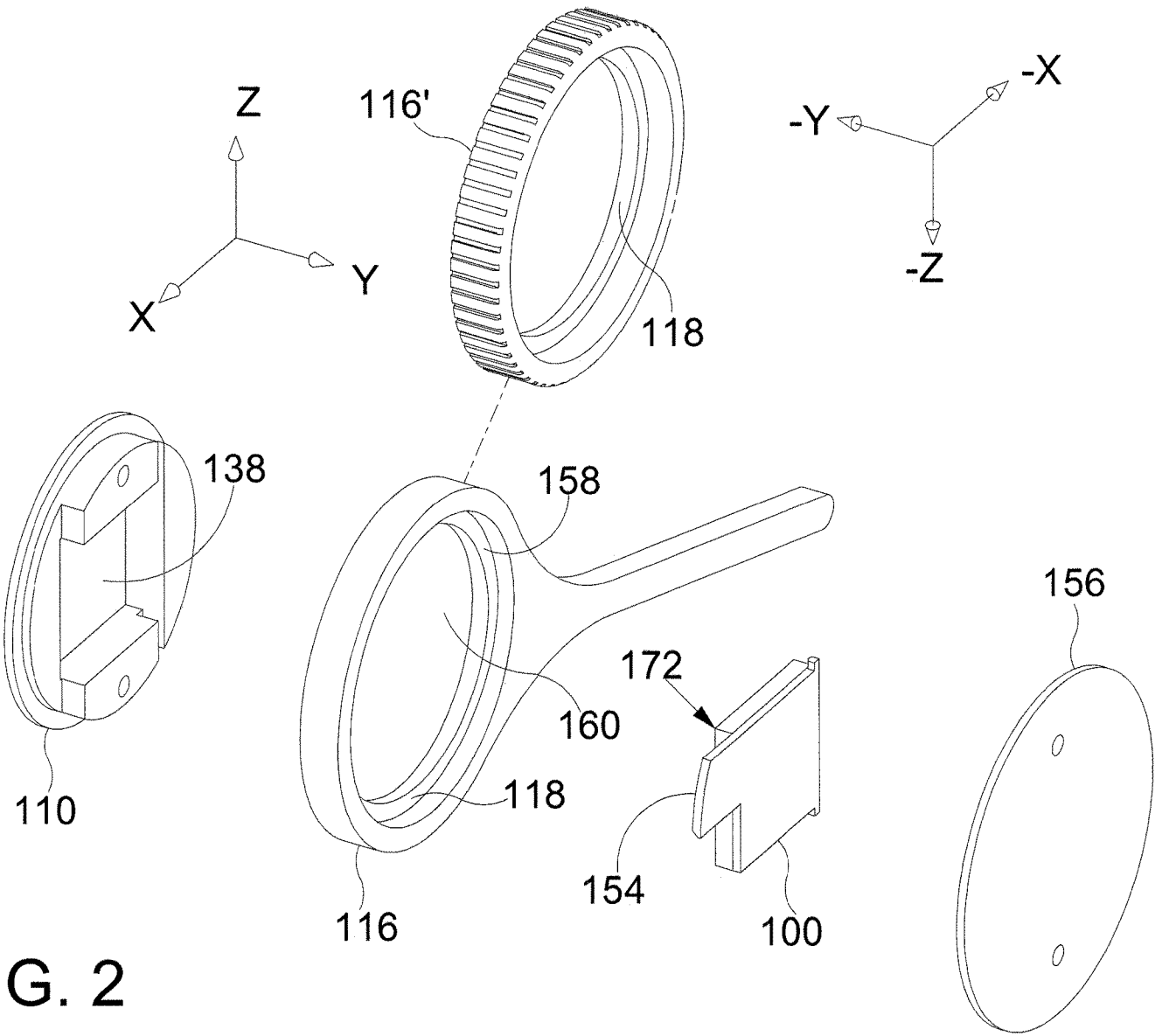
FIG. 2 is an exploded perspective view showing a detachable magnet device in accordance with an example embodiment.
Figure 3A:
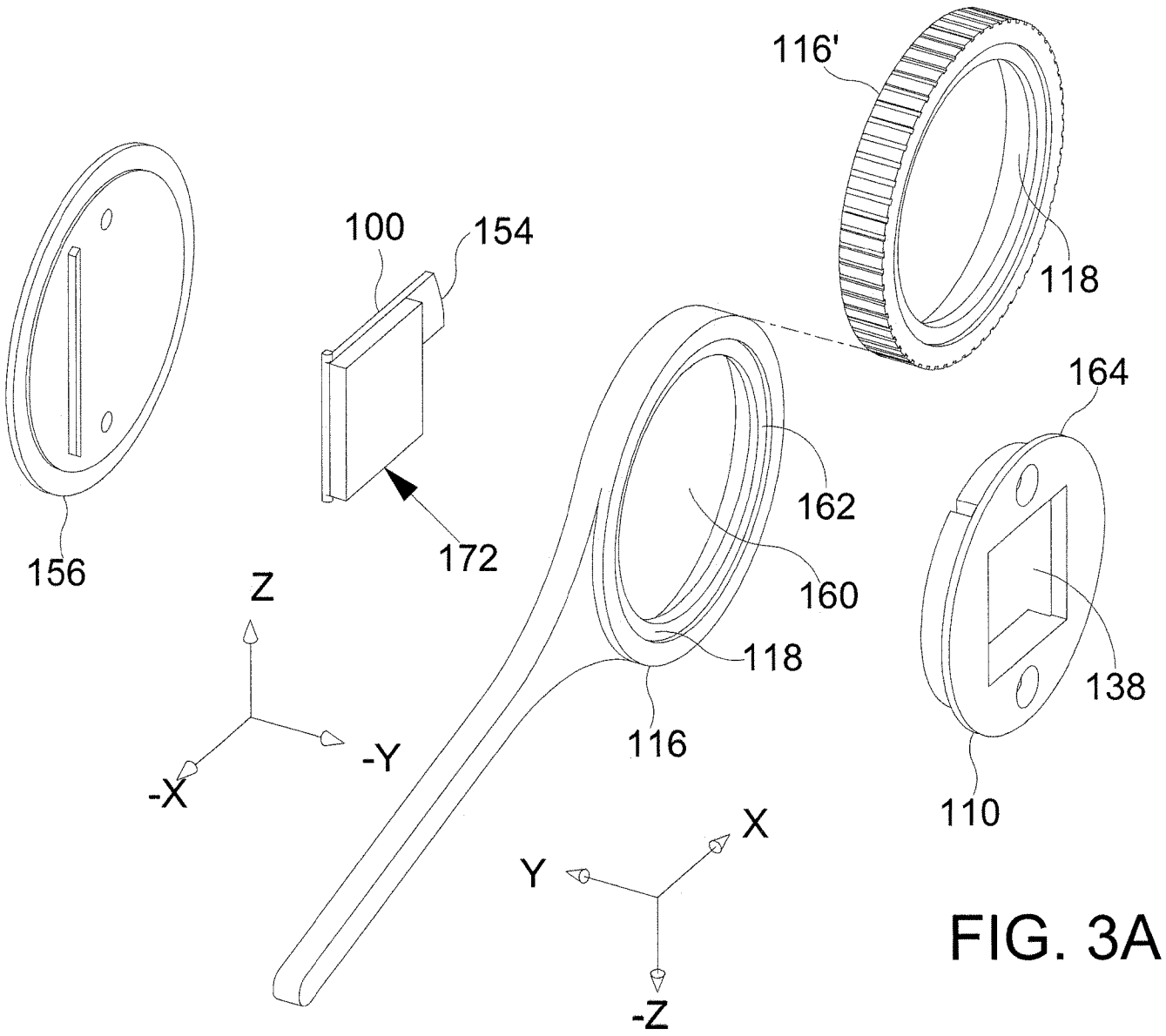
FIG. 3A is an exploded perspective view showing a detachable magnet device in accordance with an example embodiment.

FIGS. 2 and 3A are exploded perspective views showing the detachable magnet device seen in FIG. 1. In the example embodiment of FIGS. 2 and 3A, the detachable magnet device comprises a core housing 110 defining a pocket 138, a magnet assembly 172 that is received in the pocket 138, and a baseplate 100 that is fixed to the magnet assembly 172. When the device is in an assembled state, an annular body may be rotatably disposed about the core housing 110 so that the annular body is rotatable about a rotational axis. In some example embodiments, a handle member is fixed to the annular body 116. On other example embodiments the annular body 116' may include a plurality of gripping elements. In some embodiments, the gripping elements comprise a plurality of protrusions and/or grooves. In the example embodiment of FIGS. 2 and 3A, the baseplate 100 includes a tab portion 154 that extends beyond a periphery of the magnet assembly 172. Also in the example embodiment of FIGS. 2 and 3A, the baseplate 100 also includes a pivot portion 112 that is received in a corresponding portion 114 of the core housing 110 to form a hinge joint such that the baseplate 100 and the magnet assembly 172 selectively pivot relative to the core housing 110.

In the example embodiment of FIGS. 2 and 3A, the device includes a cap member 156 that can be fixed to the core housing 110 with the camming rib 118 disposed between the cap member 156 and a flange portion 164 of the core housing 110. In the example embodiment of FIGS. 2 and 3A, the annular body 116 defines a counterbore 162 and the flange portion 164 of the core housing 110 is disposed at least partially in the counterbore 162 defined by the annular body 116 when the device is assembled. Also in the example embodiment of FIGS. 2 and 3A, the annular body 116 defines a relief 158 and a portion of the cap member is disposed in the relief 158 defined by the annular body 116 when the device is assembled. In some embodiments, the annular body 116 has a counterbore 162 opening in a first direction, a relief 158 opening in a second direction, and a camming rib 118 disposed between the counterbore 162 and the relief 158. In some embodiments, the cap member 156 has a disk-shaped body. In some embodiments, the cap member 156 has a circular shape when viewed as an orthographic projection.

Figure 3B:
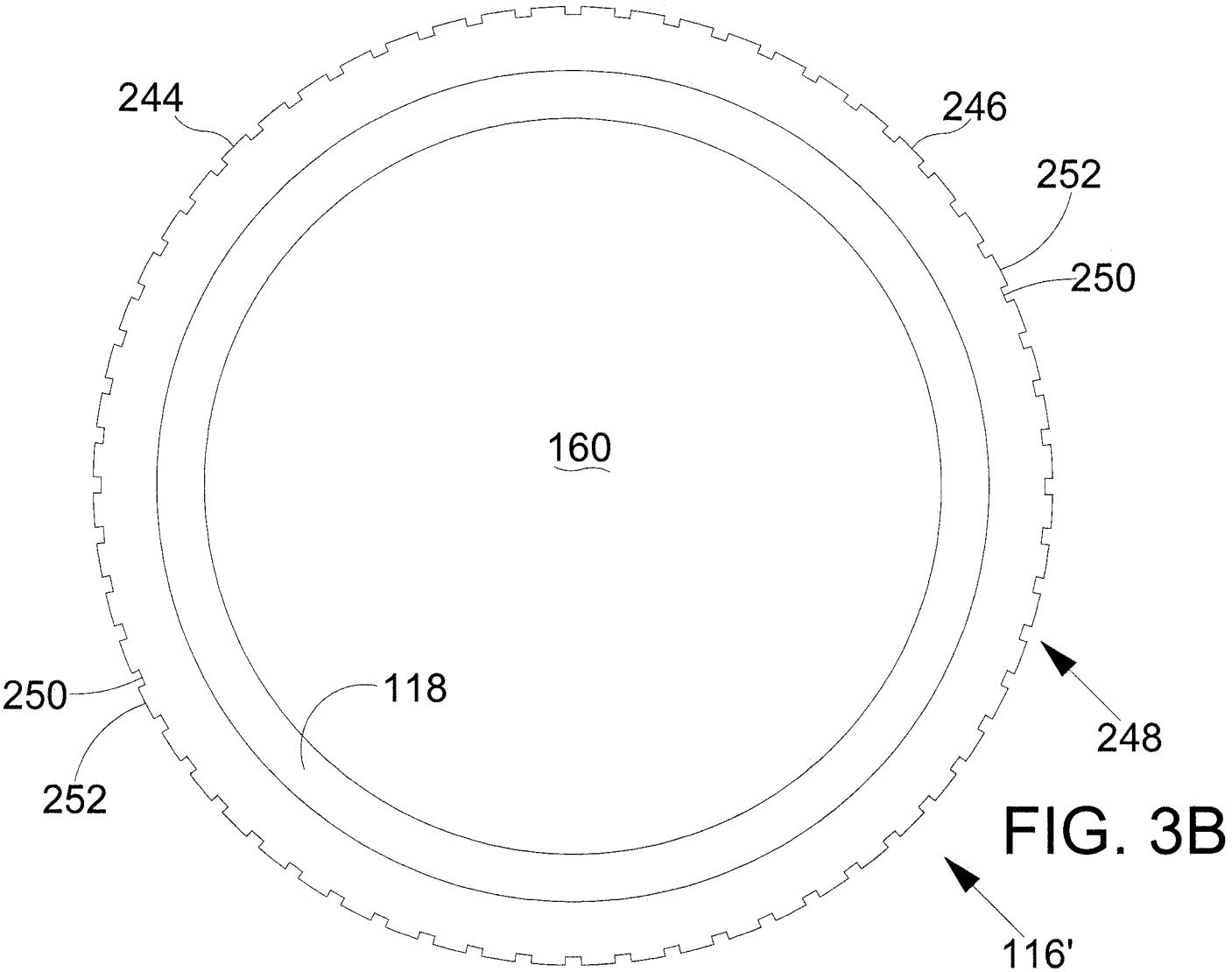
FIG. 3B is a plan view showing an annular body in accordance with an example embodiment.

FIG. 3B is a plan view showing an annular body 116' in accordance with an example embodiment. In the example embodiment of FIG. 3B, the annular body 116' includes a plurality of gripping elements 244. The gripping elements 244 comprise a plurality of protrusions 246 and a plurality of grooves 248. In some embodiments, each protrusion 246 is disposed between two grooves 248. In some embodiments, each groove 248 is disposed between two protrusions 246. In some embodiments, each protrusion 246 extends between a first surface 250 and a second surface 252. In some embodiments, each groove 248 extends between a first surface 250 and a second surface 252.

Figure 4:
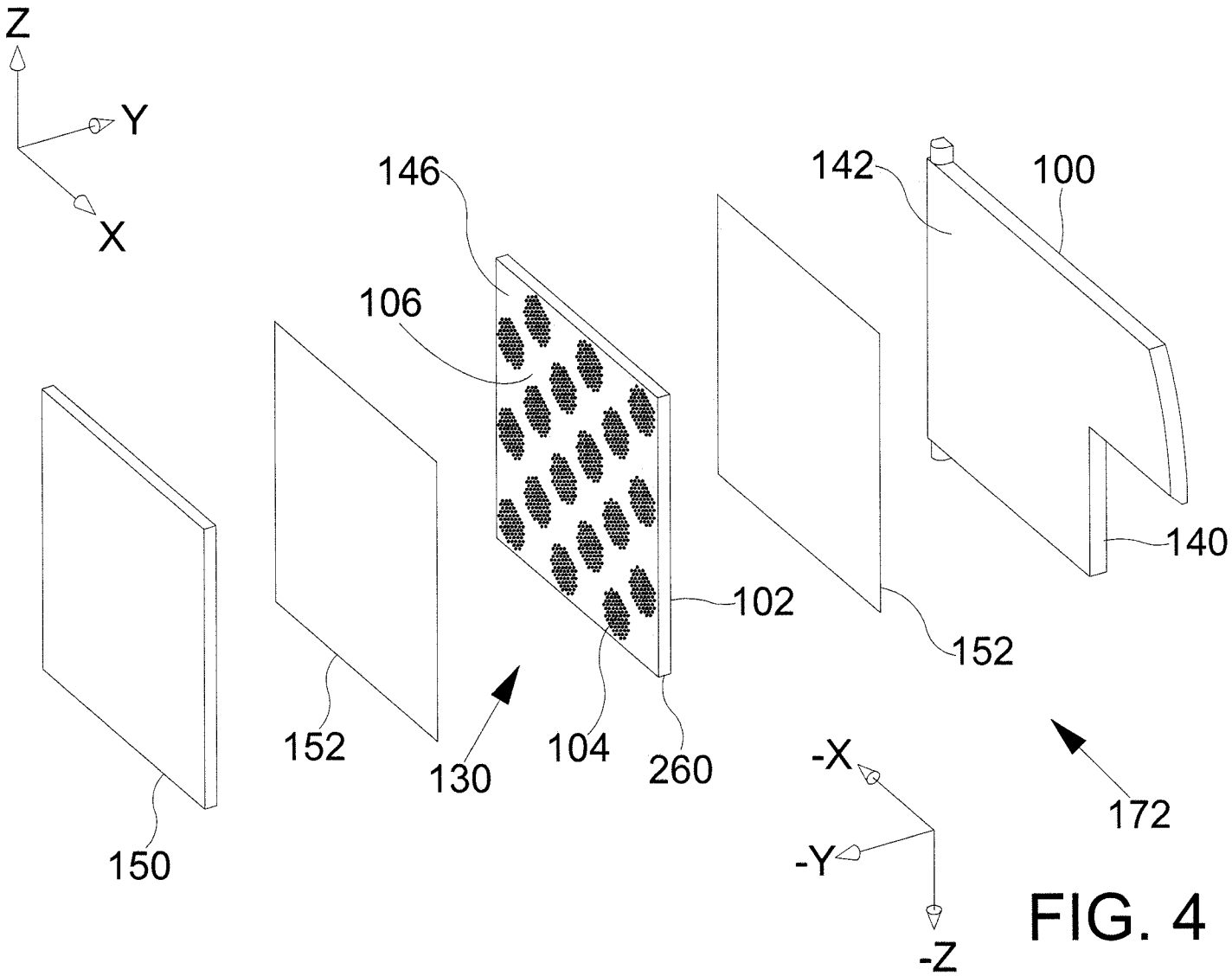
FIG. 4 is an exploded perspective view showing an assembly including a magnetic sheet and a baseplate.
Figure 5:
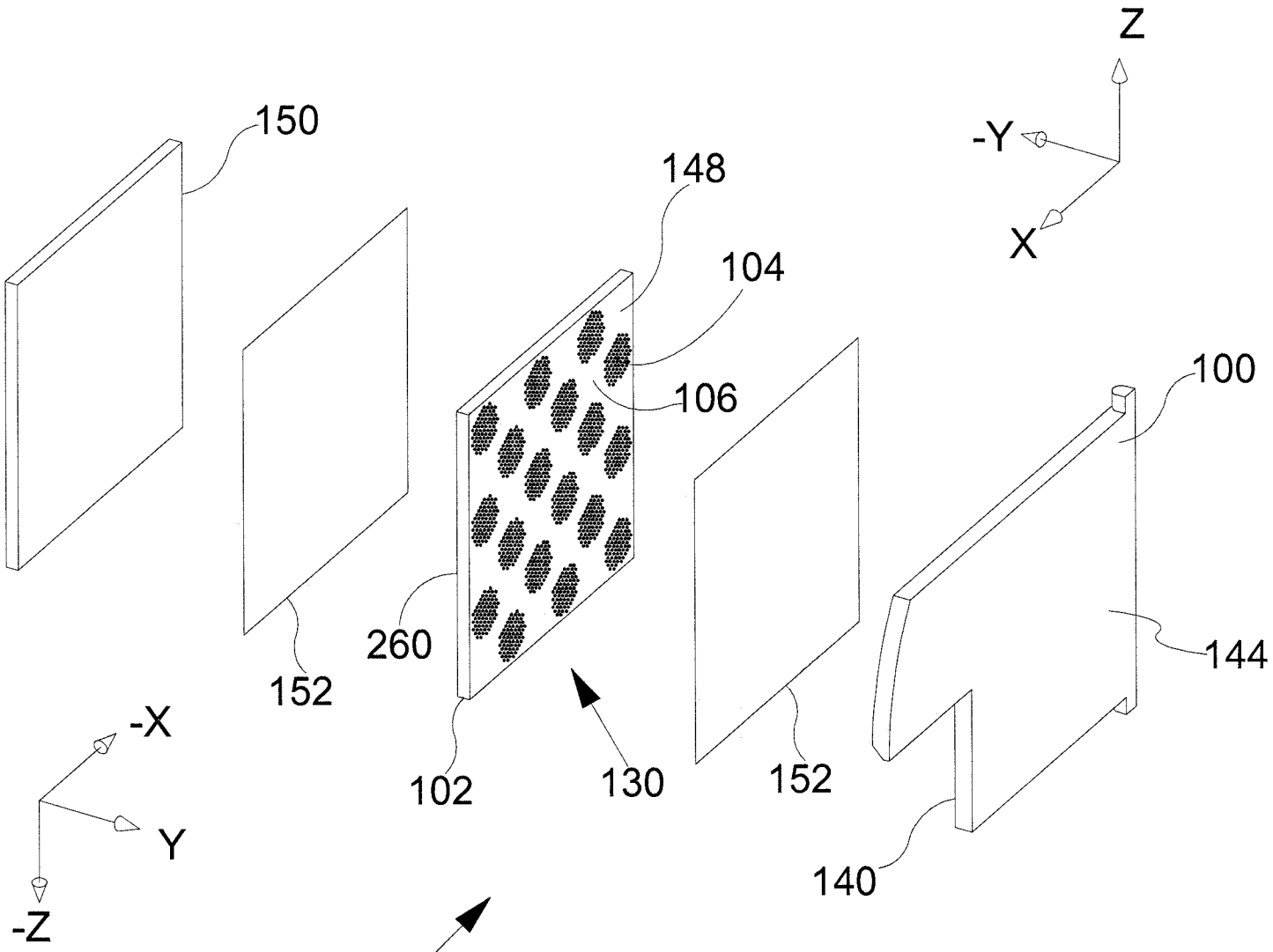
FIG. 5 is an exploded perspective view showing an assembly including a magnetic sheet and a baseplate.

FIGS. 4 and 5 are exploded perspective views showing a magnet assembly 172 and a baseplate 100. In the example embodiment of FIGS. 4 and 5, the magnet assembly 172 comprises a magnet 260, a baseplate 100, and an interface member 150. In the example embodiment of FIGS. 4 and 5, the magnet 260 comprises a magnetic sheet 102. In some embodiments, the baseplate 100 comprises a baseplate wall 140 having a forward facing surface 142, a rearward facing surface 144, and a wall thickness extending between the forward facing surface 142 and the rearward facing surface 144. When the magnet assembly 172 is in an assembled state, the magnetic sheet 102 may be positioned to overlay the rearward facing surface 144 of the baseplate wall 140. In embodiments, the magnetic sheet 102 has a forward face 146, a rearward face 148, and a sheet thickness extending between the forward face 146 and the rearward face 148. A layer of adhesive 152 may be disposed between the forward face 146 of the magnetic sheet 102 and the rearward facing surface 144 of the baseplate wall 140 in some embodiments. When the magnet assembly 172 is in an assembled state, the interface member 150 may be positioned to overlay the rearward face 148 of the magnetic sheet 102. A layer of adhesive 152 may be disposed between the rearward face 148 of the magnetic sheet 102 and the interface member 150. The interface member 150 may comprise various materials without deviating from the spirit and scope of this detailed description. Examples of materials that may be suitable in some applications include (and are not limited to): thin silicone tape, conformal coatings (e.g., Dowsil 1-2577), 3M Grip Tape, rubber sprays and coatings (e.g., PLASTI DIP multipurpose rubber coating available from Plasti Dip International of Blaine, Minn.), abrasive tapes, and tacky adhesive tapes. In some embodiments, the shear force of coatings tapes may be optimized for each magnet system design to provide a high coefficient of friction with durability at a minimum thickness to maintain the maximum magnetic attach (normal) forces.

Still referring to FIGS. 4 and 5, in embodiments, the magnetic sheet 102 comprises a plurality of island portions 104 with interstitial portions 106 of the magnetic sheet 102 disposed about each island portion 104. In FIGS. 4 and 5, the island portions 104 can be seen forming an array 130 across the face of the magnetic sheet 102. The plurality of island portions 104 are arranged to form a plurality of rows and a plurality of columns in the example embodiment of FIGS. 4 and 5. It is noted that the island portions 104 may be arranged in other patterns without deviating from the spirit and scope of this detailed description.

Figures 6A, 6B, 6C, 6D, 6E:
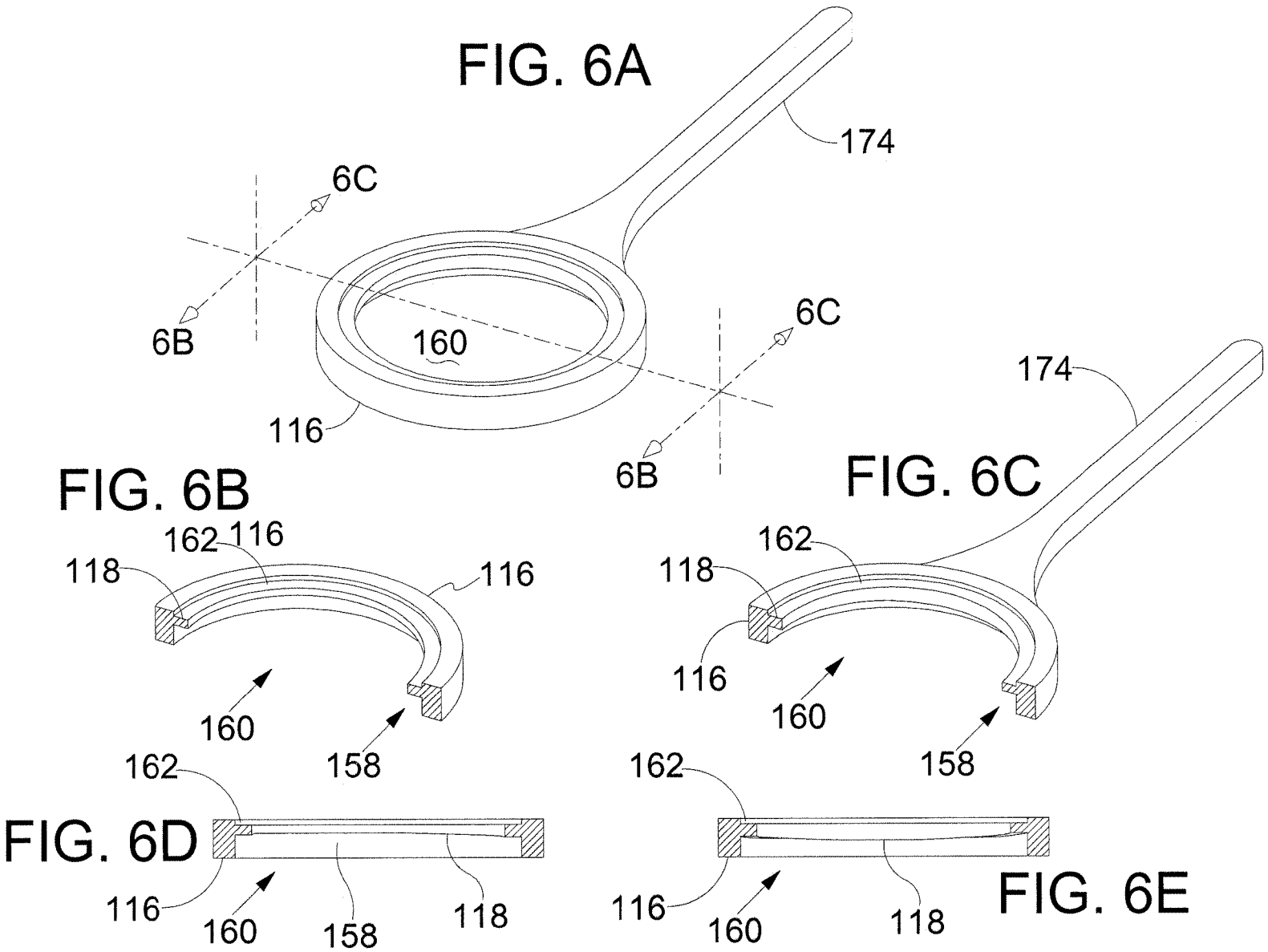
FIG. 6A is a perspective view showing an annular body and a handle portion.
FIG. 6B is a cross-sectional perspective view further illustrating the annular body shown in FIG. 6A. In the embodiment of FIG. 6B, the annular body has been cut along section line 6B-6B shown in FIG. 6A.
FIG. 6C is a cross-sectional perspective view further illustrating the annular body shown in FIG. 6A. In the embodiment of FIG. 6C, the annular body has been cut along section line 6C-6C shown in FIG. 6A.
FIG. 6D is a cross-sectional perspective view further illustrating the annular body shown in FIG. 6B.
FIG. 6E is a cross-sectional perspective view further illustrating the annular body shown in FIG. 6C.

FIG. 6A is a perspective view showing an annular body 116 and a handle portion 174 extending in a radial direction from the annular body 116. FIG. 6B is a cross-sectional perspective view further illustrating the annular body 116 shown in FIG. 6A. In the embodiment of FIG. 6B, the annular body 116 and the handle portion 174 have been cut along section line 6B-6B shown in FIG. 6A. FIG. 6C is a cross-sectional perspective view further illustrating the annular body 116 shown in FIG. 6A. In the embodiment of FIG. 6C, the annular body 116 and the handle portion 174 have been cut along section line 6C-6C shown in FIG. 6A.

With reference to FIGS. 6A, 6B, and 6C, it will be appreciated that the annular body 116 defines a cavity 160 and the annular body 116 includes a camming rib 118 that extends radially inward into the cavity 160. FIG. 6D is a cross-sectional elevation view further illustrating the annular body 116 shown in FIG. 6B and FIG. 6E is a cross-sectional perspective view further illustrating the annular body 116 shown in FIG. 6C. FIGS. 6A through 6E may be collectively referred to as FIG. 6. In the example embodiment of FIG. 6, the annular body 116 defines a counterbore 162 opening in a first direction and a relief 158 opening in a second direction. Also in the example embodiment of FIG. 6, the camming rib 118 disposed between the counterbore 162 and the relief 158. In some example embodiments, the handle portion 174 has a proximal end, a distal end, and a shaft portion extending between the proximal end and the distal end, the proximal end being fixed to the annular body 116. In some example embodiments, the handle portion 174 has a proximal end, a distal end, and a shaft portion extending between the proximal end and the distal end, the proximal end being received in a socket defined by the annular body 116.

Figure 7A:
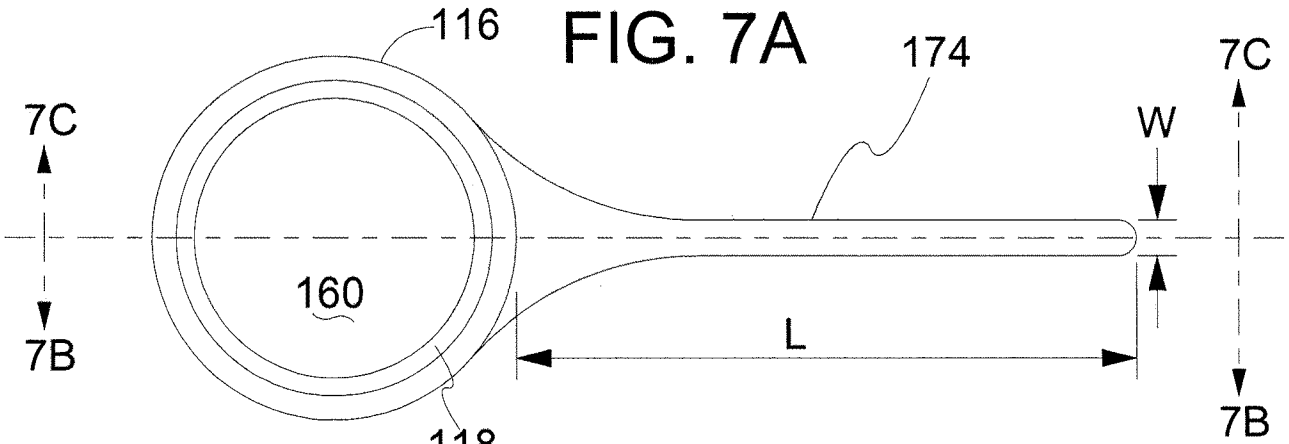
FIG. 7A is a plan view showing an annular body and a handle portion.
Figure 7B:
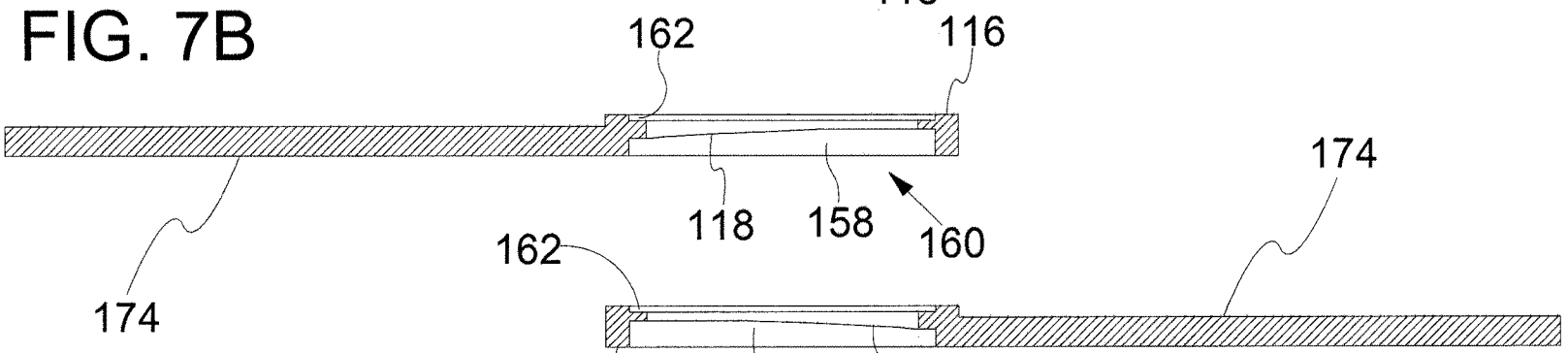
FIG. 7B is a cross-sectional view further illustrating the annular body shown in FIG. 7A. In the embodiment of FIG. 7B, the annular body and the handle portion have been cut along section line 7B-7B shown in FIG. 7A.
Figure 7C:
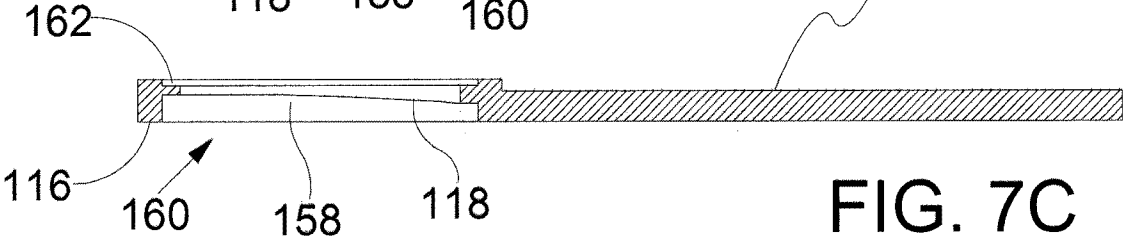
FIG. 7C is a cross-sectional view further illustrating the annular body shown in FIG. 7A. In the embodiment of FIG. 7C, the annular body and the handle portion have been cut along section line 7C-7C shown in FIG. 7A.

FIG. 7A is a plan view showing an annular body 116 and a handle portion 174 extending in a radial direction from the annular body 116. FIG. 7B and FIG. 7C are cross-sectional views further illustrating the annular body 116 shown in FIG. 7A. In the embodiment of FIG. 7B, the annular body 116 and the handle portion 174 have been cut along section line 7B-7B shown in FIG. 7A. In the embodiment of FIG. 7C, the annular body and the handle portion have been cut along section line 7C-7C shown in FIG. 7A. FIGS. 7A through 7C may be collectively referred to as FIG. 7. With reference to FIG. 7, it will be appreciated that the handle body 116 has a length L and a width W. In some example embodiments, the handle portion 174 has an elongate shape. In some embodiments, the handle portion 174 has an aspect ratio of length to width that is greater than 5. In some embodiments, the handle portion 174 has an aspect ratio of length to width that is greater than 10. In some embodiments, the handle portion 174 has an aspect ratio of length to width that is greater than 15.

Figure 8A:
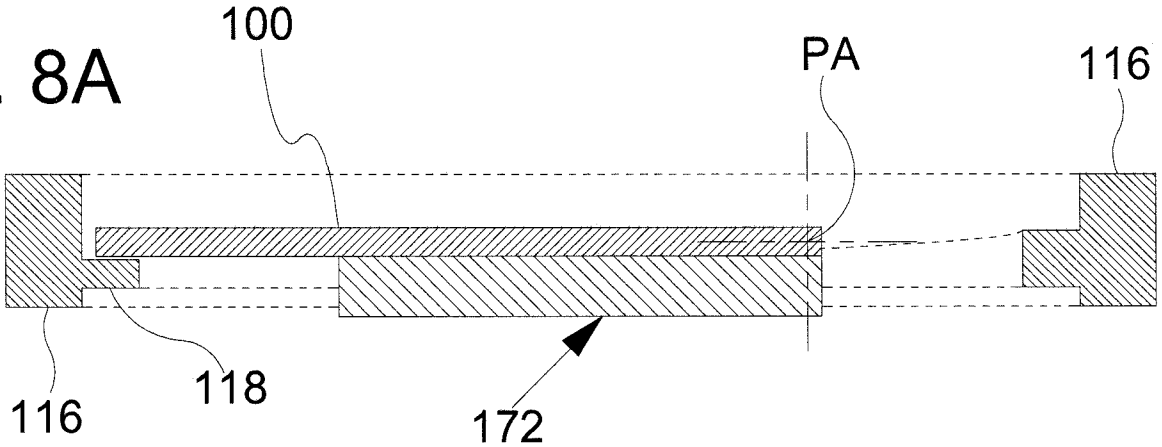
FIG. 8A and FIG. 8B are stylized diagrams illustrating a pivoting motion of a baseplate and magnet assembly.
Figure 8B:
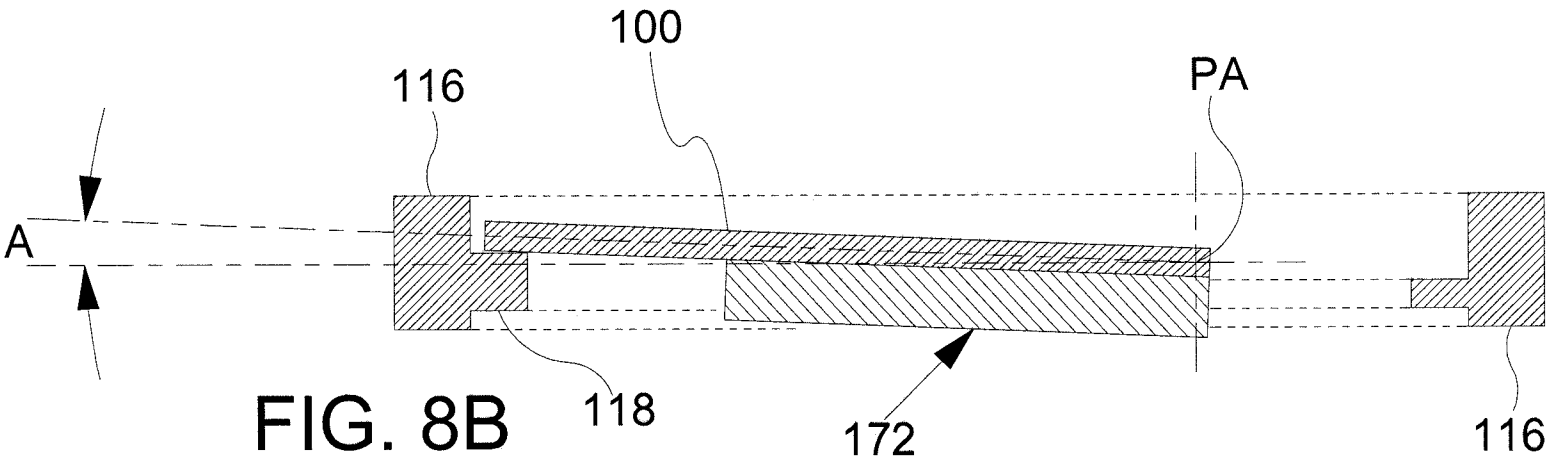

FIG. 8A and FIG. 8B are stylized diagrams illustrating an example pivot motion of a baseplate 100 and a magnet assembly 172 relative to a camming rib 118 of an annular body 116. In the embodiment of FIG. 8A, the baseplate 100 and a magnet assembly 172 are generally parallel to a plane defined by forward facing surface of the annular body 116. By comparing the positions of the baseplate 100 and the magnet assembly 172 in FIG. 8B with the positions of those elements shown in FIG. 8A, it will be appreciated that the baseplate 100 and the magnet assembly 172 have pivoted about a pivot axis PA in the example embodiment of FIG. 8B.

Figure 9A:
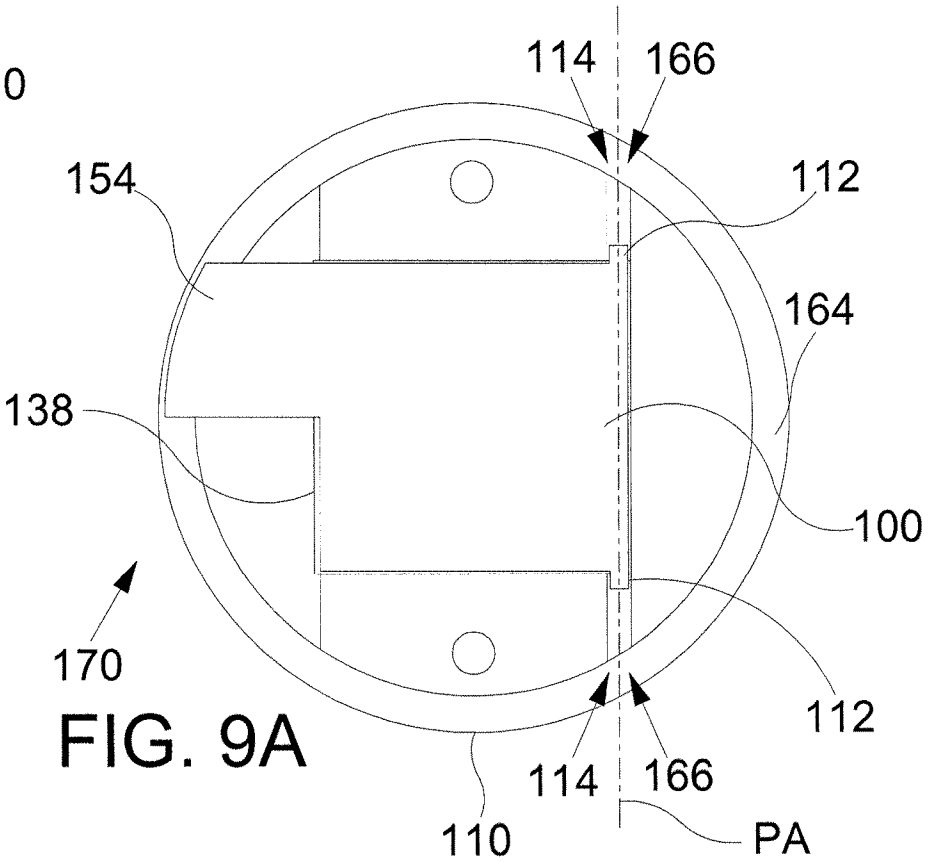
FIG. 9A through FIG. 9F are elevation and plan views showing six sides of an assembly including a baseplate, a magnetic sheet and a core housing.
Figure 9B:
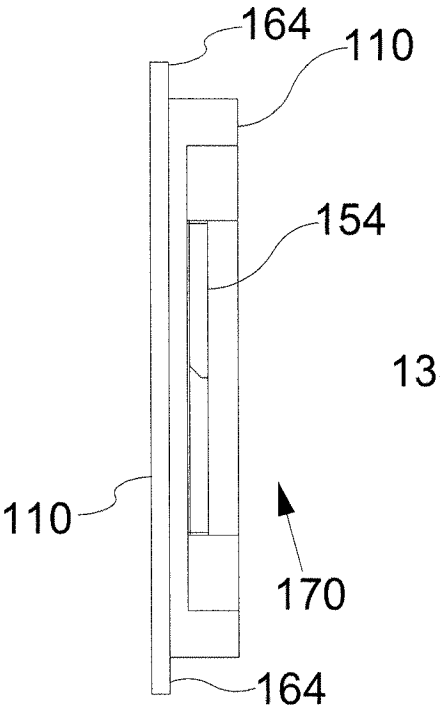
Figure 9C:
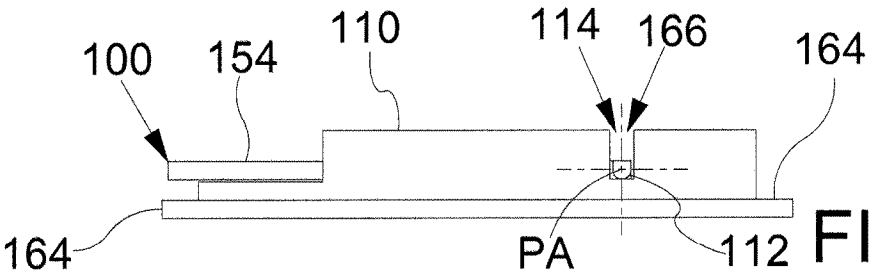
Figure 9F:
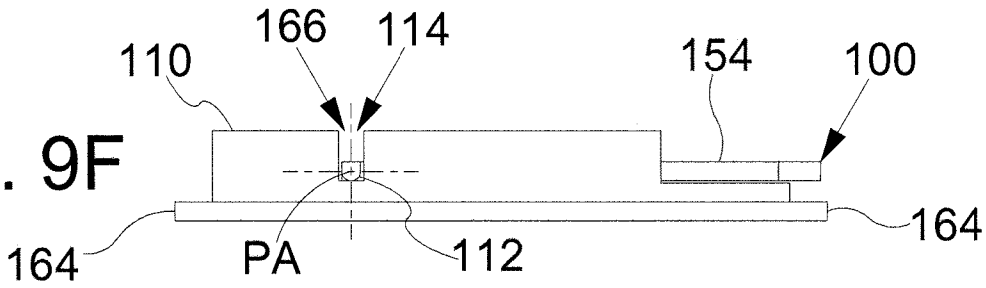
Figure 9D:
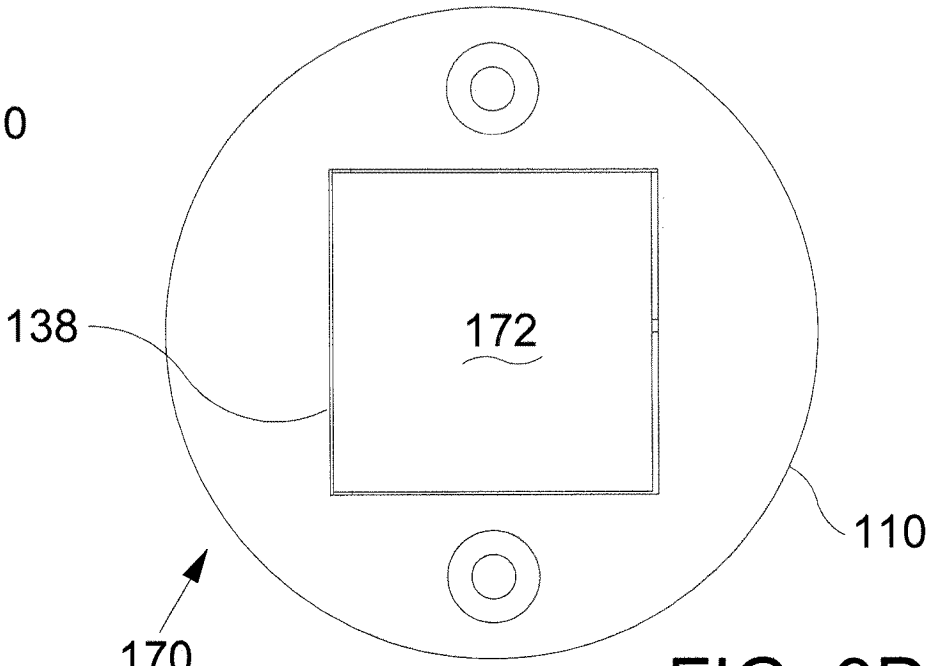
Figure 9E:
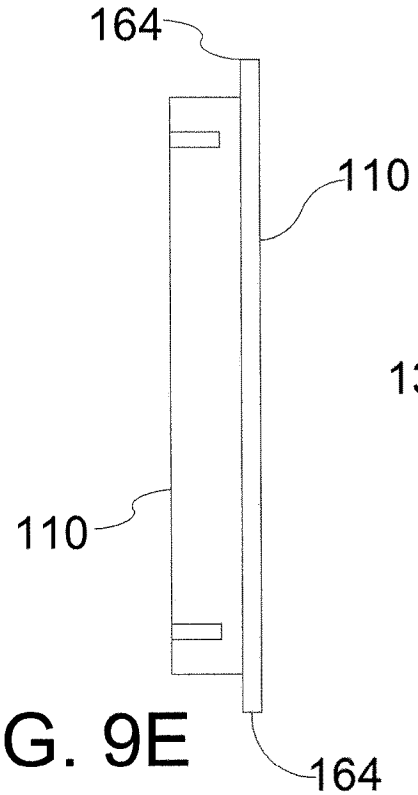

FIG. 9A through FIG. 9F are elevation and plan views showing six sides of an assembly 170. Engineer graphics textbooks generally refer to the process used to create views showing six sides of a three-dimensional object as multiview projection or orthographic projection. It is customary to refer to multiview projections using terms such as front view, right side view, top view, rear view, left side view, and bottom view. In accordance with this convention, FIG. 9A may be referred to as a front view of the assembly 170, FIG. 9B may be referred to as a left side view of the assembly 170, and FIG. 9C may be referred to as a top view of the assembly 170. FIG. 9A through FIG. 9F may be referred to collectively as FIG. 9. Terms such as front view and top view are used herein as a convenient method for differentiating between the views shown in FIG. 9. It will be appreciated that the elements shown in FIG. 9 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 9D may be referred to as a rear view of the assembly 170, FIG. 9E may be referred to as a right side view of the assembly 170, and FIG. 9F may be referred to as a bottom view of the assembly 170.

In the example embodiment of FIG. 9, the assembly 170 comprises a core housing 110 defining a pocket 138, a magnet assembly 172 disposed in the pocket 138, and a baseplate 100 fixed to the magnet assembly 172. The baseplate 100 includes a tab portion 154 that extends beyond a periphery of the magnet assembly 172 in the example embodiment of FIG. 9. The baseplate 100 includes a pivot portion 112 that engages a corresponding portion 114 of the core housing 110 to form a hinge joint 166 such that the baseplate 100 and the magnet assembly 172 selectively pivot about a pivot axis PA of the hinge joint 166 relative to the core housing 110.

Figure 10:
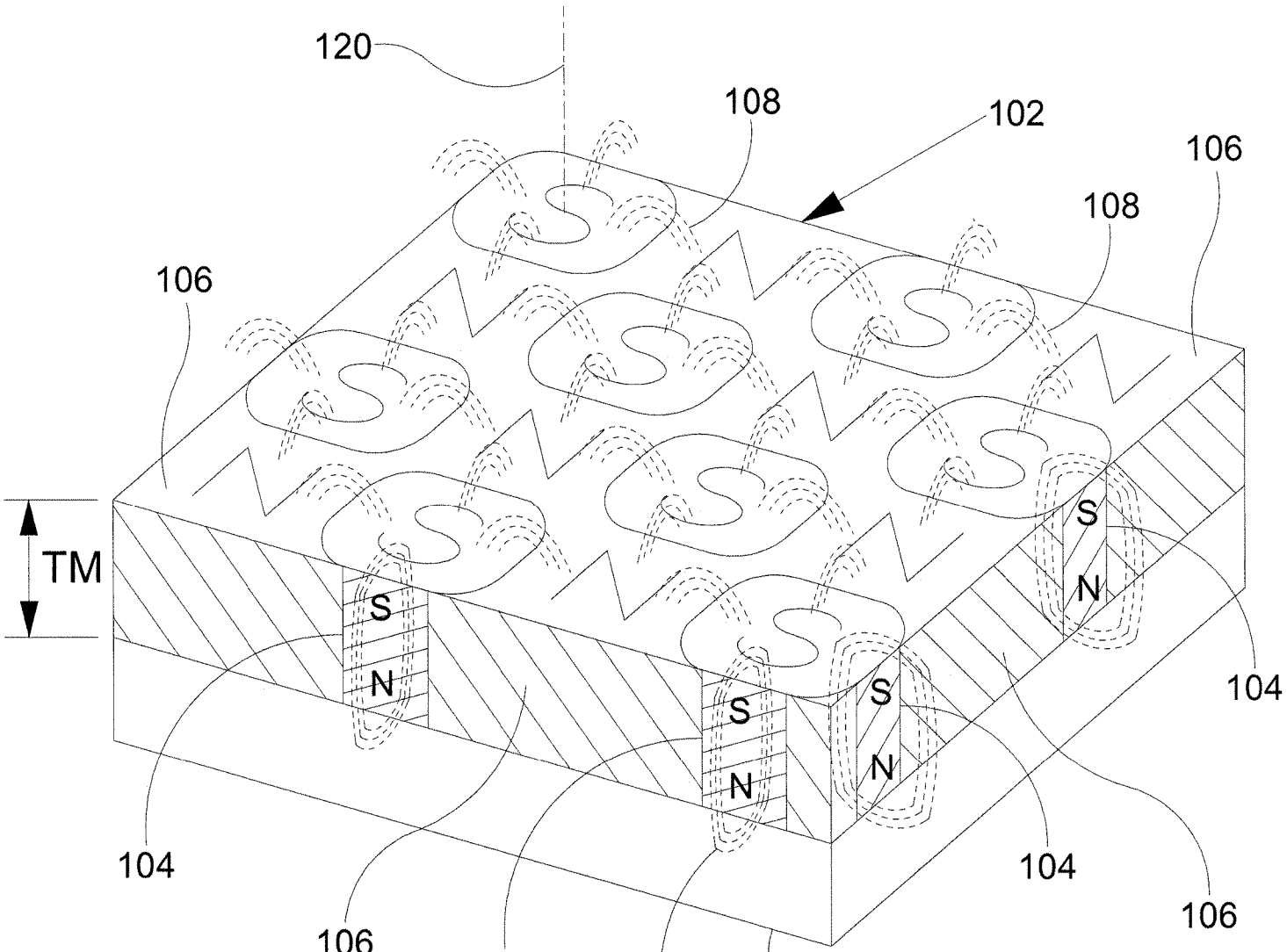
FIG. 10 is a stylized isometric view of an assembly including a baseplate and a magnetic sheet overlaying a major surface of the baseplate.

FIG. 10 is a stylized isometric view of an assembly including a baseplate 100 and a magnetic sheet 102 overlaying a major surface of the baseplate 100. The magnetic sheet 102 includes a plurality of island portions 104 with interstitial portions 106 of the magnetic sheet 102 disposed about each island portion 104. Each island portion 104 has a north pole N and a south pole S. In FIG. 10, magnetic flux 108 of each island portion 104 is shown flowing through the north pole N and the south pole S of the respective island portion 104. A magnetic axis 120 of each island portion 104 extends through the north pole N and the south pole S of the respective island portion 104. Each magnetic axis 120 is generally orthogonal to the faces of the magnetic sheet 102. The north pole N and the south pole S of each island portion 104 are positioned so that each island has a first magnetic polarity. The interstitial portions 106 of the magnetic sheet 102 have a second magnetic polarity that is the opposite of the first magnetic polarity. With reference to FIG. 10, it will be appreciated that the magnetic sheet 102 has a magnet thickness TM. The magnet thickness TM of the magnetic sheet 102 is illustrated using dimension lines in FIG. 10.

Figure 11:
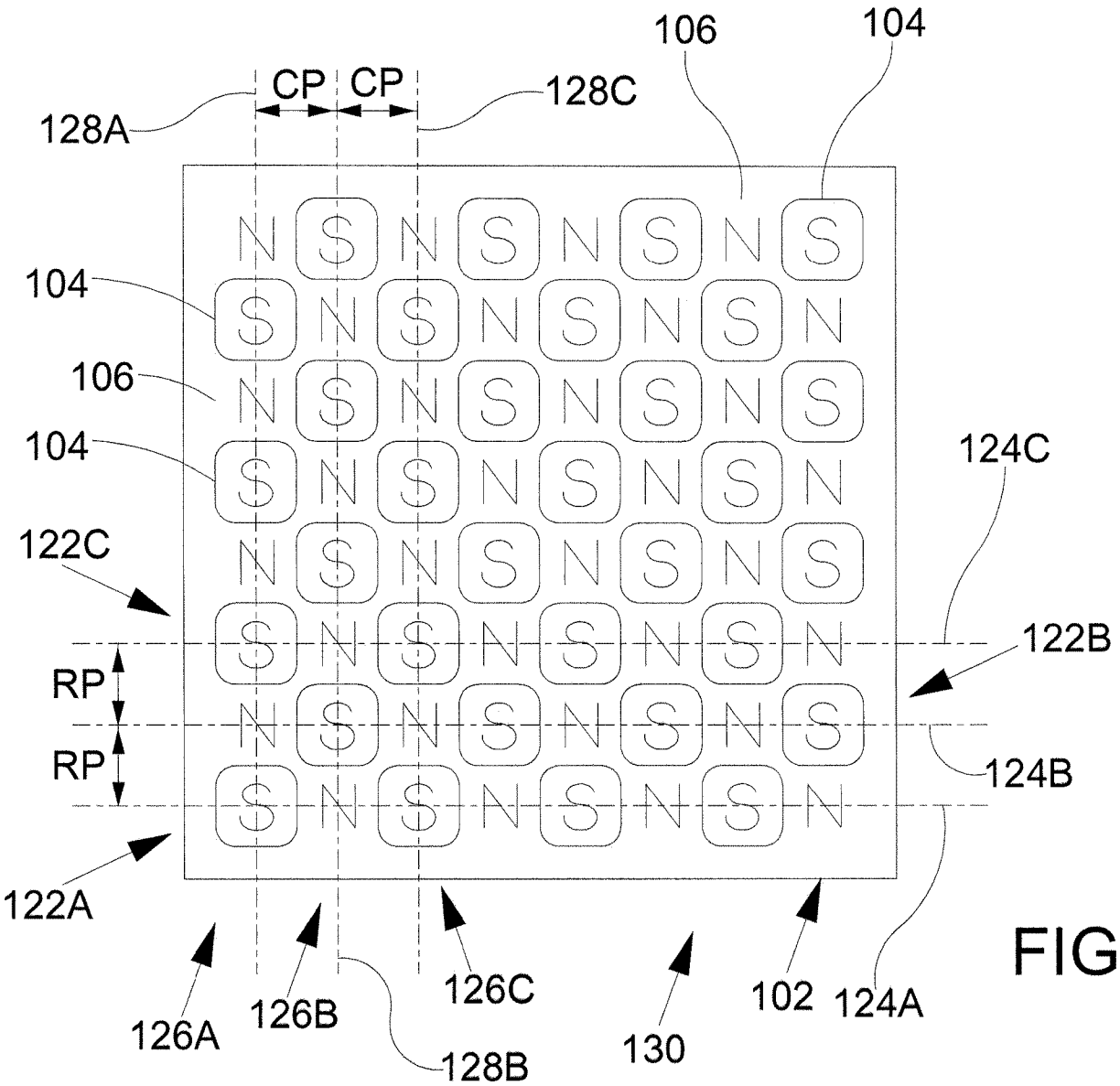
FIG. 11 is a stylized plan view of the assembly shown in FIG. 10. The assembly shown in FIG. 10 includes the magnetic sheet overlaying a major surface of the baseplate (visible in FIG. 10).

FIG. 11 is a stylized plan view of the assembly shown in FIG. 3. The assembly includes the magnetic sheet 102 overlaying a major surface of the baseplate 100 (visible in FIG. 3). With reference to FIG. 11 it will be appreciated that the magnetic sheet 102 includes a plurality of island portions 104 with interstitial portions 106 disposed about each island portion 104. In FIG. 11, the island portions 104 can be seen forming an array 130 across the face of the magnetic sheet 102. The plurality of island portions 104 include a first row 122A of island portions 104 aligned along a first row line 124A, a second row 122B of island portions 104 aligned along a second row line 124B, and a third row 122C of island portions 104 aligned along a third row line 124C. The plurality of island portions 104 also include a first column 126A of island portions 104 aligned along a first column line 128A, a second column 126B of island portions 104 aligned along a second column line 128B, and a third column 126C of island portions 104 aligned along a third column line 128C. In the embodiment of FIG. 11, the array 130 of island portions 104 includes a plurality of rows and a plurality of columns. It is noted that the island portions 104 may be arranged in other patterns without deviating from the spirit and scope of this detailed description.

In some useful embodiments, the array 130 of island portions 104 in the magnetic sheet 102 is configured and dimensioned to produce magnetic flux 108 (illustrated in FIGS. 10 and 12) within an effective zone that is relatively thin. Concentrating the magnetic flux within a relatively thin effective zone may maximize the magnetic attraction produced between the magnetic sheet 102 and a thin item such as a ferromagnetic foil or layers of ferromagnetic paint. In the embodiment of FIG. 11, adjacent columns are separated from one another by a column pitch distance CP. The column pitch distance CP is illustrated using dimension lines extending between adjacent column lines in FIG. 11. In some useful embodiments, an aspect ratio of the column pitch CP to the magnet thickness TM of the magnetic sheet 102 is between about 5 and about 1. In some useful embodiments, an aspect ratio of the column pitch CP to the magnet thickness TM of the magnetic sheet 102 is between about 4 and about 2.

In the embodiment of FIG. 11, adjacent rows are separated from one another by a row pitch distance RP. The row pitch distance RP is illustrated using dimension lines extending between adjacent row lines in FIG. 11. In some useful embodiments, an aspect ratio of the row pitch RP to the magnet thickness TM of the magnetic sheet 102 is between about 5 and about 1. In some useful embodiments, an aspect ratio of the row pitch RP to the magnet thickness TM of the magnetic sheet 102 is between about 4 and about 2. In the example embodiment of FIG. 11, the row pitch RP is approximately equal to the column pitch CP.

Figure 12:
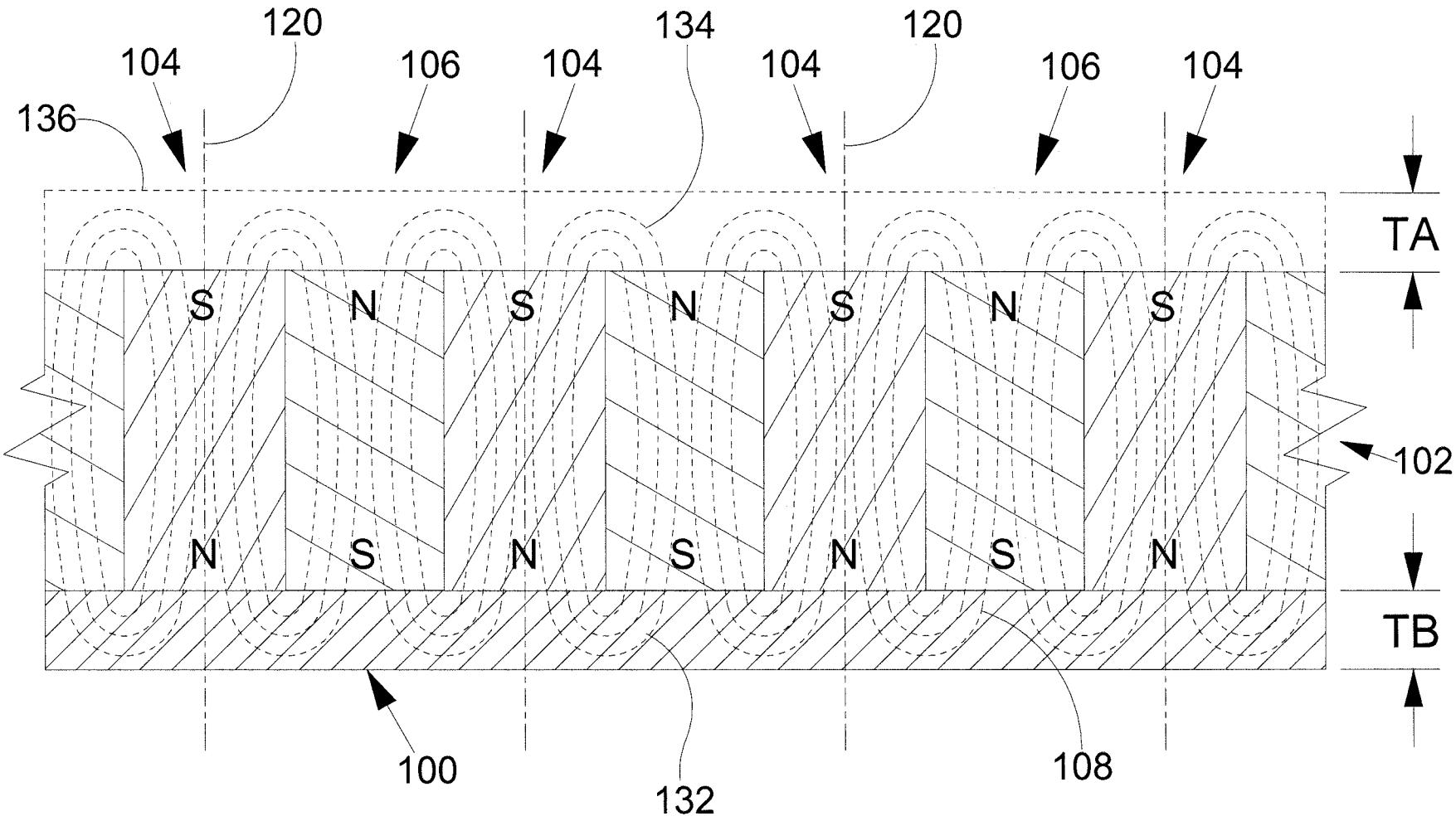
FIG. 12 is a stylized cross-sectional view of the assembly shown in FIGS. 10 and 11.

FIG. 12 is a stylized cross-sectional view of the assembly shown in FIGS. 3 and 4. The assembly includes a magnetic sheet 102 and a baseplate 100. The magnetic sheet 102 includes a plurality of island portions 104 with interstitial portions 106 of the magnetic sheet 102 disposed about each island portion 104. Each island portion 104 has a north pole N and a south pole S. A magnetic axis 120 of each island portion 104 extends through the north pole N and the south pole S of the respective island portion 104. Each magnetic axis 120 is generally orthogonal to the faces of the magnetic sheet 102. The north pole N and the south pole S of each island portion 104 are positioned so that each island has a first magnetic polarity. The interstitial portions 106 of the magnetic sheet 102 have a second magnetic polarity that is the opposite of the first magnetic polarity.

Each island portion 104 has magnetic flux 108 flowing through the north pole N and the south pole S thereof. With reference to FIG. 12, it will be appreciated that a first portion 132 of the magnetic flux 108 of each island portion 104 flows through the baseplate 100 and a second portion 134 of the magnetic flux 108 of each island portion 104 flows through an effective zone 136 of the magnetic sheet 102. In the embodiment of FIG. 12, the second portion 134 has a shape that is generally a mirror image of the shape of the first portion 132. Ferromagnetic items positioned to extend into the effective zone 136 of the magnetic sheet 102 will be magnetically attracted to the magnetic sheet 102. Ferromagnetic items located outside of the effective zone 136 will not be magnetically attracted to the magnetic sheet 102.

With reference to FIG. 12, it will be appreciated that the effective zone 136 has a first thickness TA and the baseplate 100 has a second thickness TB. In the embodiment of FIG. 12, the first thickness TA is generally equal to the second thickness TB. In some useful embodiments, the magnetic sheet 102 and the baseplate 100 are configured and dimensioned to produce magnetic flux 108 within an effective zone 136 that is relatively thin. Concentrating the magnetic flux within a relatively thin effective zone 136 may maximize the magnetic attraction produced between the magnetic sheet 102 and a thin item such as a ferromagnetic foil or layers of ferromagnetic paint. In some useful embodiments, the magnetic sheet 102 has a thickness of about 0.040 inches and the baseplate 100 has a thickness of about 0.015 inches. In some useful embodiments, the magnetic sheet 102 has a thickness of about 0.0625 inches and the baseplate 100 has a thickness of about 0.048 inches.

Referring to FIGS. 1-12, in embodiments, a device for detachable attachment to a ferromagnetic surface comprises a core housing 110 defining a pocket 138, a magnet assembly 172 disposed in the pocket 138, and a baseplate 100 fixed to the magnet assembly 172. In some embodiments, the baseplate 100 includes a tab portion 154 that extends beyond a periphery of the magnet assembly 172. In some embodiments, the baseplate 100 also includes a pivot portion 112 that engages a corresponding portion 114 of the core housing 110 to form a hinge joint 166 such that the baseplate 100 and the magnet assembly 172 selectively pivot about a pivot axis PA of the hinge joint 166 relative to the core housing 110.

In some embodiments, an annular body 116 is disposed about the core housing 110 such that the annular body 116 is rotatable about a rotational axis RA relative to the core housing 110. In some embodiments, the annular body 116 defines a cavity 160 and the annular body 116 includes a camming rib 118 that extends radially inward into the cavity 160. In some embodiments, the camming rib 118 applies a camming force to the tab portion 154 of the baseplate 100 upon rotation of the annular body 116 relative to the core housing 110 and the camming force urges the magnet assembly 172 and the baseplate 100 to pivot about the pivot axis PA of the hinge joint 166.

In some embodiments, the device includes a cap member 156 that is fixed to the core housing 110 with the camming rib 118 disposed between the cap member 156 and a flange portion 164 of the core housing 110. In some embodiments, the annular body 116 defines a counterbore 162 and the flange portion 164 of the core housing 110 is disposed at least partially in the counterbore 162 defined by the annular body 116. In some embodiments, the annular body 116 defines a relief 158 and a portion of the cap member is disposed in the relief 158 defined by the annular body 116. In some embodiments, the annular body 116 has a counterbore 162 opening in a first direction, a relief 158 opening in a second direction, and a camming rib 118 disposed between the counterbore 162 and the relief 158. In some embodiments, the cap member 156 has a disk-shaped body. In some embodiments, the cap member 156 has a circular shape when viewed as an orthographic projection.

Still referring to FIGS. 1-12, in embodiments, the baseplate 100 comprises a baseplate wall 140 having a forward facing surface 142, a rearward facing surface 144, and a wall thickness extending between the forward facing surface 142 and the rearward facing surface 144. In embodiments, the magnetic sheet 102 is positioned to overlay the rearward facing surface 144 of the baseplate wall 140. In embodiments, the magnetic sheet 102 has a forward face 146, a rearward face 148, and a sheet thickness extending between the forward face 146 and the rearward face 148. In embodiments, the magnetic sheet 102 comprises a plurality of island portions 104 with interstitial portions 106 of the magnetic sheet 102 disposed about each island portion 104. In embodiments, each island portion 104 has a north pole and a south pole and magnetic flux 108 flows through the north pole and the south pole of each island portion. In embodiments, the poles of each island portion 104 defining a magnetic axis 120 extending through the island portion 104. In embodiments, each magnetic axis 120 is generally orthogonal to the faces of the magnetic sheet 102. In embodiments, the north pole and the south pole of each island portion 104 are positioned so that each island portion has a first magnetic polarity and the interstitial portions 106 of the magnetic sheet 102 have a second magnetic polarity that is opposite the first magnetic polarity.

Still referring to FIGS. 1-12, in embodiments, the baseplate 100 comprises a ferromagnetic material so that a first portion of the magnet flux flows through the baseplate 100. In embodiments, a second portion 134 of the magnetic flux 108 flows through an effective zone 136 opposite a forward face 146 of the magnetic sheet 102, the second portion 134 of the magnetic flux 108 having a shape that is a mirror image of a first shape of the first portion 132 of the magnetic flux 108. In embodiments, the effective zone 136 has an effective zone thickness and ferromagnetic items located outside the effective zone are not attracted to the magnetic sheet. In embodiments, the effective zone 136 has an effective zone thickness and ferromagnetic items located partially or completely in the effective zone are attracted to the magnetic sheet 102.

Referring to FIGS. 2 through 5, an upward direction Z and a downward or lower direction −Z are illustrated using arrows labeled "Z" and "−Z," respectively. A forward direction Y and a rearward direction −Y are illustrated using arrows labeled "Y" and "−Y," respectively. A first lateral direction X and a second lateral direct −X are illustrated using arrows labeled "X" and "−X," respectively. The directions illustrated using these arrows are applicable to the apparatus shown and discussed throughout this application. The second lateral direction may also be referred to as a left direction and/or the second lateral direction. The first lateral direction may also be referred to as a right direction. In one or more embodiments, the upward direction is generally opposite the downward direction. In one or more embodiments, the upward direction and the downward direction are both generally orthogonal to an XY plane defined by the forward direction and the first lateral direction. In one or more embodiments, the forward direction is generally opposite the rearward direction. In one or more embodiments, the forward direction and the rearward direction are both generally orthogonal to a ZX plane defined by the upward direction and the first lateral direction. In one or more embodiments, the first lateral direction is generally opposite the second lateral direction. In one or more embodiments, first lateral direction and the second lateral direction are both generally orthogonal to a ZY plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," should not be interpreted to limit the scope of the invention recited in the attached claims.

Figure 13:
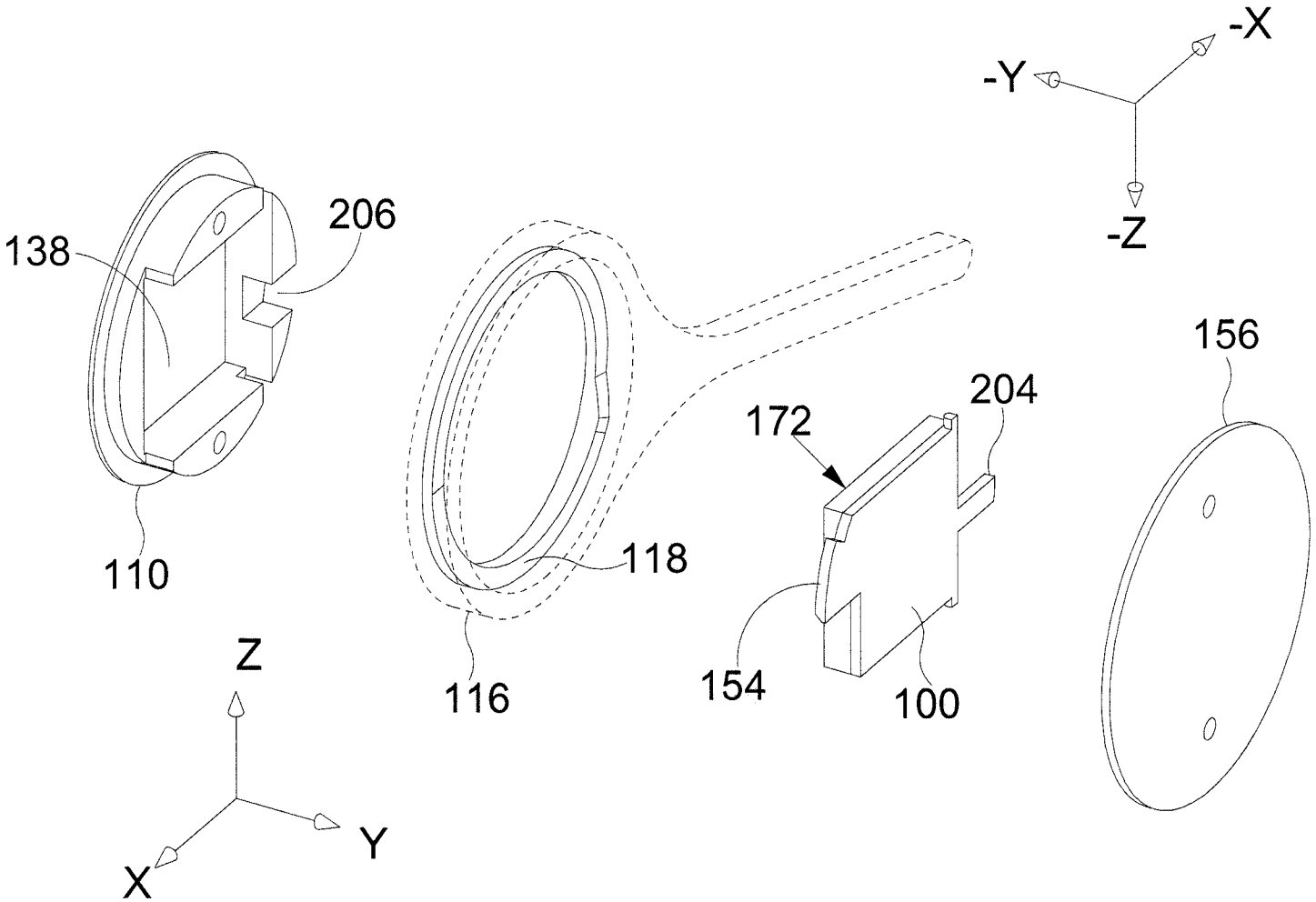
FIGS. 13 and 14 are exploded perspective views showing a detachable magnet device in accordance with an additional example embodiment.
Figure 14:
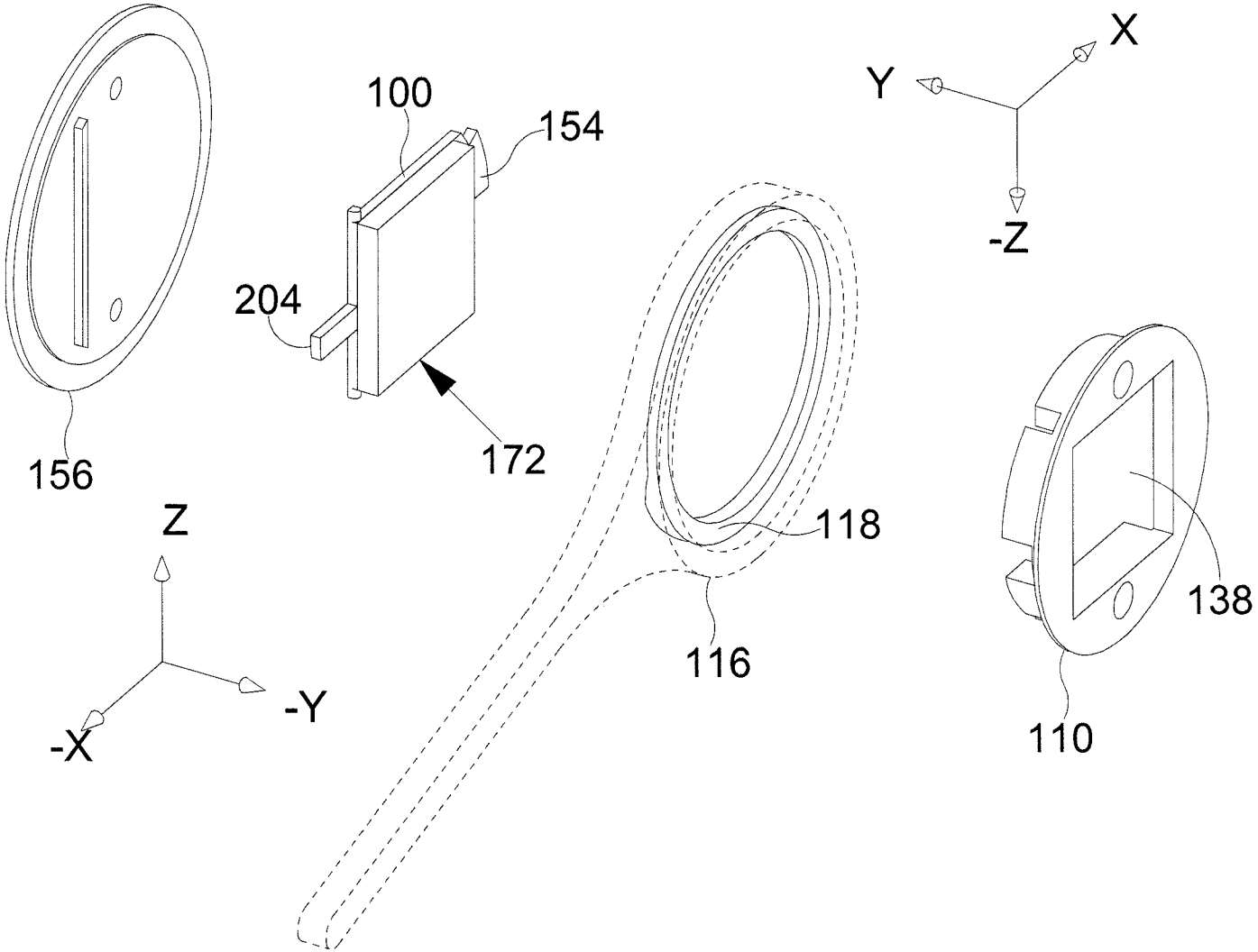

FIGS. 13 and 14 are exploded perspective views showing a detachable magnet device in accordance with an additional example embodiment. In the example embodiment of FIGS. 13 and 14, the detachable magnet device comprises a core housing 110 defining a pocket 138, a magnet assembly 172 that is received in the pocket 138, and a baseplate 100 that is fixed to the magnet assembly 172. In the example embodiment of FIGS. 13 and 14, baseplate 100 includes a lug portion 204. The lug portion 204 of the baseplate is received in a channel 206 defined by the core housing 110 in the example embodiment of FIGS. 13 and 14. In the example embodiment of FIGS. 13 and 14, the baseplate 100 includes a tab portion 154 that extends beyond a periphery of the magnet assembly 172. Also in the example embodiment of FIGS. 13 and 14, the baseplate 100 also includes a pivot portion 112 that is received in a corresponding portion 114 of the core housing 110 to form a hinge joint such that the baseplate 100 and the magnet assembly 172 selectively pivot relative to the core housing 110.

In the example embodiment of FIGS. 13 and 14, the device includes a cap member 156 that can be fixed to the core housing 110 with the camming rib 118 disposed between the cap member 156 and a flange portion 164 of the core housing 110. In the example embodiment of FIGS. 13 and 14, the annular body 116 defines a counterbore 162 and the flange portion 164 of the core housing 110 is disposed at least partially in the counterbore 162 defined by the annular body 116 when the device is assembled. Also in the example embodiment of FIGS. 13 and 14, the annular body 116 defines a relief 158 and a portion of the cap member is disposed in the relief 158 defined by the annular body 116 when the device is assembled. In some embodiments, the annular body 116 has a counterbore 162 opening in a first direction, a relief 158 opening in a second direction, and a camming rib 118 disposed between the counterbore 162 and the relief 158. In some embodiments, the cap member 156 has a disk-shaped body. In some embodiments, the cap member 156 has a circular shape when viewed as an orthographic projection.

Figure 15A:
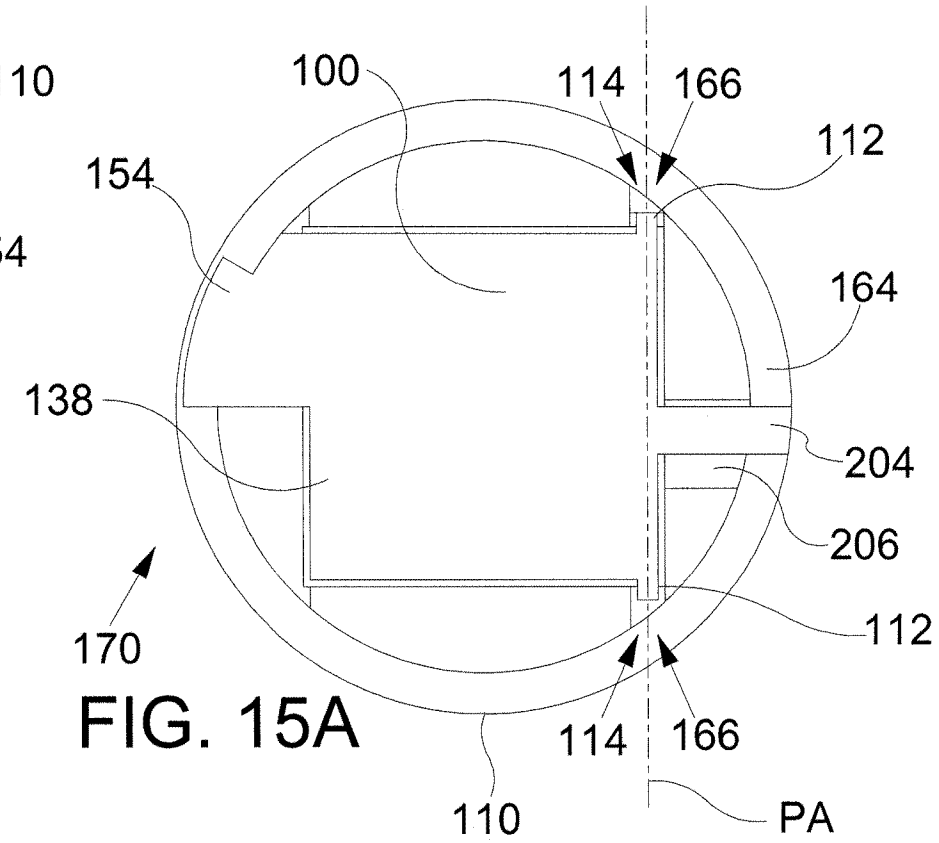
FIG. 15A through FIG. 15F are elevation and plan views showing six sides of an assembly including a baseplate, a magnetic sheet and a core housing.
Figure 15B:
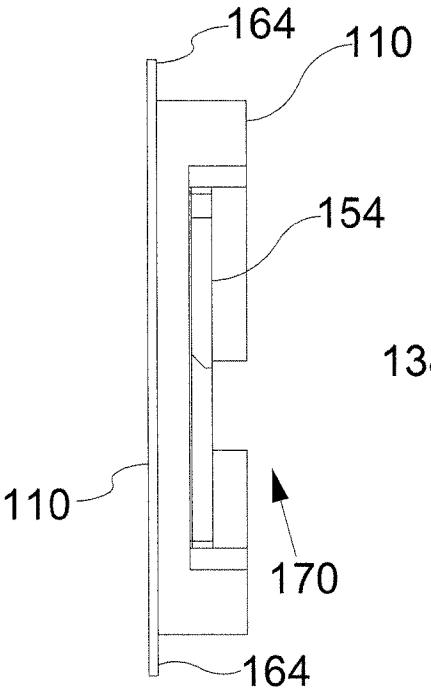
Figure 15C:
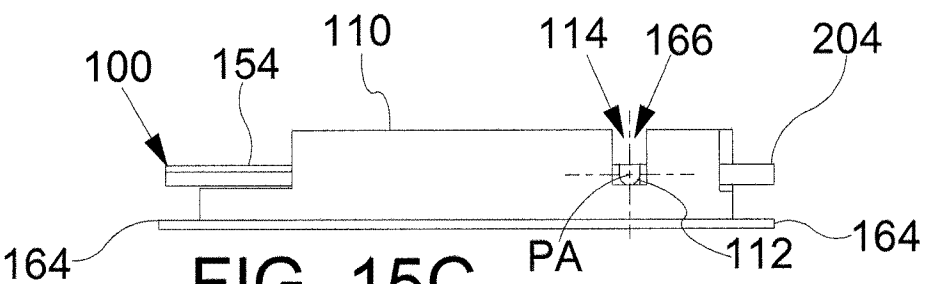
Figure 15F:
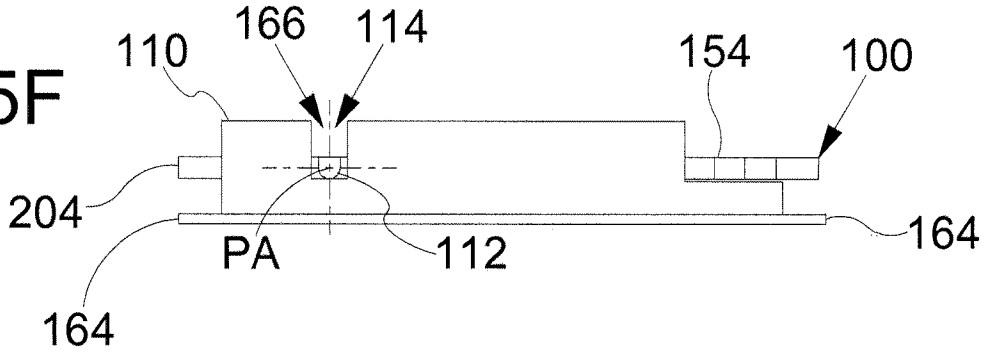
Figure 15D:
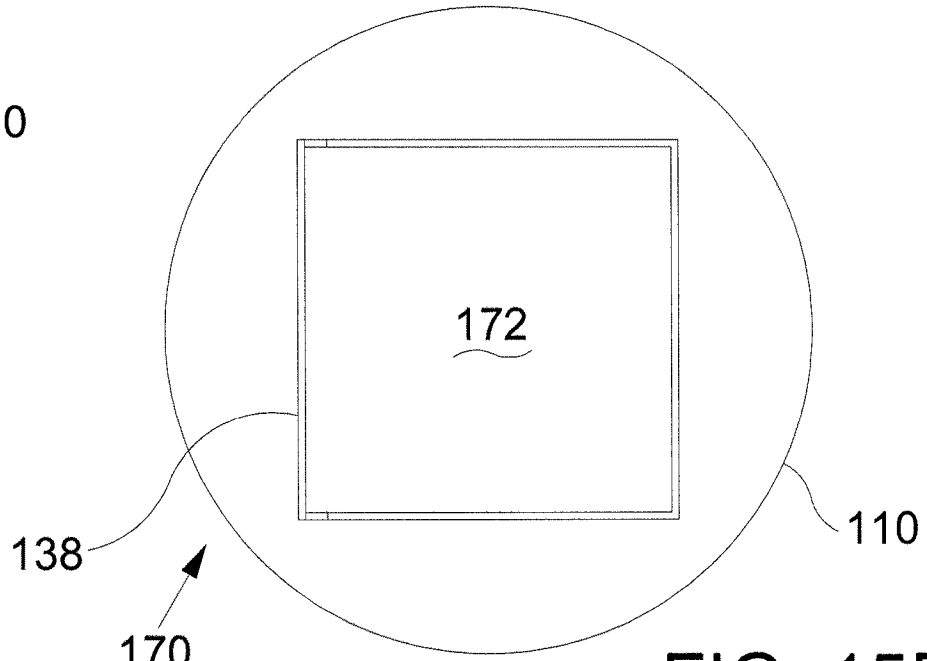
Figure 15E:
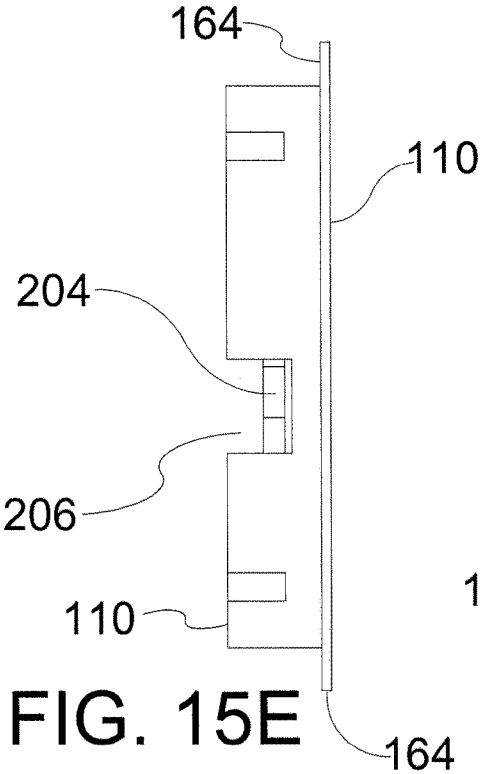
Figure 16:
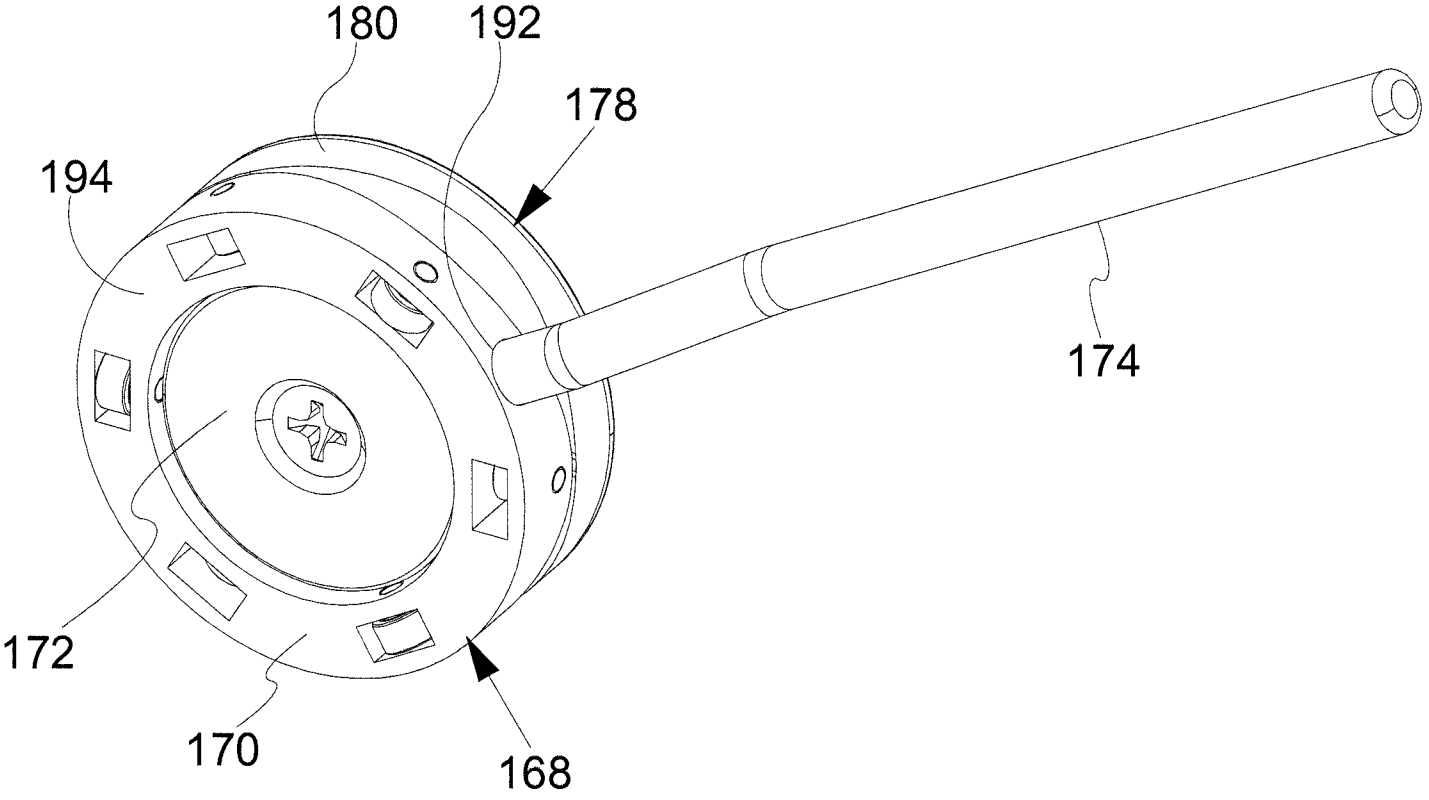
FIG. 16 is a perspective view showing a detachable magnet device in accordance with an additional example embodiment.
Figure 17:
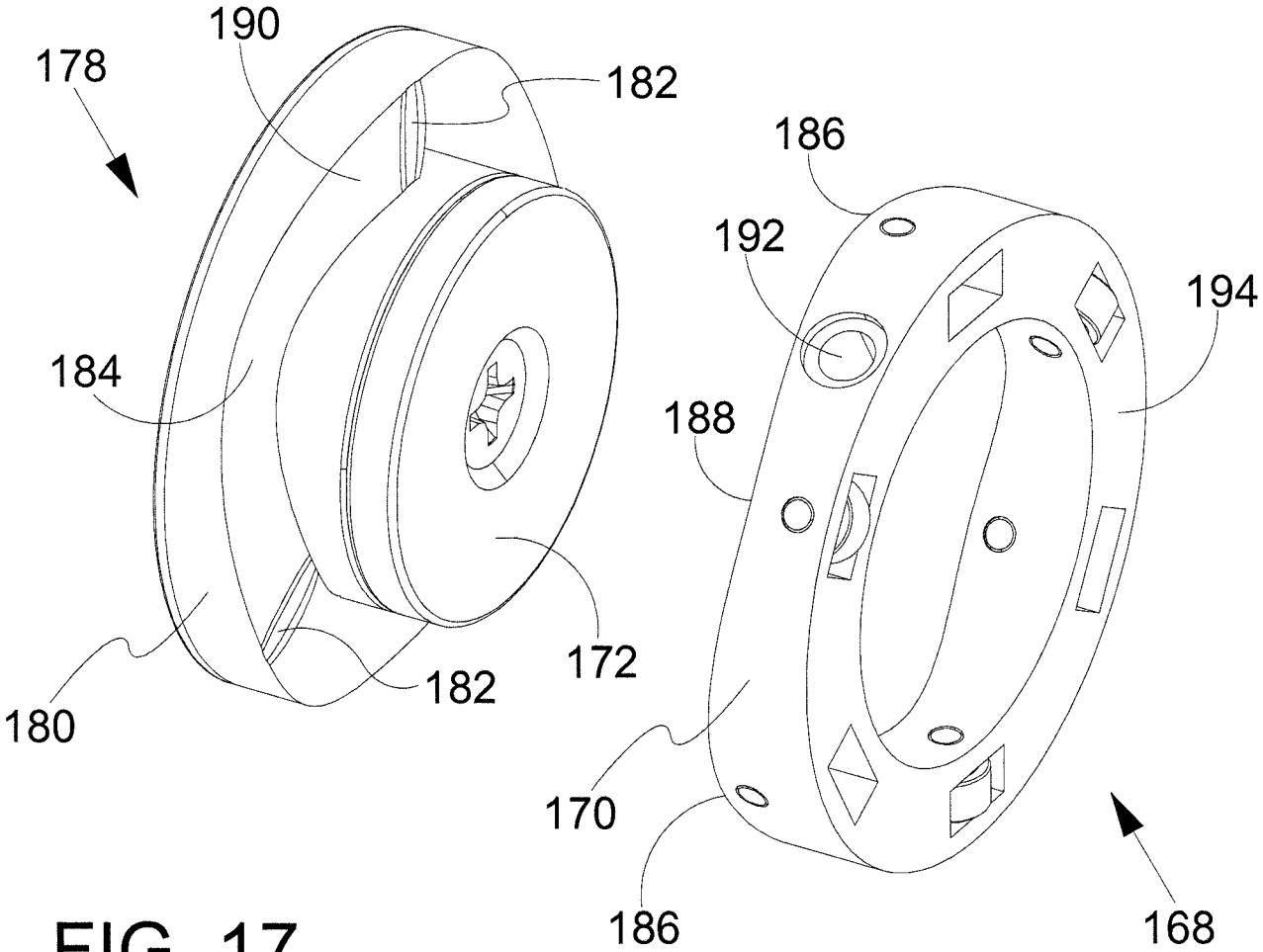
FIG. 17 is an exploded perspective view further illustrating the detachable magnet device shown in FIG. 16.
Figure 18:
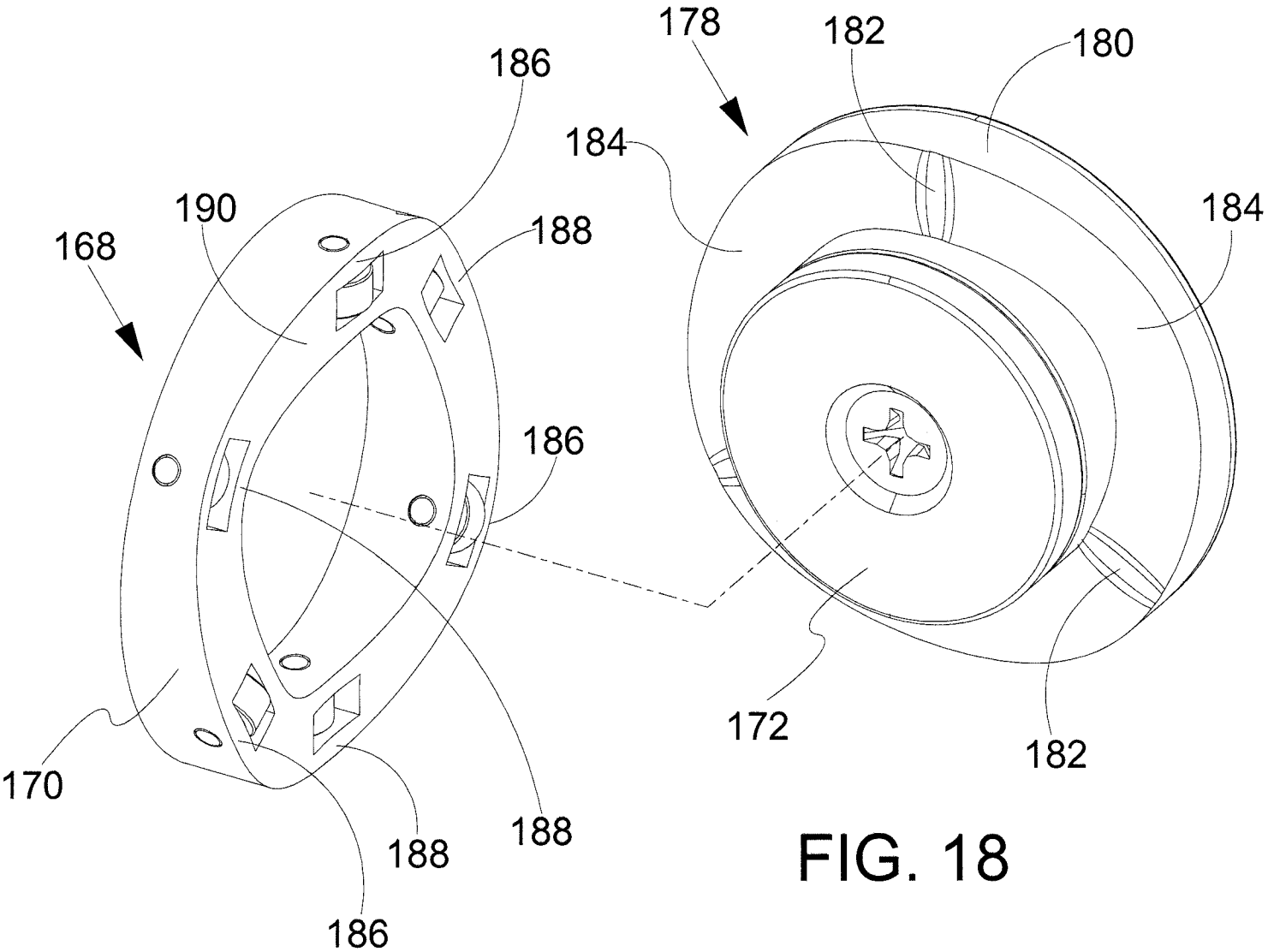
FIG. 18 is an exploded perspective view further illustrating the detachable magnet device shown in FIG. 16.

FIG. 15A through FIG. 15F are elevation and plan views showing six sides of an assembly 170. Engineer graphics textbooks generally refer to the process used to create views showing six sides of a three-dimensional object as multiview projection or orthographic projection. It is customary to refer to multiview projections using terms such as front view, right side view, top view, rear view, left side view, and bottom view. In accordance with this convention, FIG. 15A may be referred to as a front view of the assembly 170, FIG. 15B may be referred to as a left side view of the assembly 170, and FIG. 15C may be referred to as a top view of the assembly 170. FIG. 15A through FIG. 15F may be referred to collectively as FIG. 15. Terms such as front view and top view are used herein as a convenient method for differentiating between the views shown in FIG. 15. It will be appreciated that the elements shown in FIG. 15 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 15D may be referred to as a rear view of the assembly 170, FIG. 15E may be referred to as a right side view of the assembly 170, and FIG. 15F may be referred to as a bottom view of the assembly 170.

In the example embodiment of FIG. 15, the assembly 170 comprises a core housing 110 defining a pocket 138, a magnet assembly 172 disposed in the pocket 138, and a baseplate 100 fixed to the magnet assembly 172. The baseplate 100 includes a tab portion 154 that extends beyond a periphery of the magnet assembly 172 in the example embodiment of FIG. 15. The baseplate 100 includes a pivot portion 112 that engages a corresponding portion 114 of the core housing 110 to form a hinge joint 166 such that the baseplate 100 and the magnet assembly 172 selectively pivot about a pivot axis PA of the hinge joint 166 relative to the core housing 110.

Figure 19:
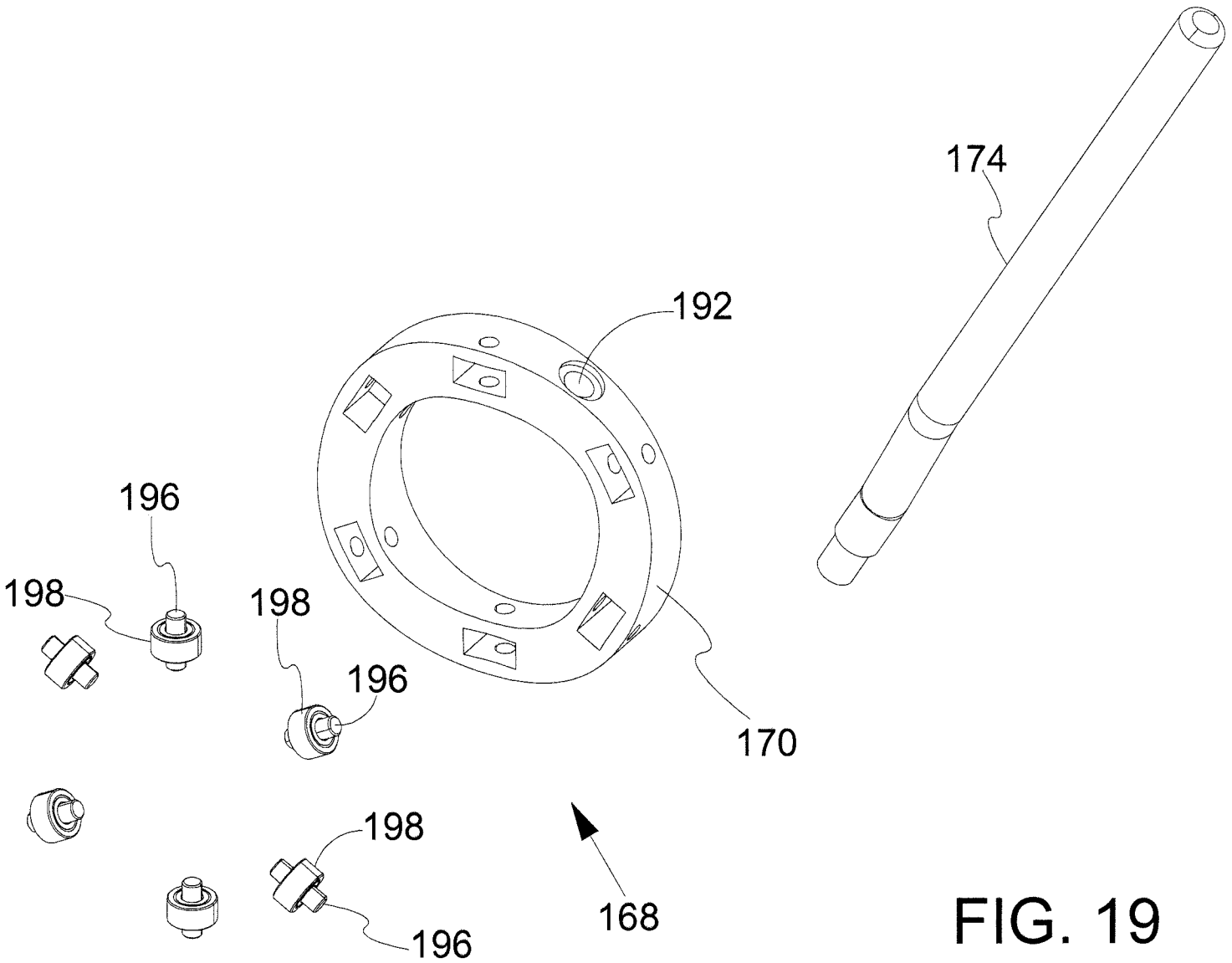
FIG. 19 is an exploded perspective view showing a drive body assembly in accordance with an example embodiment.

FIG. 19 is an exploded perspective view showing a drive body assembly 168 in accordance with an example embodiment. With reference to FIG. 19, it will be appreciated that when the drive body assembly 168 is in an unexploded state, the drive body 170 supports are plurality of rollers 198 and pins 196. In the example embodiment of FIG. 19, each pin extends through the center of a roller and the ends of each pin are supported by the drive body 170.

Figure 20:
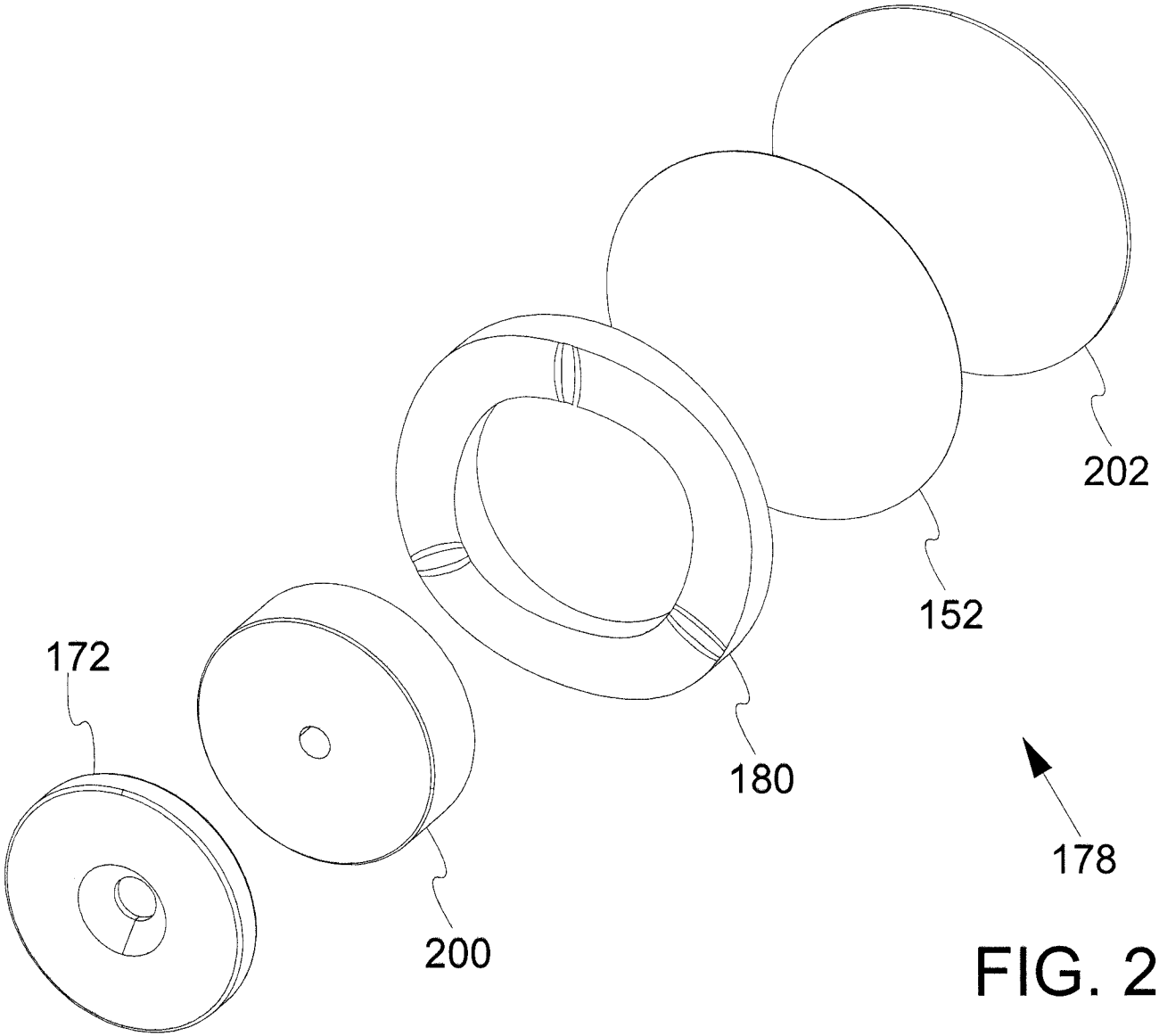
FIG. 20 is an exploded perspective view showing a mating body assembly in accordance with an example embodiment.

FIG. 20 is an exploded perspective view showing a mating body assembly 178 in accordance with an example embodiment. In the example embodiment of FIG. 20, the mating body assembly 178 includes a cover plate 202 that is fixed to the mating body 180 by an adhesive layer 152. With reference to FIG. 20, it will be appreciated that the mating body assembly 178 also includes a magnet assembly 172 and a magnet support 200. In the example embodiment of FIG. 20, the magnet assembly 172 is coupled to the mating body 180 by the magnet support 200 and the cover plate 202. In some example embodiments, a screw is used to attach the magnet assembly 172 to the magnet support 200.

Referring to FIGS. 16 through 20, in some example embodiments, a device for detachable attachment to a ferromagnetic surface comprises a drive body assembly 168 including a ring-shaped drive body 170. In some embodiments, the drive body 170 includes a plurality of raised portions 186, a plurality of recessed portions 188, and an undulating surface 190 extending over the plurality of raised portions 186 and the plurality of recessed portions 188. In some embodiments, the mating body assembly 178 of the device comprises a ring-shaped mating body 180 that includes a plurality of peak portions 182, a plurality of valley portions 184, and an undulating surface 190 extending over the plurality of peak portions 182 and the plurality of valley portions 184. The mating body assembly 178 may further include a magnet assembly 172 that is coupled to the mating body 180. The driving body 180 may have a face 190 that defines a face plane.

Still referring to FIGS. 16 through 20, in some example embodiments, the mating body 180 of the device has an attachment position in which each peak portion of the mating body 180 is received in a corresponding recessed portion of the driving body 170 and each raised portion of the drive body 170 is received in a valley portion of the mating body 180. In these example embodiments, the mating body 180 may also have a maximum displacement position in which each peak portion of the mating body 180 is outside of the corresponding recessed portion of the drive body 170 and each raised portion of the drive body 170 is outside of the corresponding valley portion of the mating body 180. Upon relative rotation between the drive body 170 and the mating body 180, the mating body 180 may move toward the maximum displacement position and the magnetic sheet assembly is displaced by a displacement distance relative to the face plane. In some example embodiments, the distance traveled by the magnetic sheet assembly is greater than an effective zone thickness of a magnetic field produced by the magnetic sheet assembly. In some example embodiments, distance traveled by the magnetic sheet assembly is greater than a baseplate wall thickness of a shunt of the magnetic sheet assembly.

Figure 21:
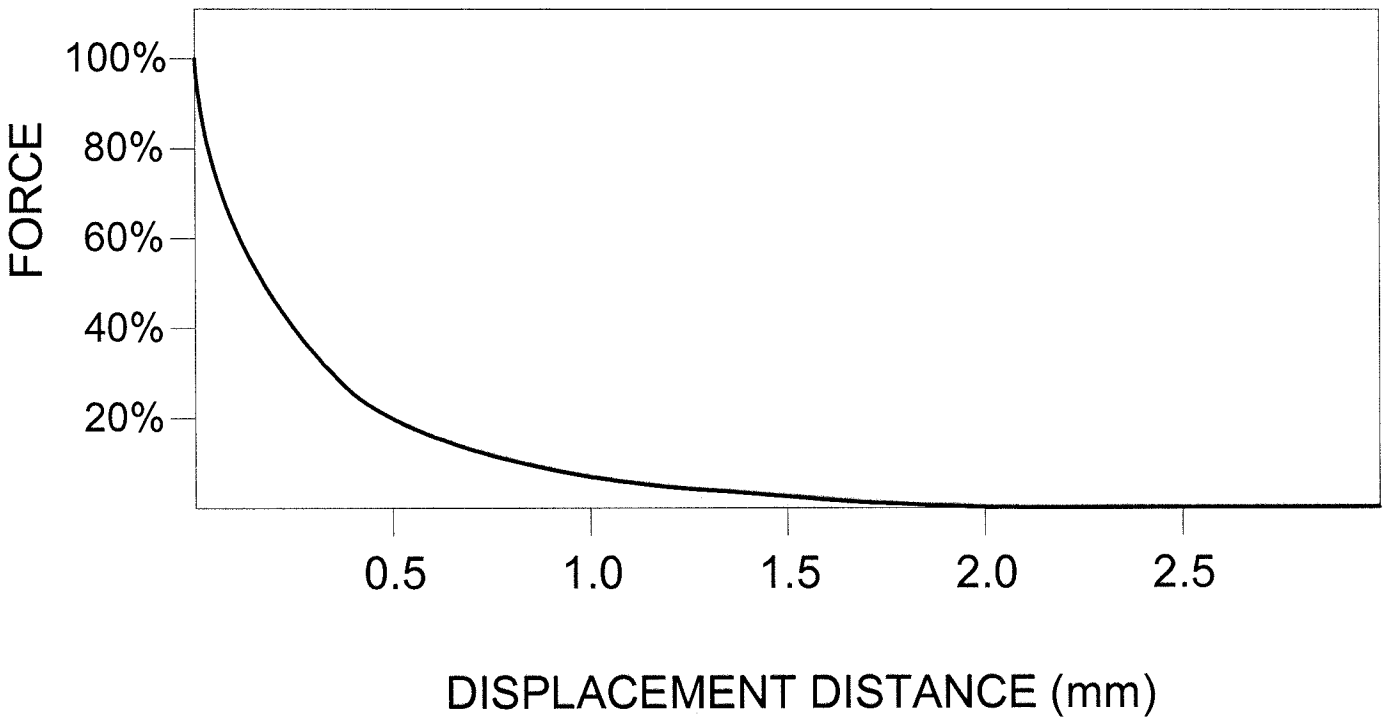
FIG. 21 is a graph illustrating a magnetic attraction force between an example magnet and a ferromagnetic object plotted as a function of the distance between the example magnet and the ferromagnetic object.
Figure 22B:
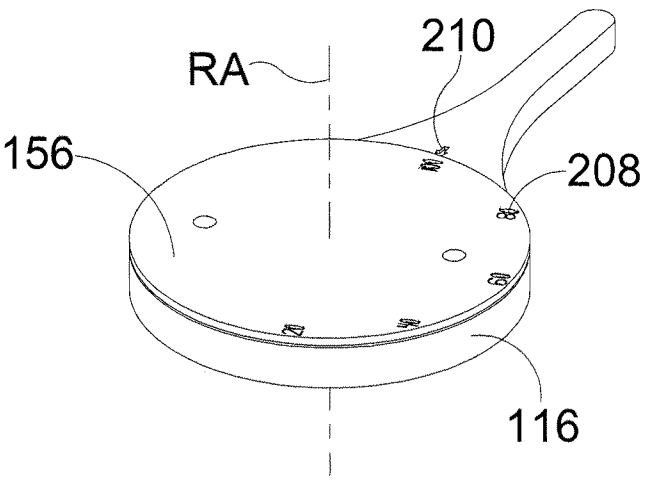
FIGS. 22A through 22C are perspective views showing a detachable magnet device in accordance with an example embodiment.
Figure 22C:
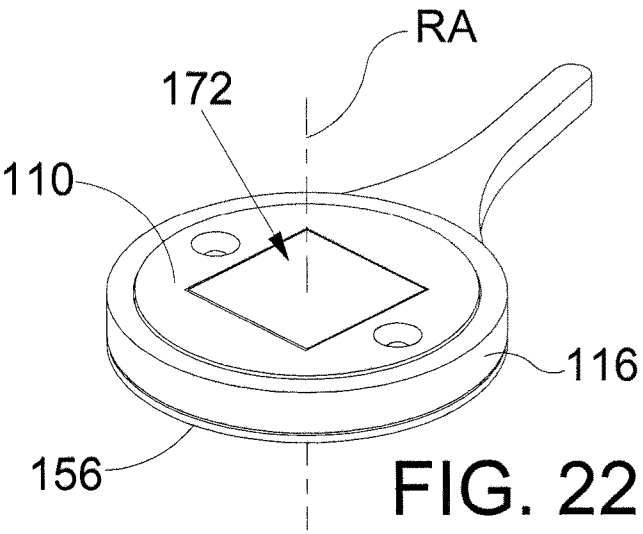
Figure 22A:
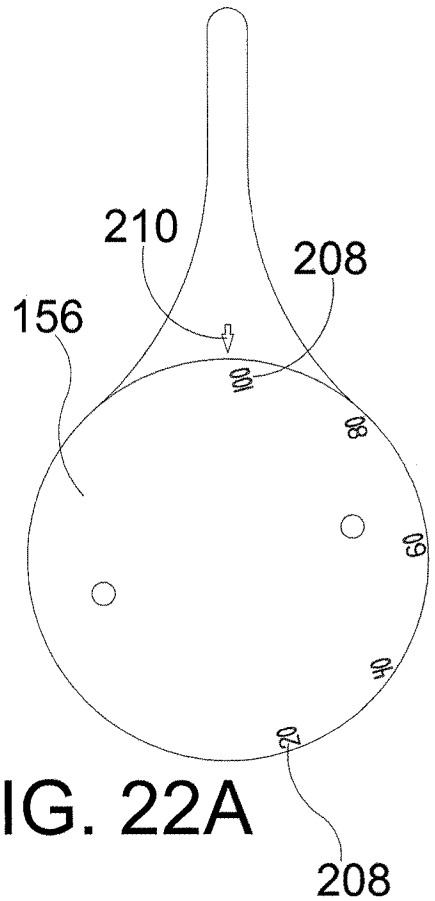

FIG. 21 is a graph illustrating a magnetic attraction force between an example magnet and a ferromagnetic object plotted as a function of the distance between the example magnet and the ferromagnetic object. With reference to FIG. 21, it will be appreciated that the magnetic attraction force decreases as the distance between the example magnet and the ferromagnetic object increases. In some example embodiments, the magnetic attraction force decreases by more than 80% when distance between the example magnet and the ferromagnetic object is about 1.0 mm. In some example embodiments, the magnetic attraction force decreases by more than 85% when distance between the example magnet and the ferromagnetic object is about 1.5 mm. In some example embodiments, the magnetic attraction force decreases by more than 90% when distance between the example magnet and the ferromagnetic object is about 2.0 mm. FIGS. 22A through 22C are perspective views showing a detachable magnet device in accordance with an example embodiment. FIGS. 22A through 22C may be collectively referred to as FIG. 22. The detachable magnet device of FIG. 22 comprises a core housing 110 defining a pocket 138 and a magnet assembly 172 that is received in the pocket 138. In the example embodiment of FIG. 22, an annular body 116 is disposed about the core housing 110 such that the annular body 116 is rotatable about a rotational axis RA relative to the core housing 110. An index mark 210 is located on the annular body 116 in the example embodiment of FIG. 22. Also in the example embodiment of FIG. 22, the device includes a cap member 156 that can be fixed to the core housing 110 with a camming rib of the annular body 116 disposed between the cap member 156 and a flange portion 164 of the core housing 110. A plurality of indicia 208 are located on the cap member 156 in the example embodiment of FIG. 22. In some embodiments, the indicia 208 located on the cap member 156 may be selectively aligned with the index mark 210 located on the annular body 116

Figure 22D:
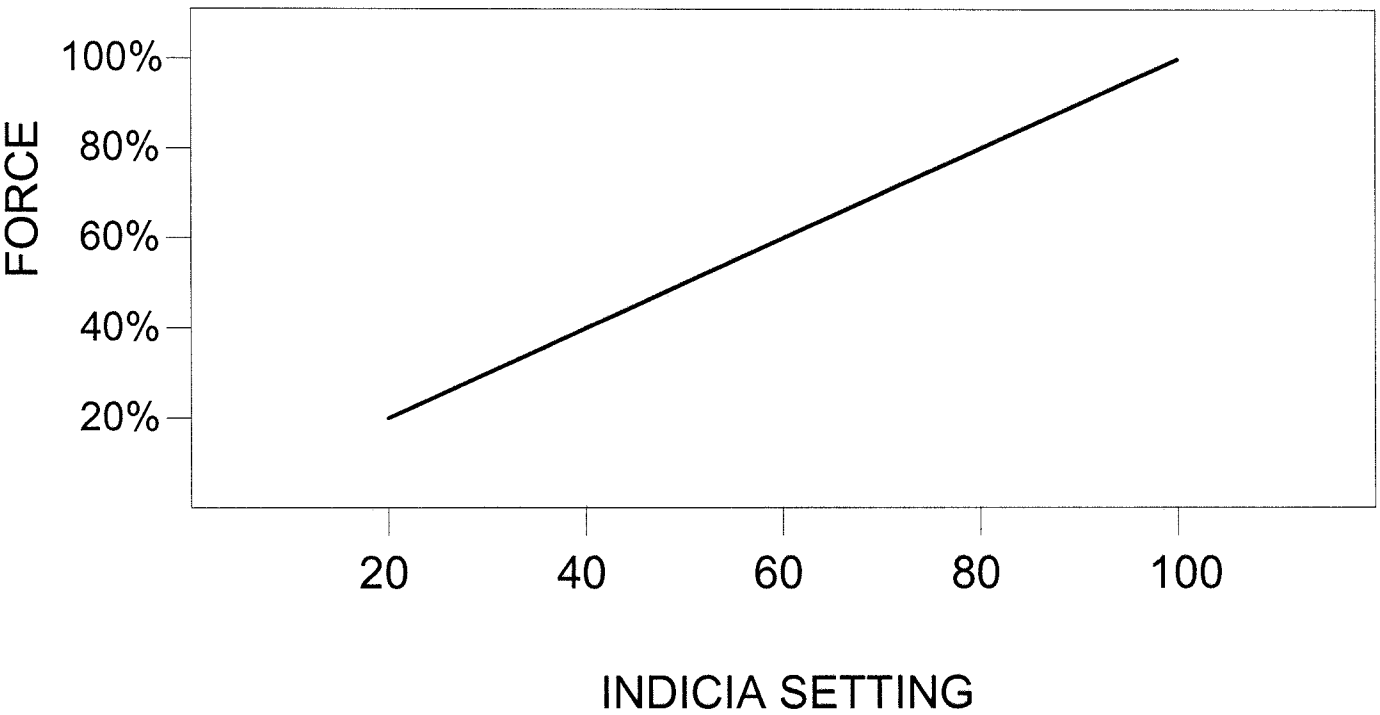
FIG. 22D is a graph illustrating a magnetic attraction force between an example magnet and a ferromagnetic object.

FIG. 22D is a graph illustrating a magnetic attraction force between an example magnet and a ferromagnetic object. In the example embodiment of FIG. 22D, force is plotted on the vertical axis and device indicia settings are plotted on the horizontal axis. In some example embodiments, the magnetic attraction force between the example magnet and the ferromagnetic object is at a maximum when the position of the annular body relative to the core housing corresponds to an indicia setting of "100." In some example embodiments, the magnetic attraction force between the example magnet and the ferromagnetic object is about 80% of maximum when the position of the annular body relative to the core housing corresponds to an indicia setting of "80." In some example embodiments, the magnetic attraction force between the example magnet and the ferromagnetic object is about 60% of maximum when the position of the annular body relative to the core housing corresponds to an indicia setting of "60." In some example embodiments, the magnetic attraction force between the example magnet and the ferromagnetic object is about 40% of maximum when the position of the annular body relative to the core housing corresponds to an indicia setting of "40." In some example embodiments, the magnetic attraction force between the example magnet and the ferromagnetic object is about 20% of maximum when the position of the annular body relative to the core housing corresponds to an indicia setting of "20."

Figure 22E:
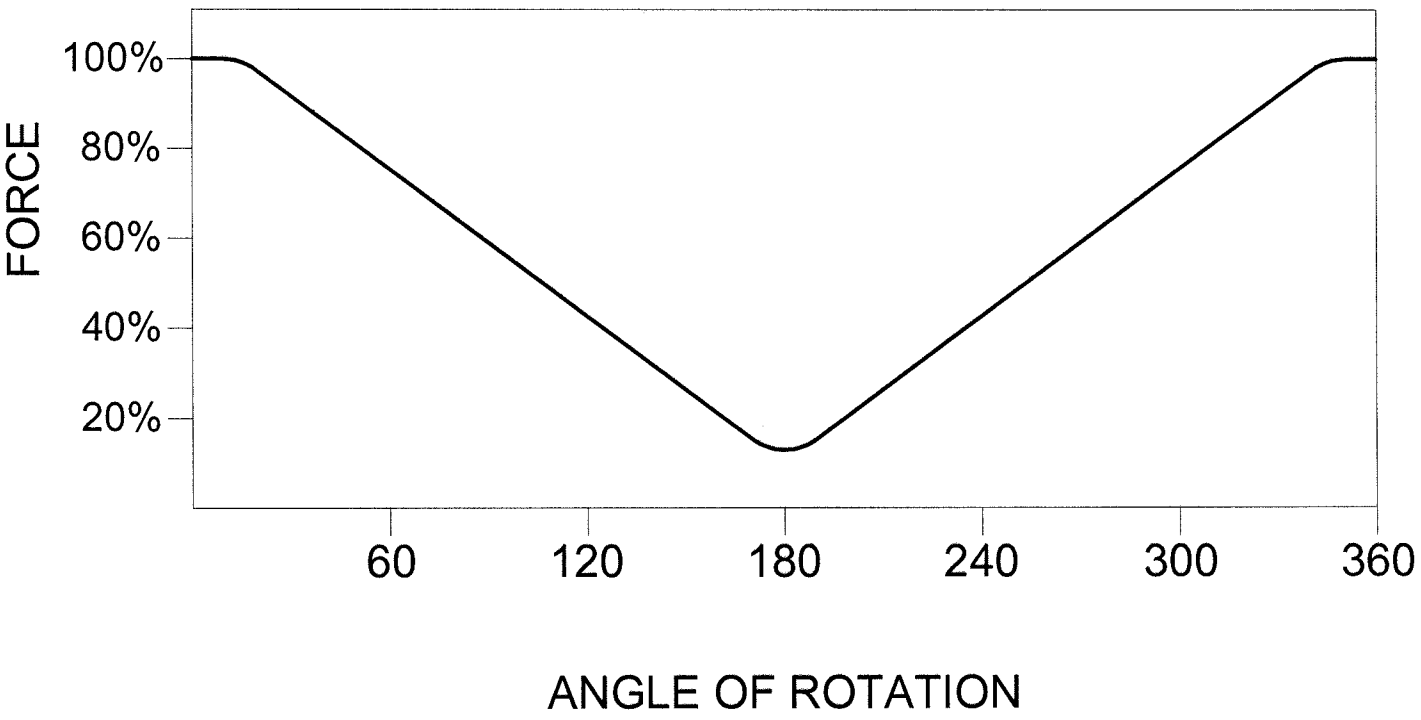
FIG. 22E is a graph illustrating a magnetic attraction force between an example magnet and a ferromagnetic object plotted as a function of the angular orientation of the annular body with respect to the core housing.

FIG. 22E is a graph illustrating a magnetic attraction force between an example magnet and a ferromagnetic object plotted as a function of the angular orientation of the annular body with respect to the core housing. In the example embodiment of FIG. 22E, orientation of the annular body moves through a rotational span of 0 and 360 degrees as it rotates with respect to the core housing. In some example embodiments, the magnetic attraction force is at a maximum for a first portion of the rotational span and the magnetic attraction force is at a maximum for a second portion of the rotational span. In some example embodiments, the minimum magnetic attraction force is greater than zero. In some example embodiments, the minimum magnetic attraction force is greater than 2% of the maximum magnetic attraction force. In some example embodiments, the minimum magnetic attraction force is greater than 6% of the maximum magnetic attraction force. In some example embodiments, the minimum magnetic attraction force is greater than 12% of the maximum magnetic attraction force.

Figure 23C:
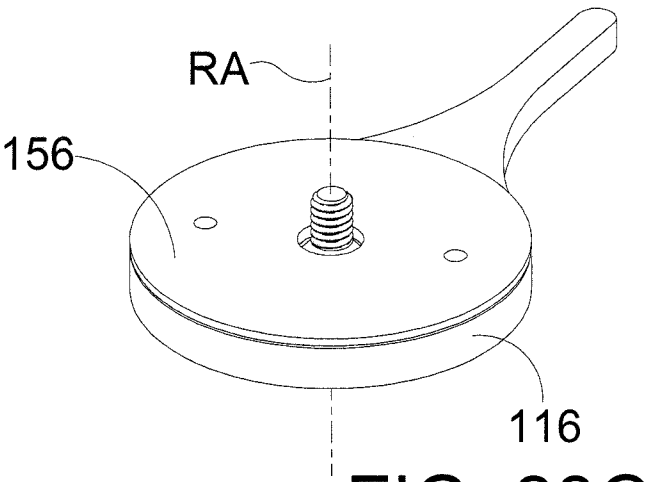
FIGS. 23A through 23C are perspective views showing a selectively detachable magnet device including a mounting post.
Figure 23B:
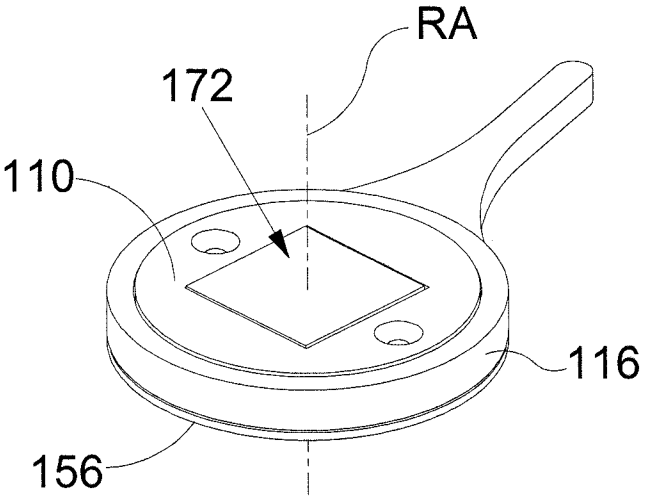
Figure 23A:
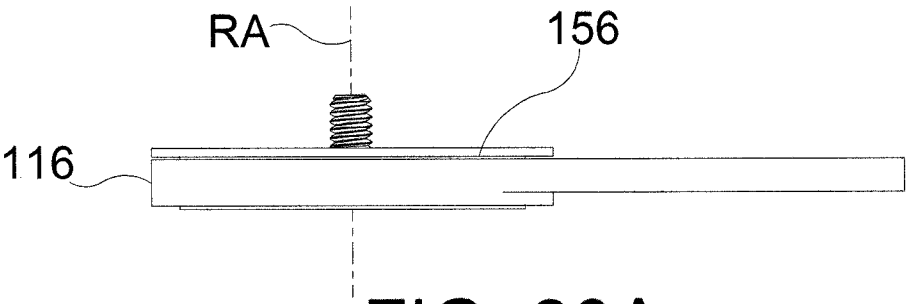

FIGS. 23A through 23C are perspective views showing a selectively detachable magnet device including a mounting post 216. FIGS. 23A through 23C may be collectively referred to as FIG. 23. In the example embodiment of FIG. 23, the mounting post 216 may be used to couple the detachable magnet device to other objects (e.g., a GoPro camera). The detachable magnet device of FIG. 23 comprises a core housing 110 defining a pocket 138 and a magnet assembly 172 that is received in the pocket 138. In the example embodiment of FIG. 23, the magnet assembly 172 includes a magnet 260. In some embodiments, the magnet 260 and the mount post 216 are both fixed to a plate portion of a mount assembly. In the example embodiment of FIG. 23, an annular body 116 is disposed about the core housing 110 such that the annular body 116 is rotatable about a rotational axis RA relative to the core housing 110. The device includes a cap member 156 that may be fixed to the core housing 110 with a camming rib of the annular body 116 disposed between the cap member 156 and a flange portion 164 of the core housing 110 in the example embodiment of FIG. 23.

Figure 24:
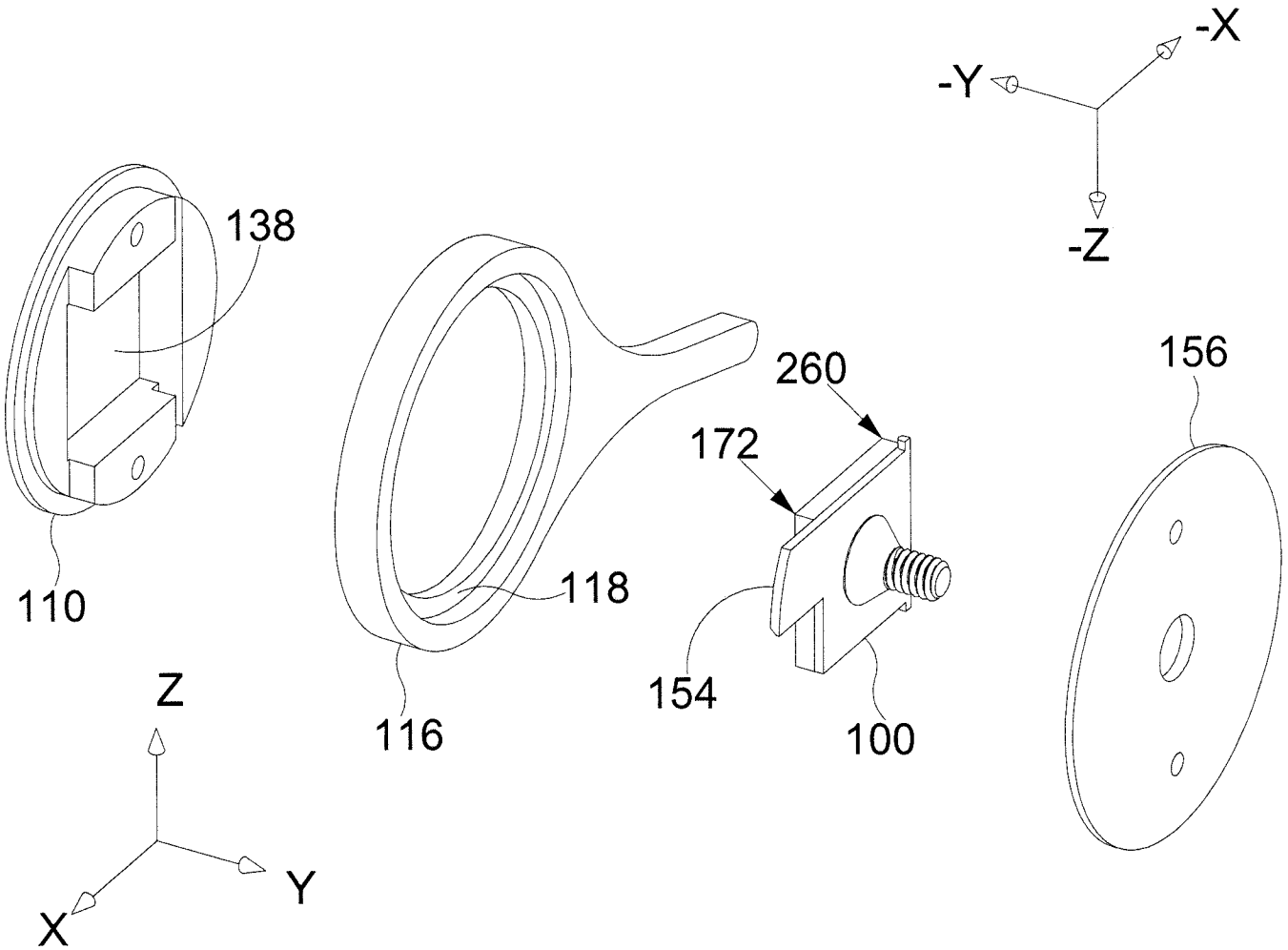
FIGS. 24 and 25 are exploded perspective views showing the detachable magnet device seen in FIG. 23.
Figure 25:
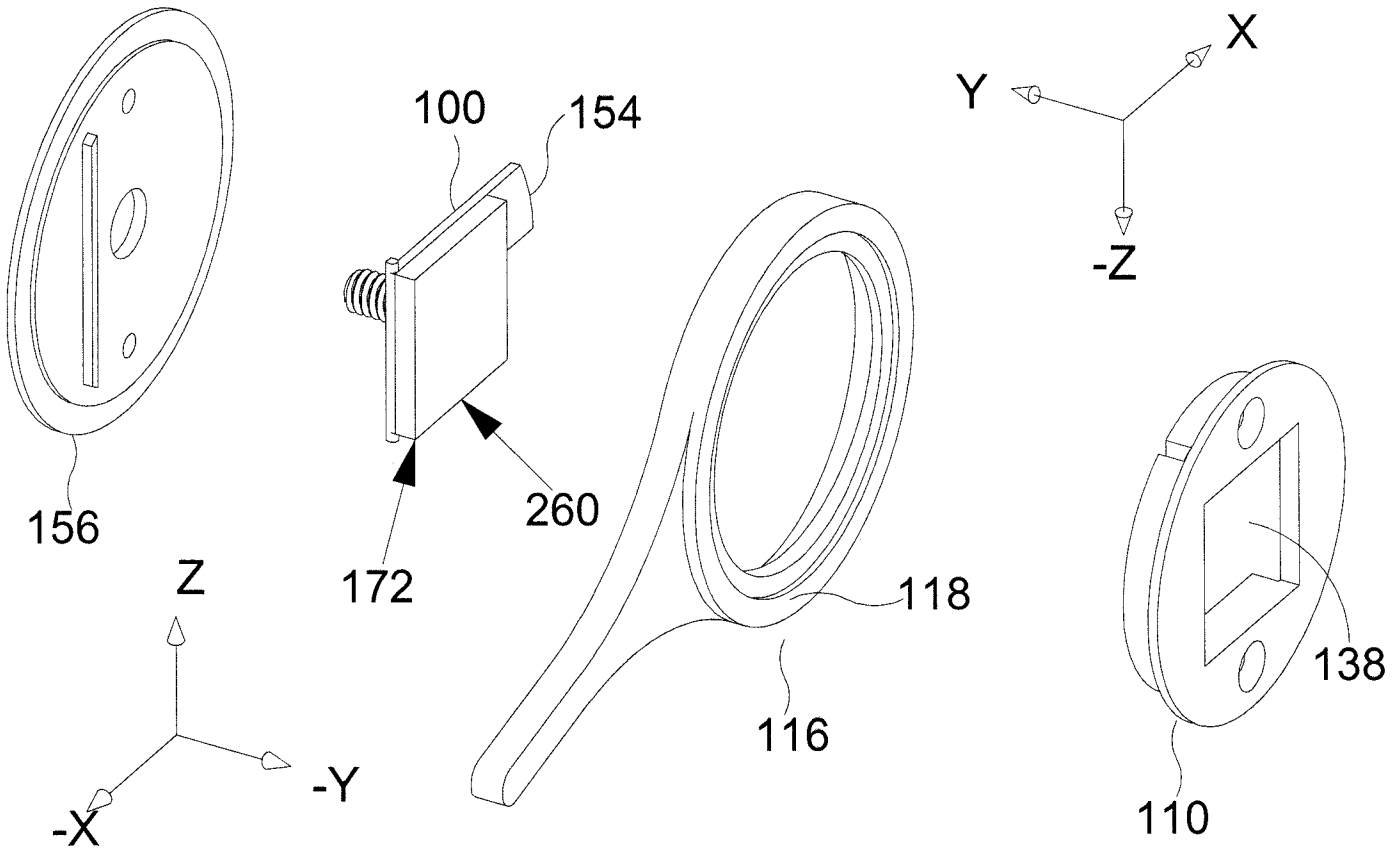

FIGS. 24 and 25 are exploded perspective views showing the detachable magnet device seen in FIG. 23. In the example embodiment of FIGS. 24 and 25, the detachable magnet device comprises a core housing 110 defining a pocket 138, a magnet assembly 172 that is received in the pocket 138. The detachable magnet device of FIGS. 24 and 25 also comprises a mount assembly 212 including a baseplate 100 and a mounting post 216. The magnet assembly 172 is fixed to the baseplate 100 of the mount assembly 212 in the example embodiment of FIGS. 24 and 25. In some embodiments, the baseplate 100 includes a tab portion 154 that extends beyond a periphery of the magnet assembly 172. Also in some embodiments of FIGS. 24 and 25, the baseplate 100 also includes a pivot portion 112 that is received in a corresponding portion 114 of the core housing 110 to form a hinge joint such that the baseplate 100 and the magnet assembly 172 selectively pivot relative to the core housing 110.

Figure 26B:
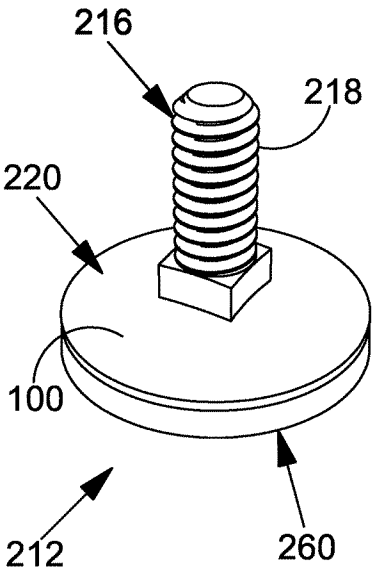
FIG. 26A and FIG. 26B are perspective views showing example mount assemblies in accordance with this detailed description.
Figure 26A:
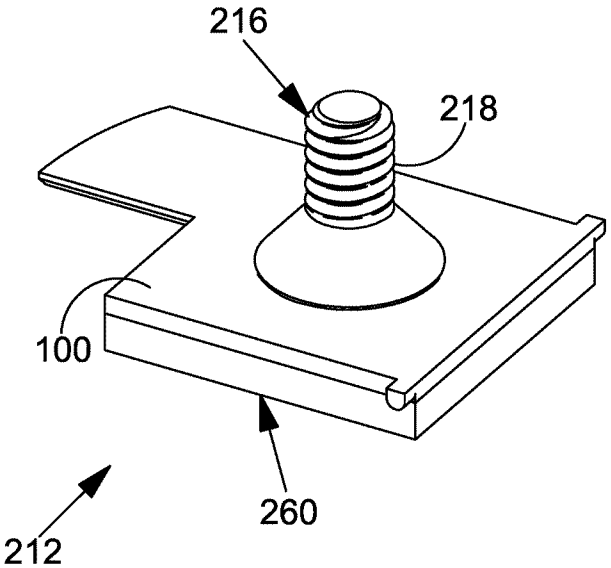

FIG. 26A and FIG. 26B are perspective views showing example mount assemblies 212 in accordance with this detailed description. Each mount assembly 212 includes mounting post 216 that is fixed to a baseplate 100 in the example embodiments of FIG. 26A and FIG. 26B. In some embodiments, each mounting post 216 comprises a thread 218. A magnet 260 is also fixed to the baseplate 100 in the example embodiments of FIG. 26A and FIG. 26B. In some embodiments, a mount assembly 212 may comprise an elevator bolt 220 (as shown in FIG. 26B).

Figures 27A, 27B:
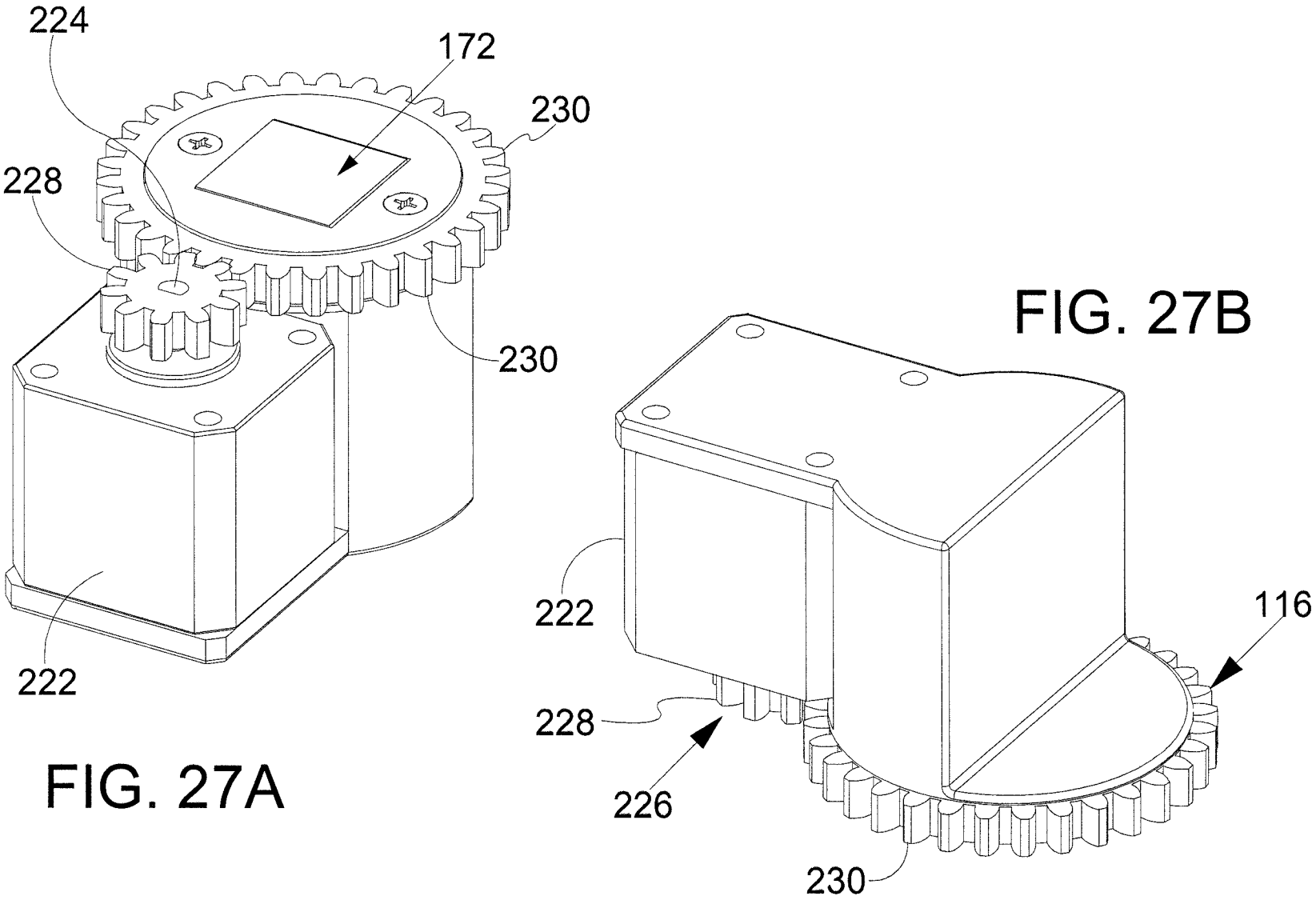
FIGS. 27A and 27B are perspective views showing a system including an actuator and a magnet assembly.

FIGS. 27A and 27B are perspective views showing a system 262 including an actuator 232 and a magnet assembly 172. FIGS. 27A and 27B may be collectively referred to as FIG. 27. In the example embodiment of FIG. 27, the actuator 232 comprises a motor 222 having a drive shaft 224. A drive gear 226 having drive teeth 228 is coupled to the drive shaft 224 of the motor 222 in the example embodiment of FIG. 27. In FIG. 27, the drive teeth 228 of the drive gear 226 can be seen operatively engage driven teeth 230 of an annular body 116. In some example embodiments, the annular body 116 rotates when the drive gear 226 rotates.

Figure 28:
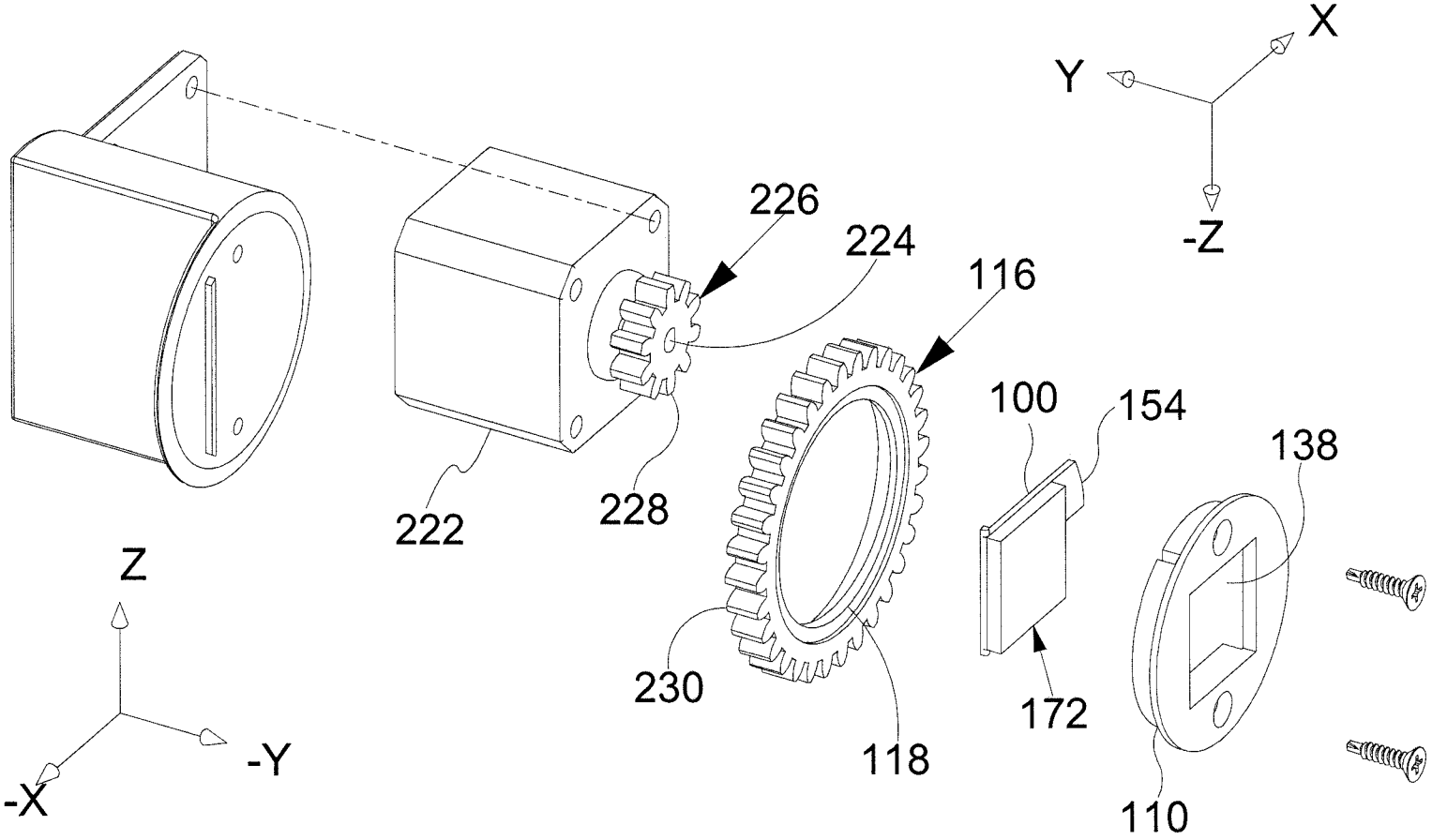
FIGS. 28 and 29 are exploded perspective views showing the system device in seen in FIG. 27.
Figure 29:
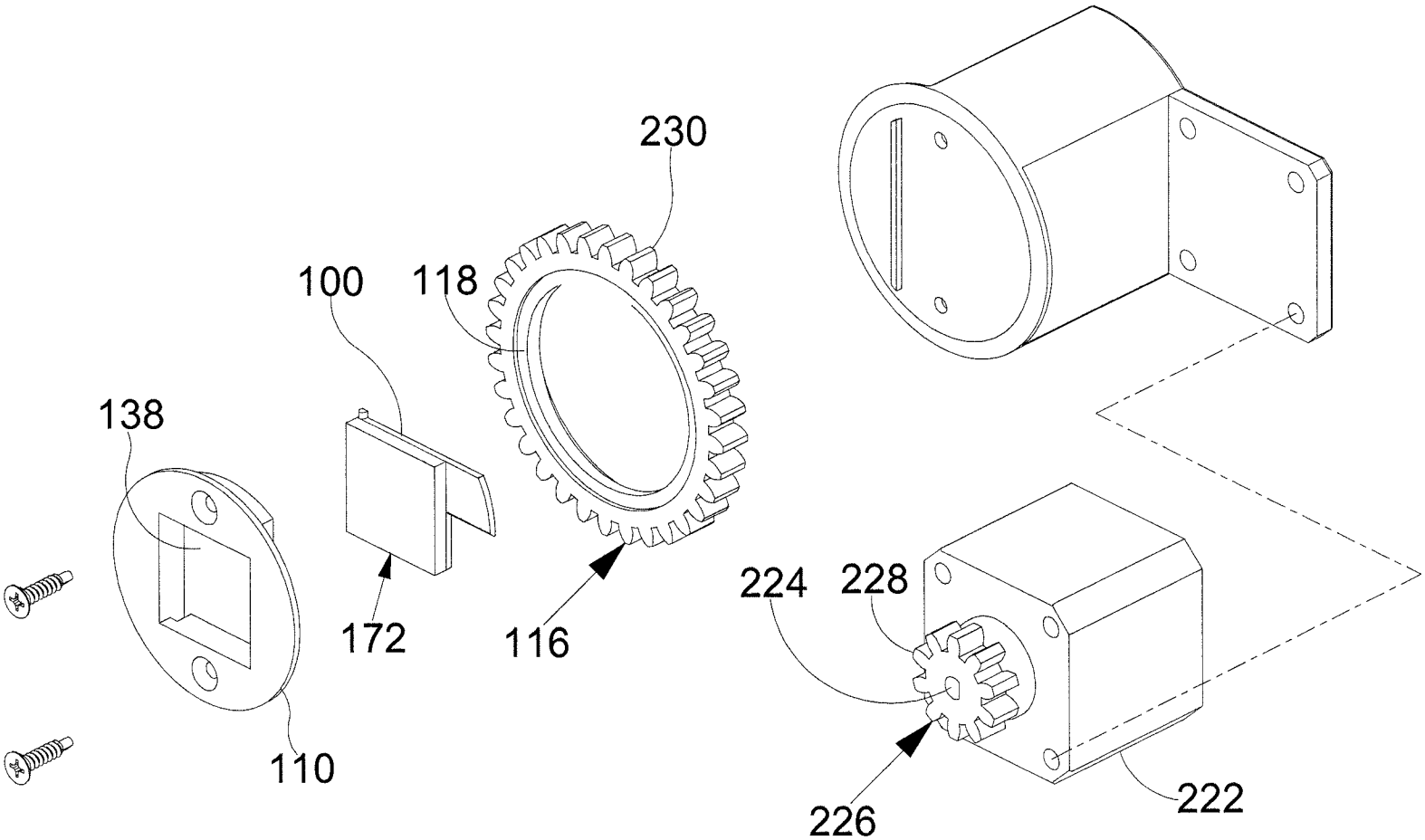

FIGS. 28 and 29 are exploded perspective views showing the system seen in FIG. 27. With reference to FIGS. 28 and 29, it will be appreciated that the system includes a core housing 110 defining a pocket 138, a magnet assembly 172 that is received in the pocket 138, and a baseplate 100 that is fixed to the magnet assembly 172. In the example embodiment of FIGS. 28 and 29, the baseplate 100 includes a tab portion 154 that extends beyond a periphery of the magnet assembly 172. Also in the example embodiment of FIGS. 28 and 29, the baseplate 100 also includes a pivot portion 112 that is received in a corresponding portion 114 of the core housing 110 to form a hinge joint such that the baseplate 100 and the magnet assembly 172 selectively pivot relative to the core housing 110.

In the example embodiment of FIGS. 28 and 29, the annular body 116 has a camming rib 118 that operatively engages a baseplate 100 that is fixed to a magnet assembly 172. In some embodiments, the camming rib 118 applies a camming force to a portion of the baseplate 100 upon rotation of the annular body 116 relative to the baseplate 100 and the camming force urges the magnet assembly 172 and the baseplate 100 to pivot about a pivot axis of a hinge joint 166. In some embodiments, the pivot axis is formed at a pivot portion of the baseplate 100 that engages a corresponding portion of the core housing 110. In some embodiments, the camming rib 118 applies a camming force to the portion of the baseplate 100 upon rotation of the annular body 116 relative to the baseplate 100 and the camming force urges the magnet assembly 172 and the baseplate 100 to pivot about the pivot axis of the hinge joint 166. In some example embodiments, the annular body 116 rotates when the motor 222 of the actuator 232 is energized. In the embodiment of FIGS. 28 and 29, the actuator 232 comprises a motor 222 having a drive shaft 224. A drive gear 226 having drive teeth 228 is coupled to the drive shaft 224 of the motor 222 in the example embodiment of FIGS. 28 and 29. In some embodiments, the drive teeth 228 of the drive gear 226 operatively engage driven teeth 230 of an annular body 116.

Figure 30:
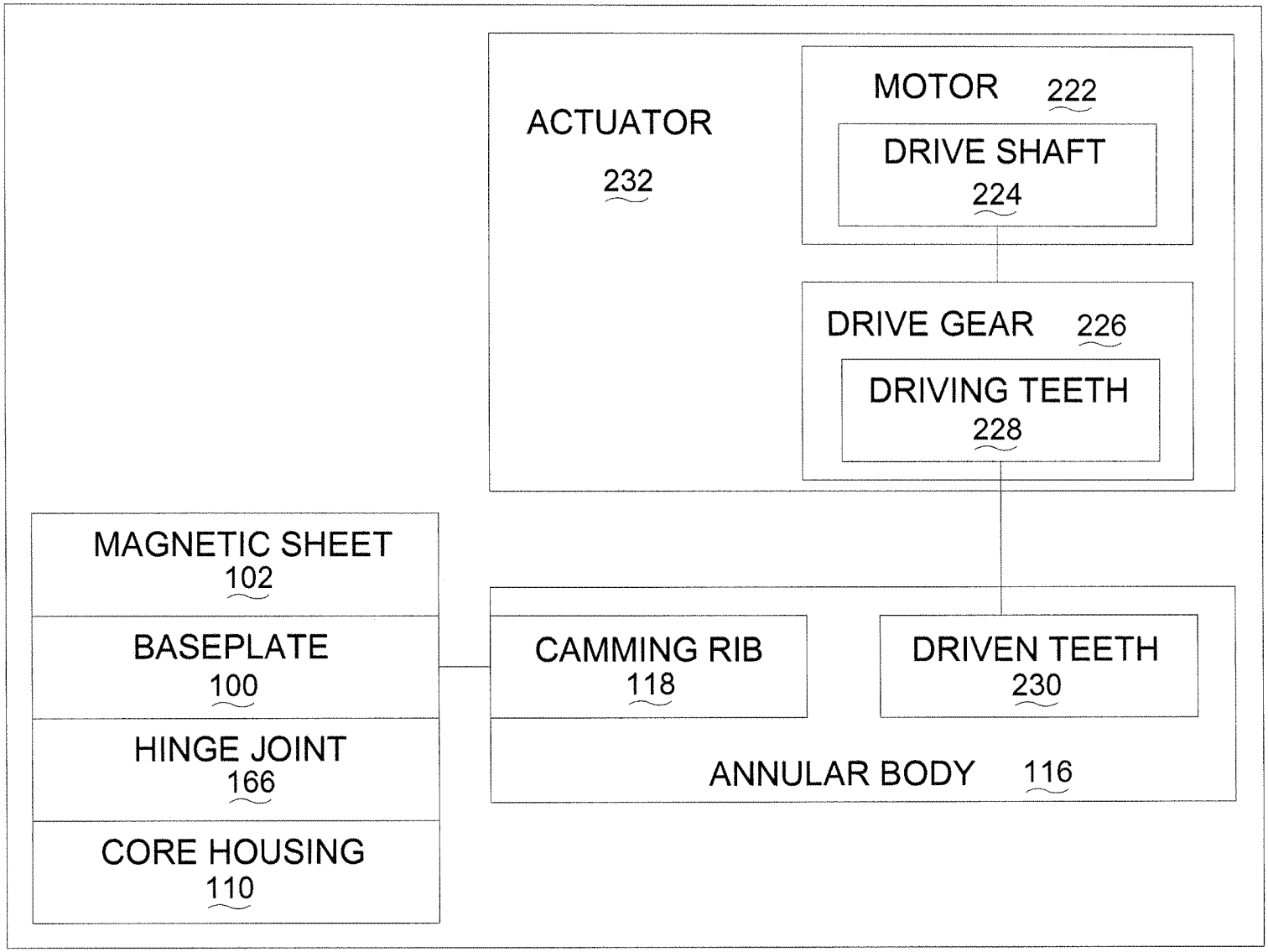
FIG. 30 illustrates a system including an actuator and a magnet assembly.

FIG. 30 illustrates a system 262 including an actuator 232 and a magnet assembly 172. In some embodiments, the system 262 is capable of selective magnetic attachment to a ferromagnetic object or surface. The illustration shown in FIG. 30 is not meant to imply physical or architectural limitations to the manner in which an illustrative embodiment may be implemented. Other components in addition to or in place of the ones illustrated may be used. Some components may be optional. Also, some blocks may illustrate functional components. One or more of these blocks may be combined, divided, or combined and divided into different blocks in some implementations. In the embodiment of FIG. 30, the actuator 232 comprises a motor 222 having a drive shaft 224. A drive gear 226 having drive teeth 228 is coupled to the drive shaft 224 of the motor 222 in the example embodiment of FIG. 30. In some embodiments, the drive teeth 228 of the drive gear 226 operatively engage driven teeth 230 of an annular body 116. In the example embodiment of FIG. 30, the annular body 116 has a camming rib 118 that operatively engages a baseplate 100 that is fixed to a magnet assembly 172. In some embodiments, the camming rib 118 applies a camming force to a portion of the baseplate 100 upon rotation of the annular body 116 relative to the baseplate 100 and the camming force urges the magnet assembly 172 and the baseplate 100 to pivot about a pivot axis of a hinge joint 166. In some embodiments, the pivot axis is formed at a pivot portion of the baseplate 100 that engages a corresponding portion of the core housing 110. In some embodiments, the camming rib 118 applies a camming force to the portion of the baseplate 100 upon rotation of the annular body 116 relative to the baseplate 100 and the camming force urges the magnet assembly 172 and the baseplate 100 to pivot about the pivot axis of the hinge joint 166.

Figure 31A:
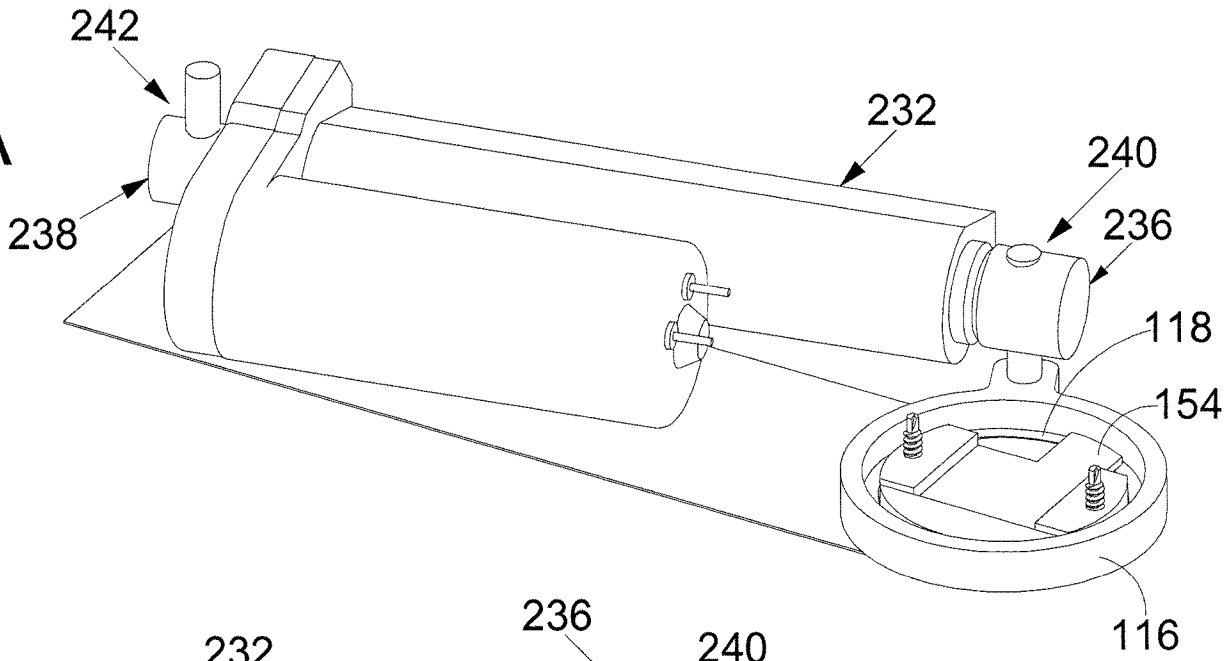
FIGS. 31A and 31B are perspective views showing a system including an actuator and a magnet that is fixed to a baseplate.
Figure 31B:
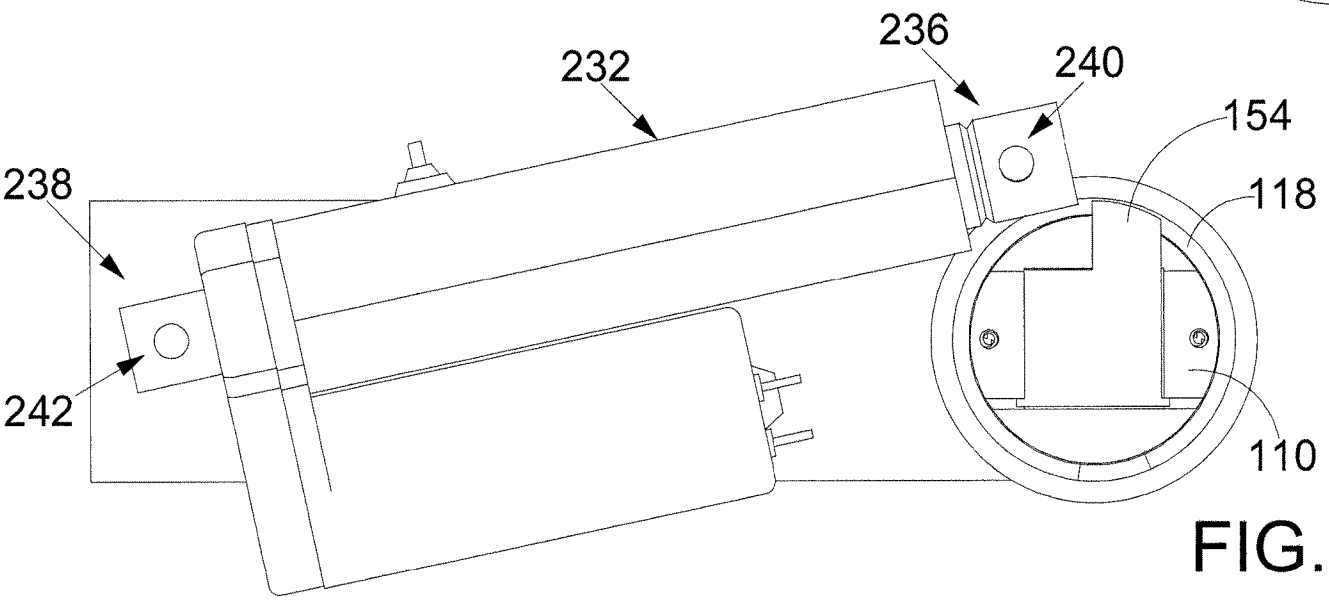

FIGS. 31A and 31B are perspective views showing a system 262 including an actuator 232 and a magnet assembly 172 that is fixed to a baseplate 100. FIGS. 31A and 31B may be collectively referred to as FIG. 31. In the example embodiment of FIG. 31, the actuator 232 comprises a linear actuator. With reference to FIG. 31, will be appreciated that actuator 232 has a first end portion 236 that is coupled to an annular body at a first pivot joint 240. Actuator 232 also has a second end portion 238 that is coupled to a frame member at a second pivot joint 242. In the example embodiment of FIG. 31, the annular body 116 rotates when a motor of the actuator 232 is energized. With reference to FIG. 31, it will be appreciated that annular body 116 includes a camming rib 118. In some embodiments, the camming rib 118 applies a camming force to a tab portion 154 of the baseplate 100 upon rotation of the annular body 116 relative to the baseplate 100. In some embodiments, the camming force applied by the camming rib 118 urges a magnet assembly and the baseplate 100 to pivot about a pivot axis of a hinge joint.

Figure 32A:
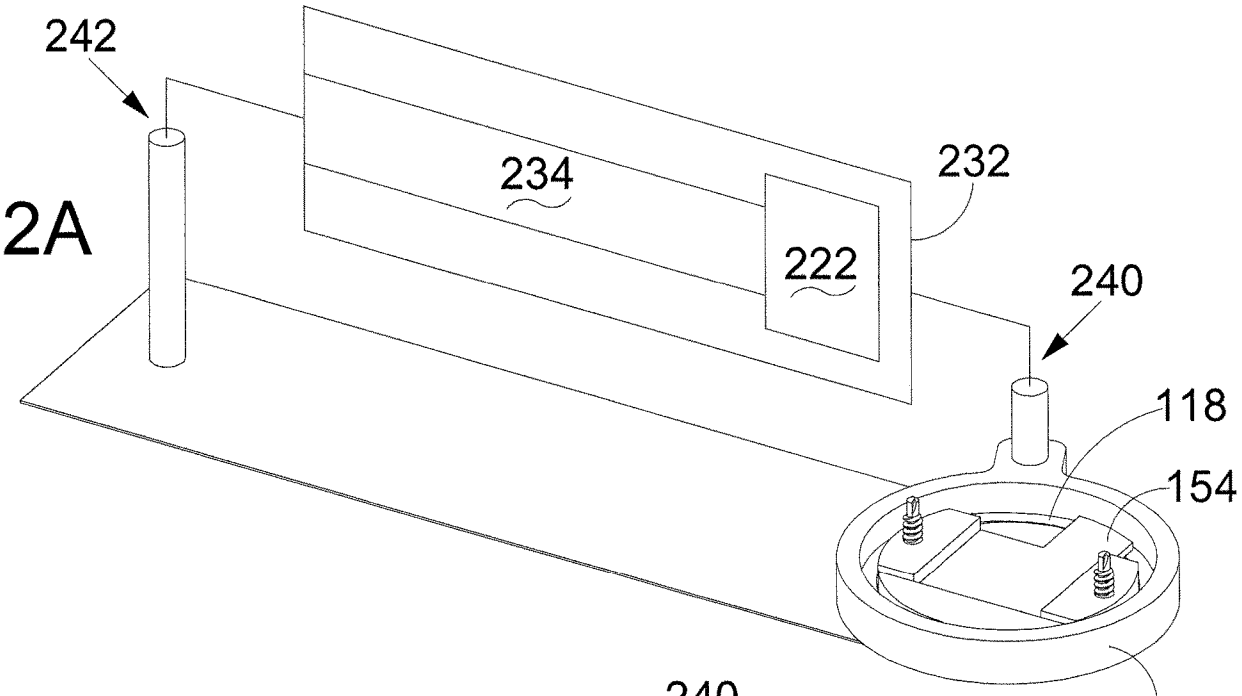
FIGS. 32A and 32B are stylized perspective views showing a system including an actuator and a magnet that is fixed to a baseplate.
Figure 32B:
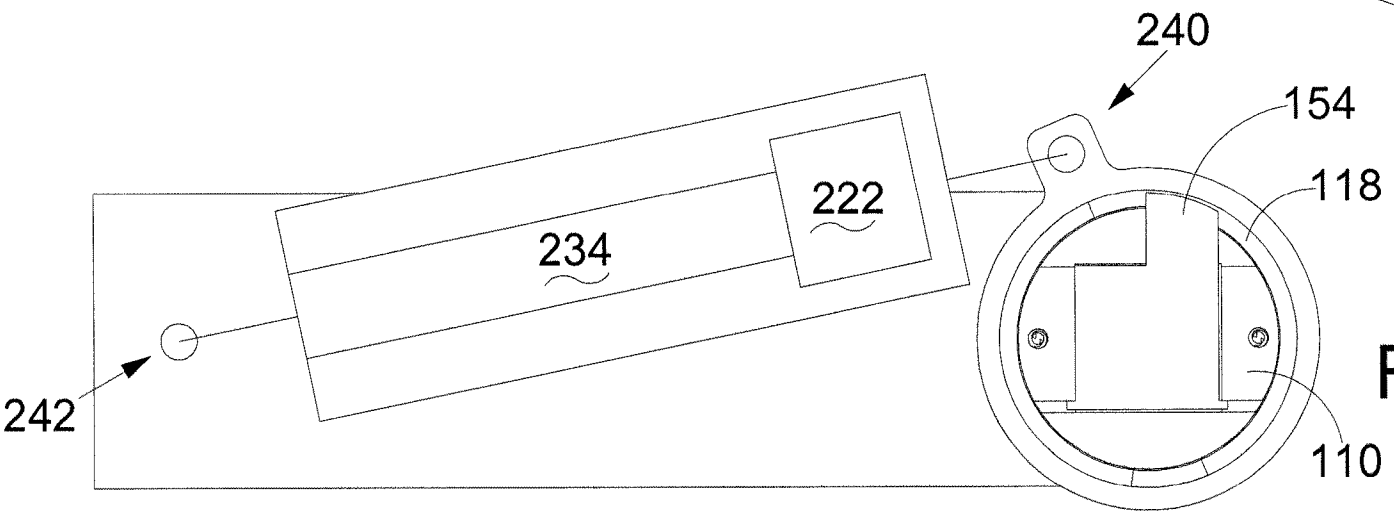

FIGS. 32A and 32B are stylized perspective views showing a system 262 including an actuator 232. FIGS. 32A and 32B may be collectively referred to as FIG. 32. In the embodiment of FIG. 32, the actuator 232 comprises a motor 222 and a lead screw 234. With reference to FIG. 32, it will be appreciated that the system includes an annular body 116 that is disposed about a core housing 110. The system also includes a baseplate 100 that is fixed to a magnet assembly. In the example embodiment of FIG. 32, the baseplate 100 includes a tab portion 154 that engages a camming rib 118 of the annular body 116. In some embodiments, the camming rib 118 applies a camming force to the tab portion 154 of the baseplate 100 upon rotation of the annular body 116 relative to the baseplate 100. With reference to FIG. 32, will be appreciated that actuator 232 has a first end portion 236 that is coupled to an annular body at a first pivot joint 240. Actuator 232 also has a second end portion 238 that is coupled to a frame member at a second pivot joint 242. In the example embodiment of FIG. 32, the annular body 116 rotates when the motor 22 of the actuator 232 is energized.

Figure 33B:
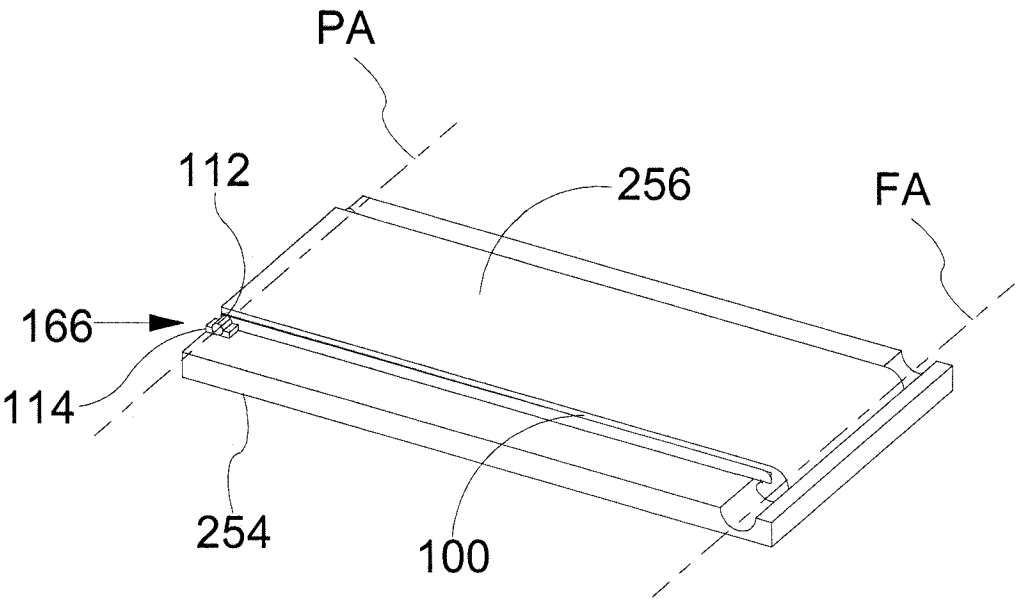
FIGS. 33A and 33B are perspective views showing a device for detachable attachment to a ferromagnetic object or surface.
Figure 33A:
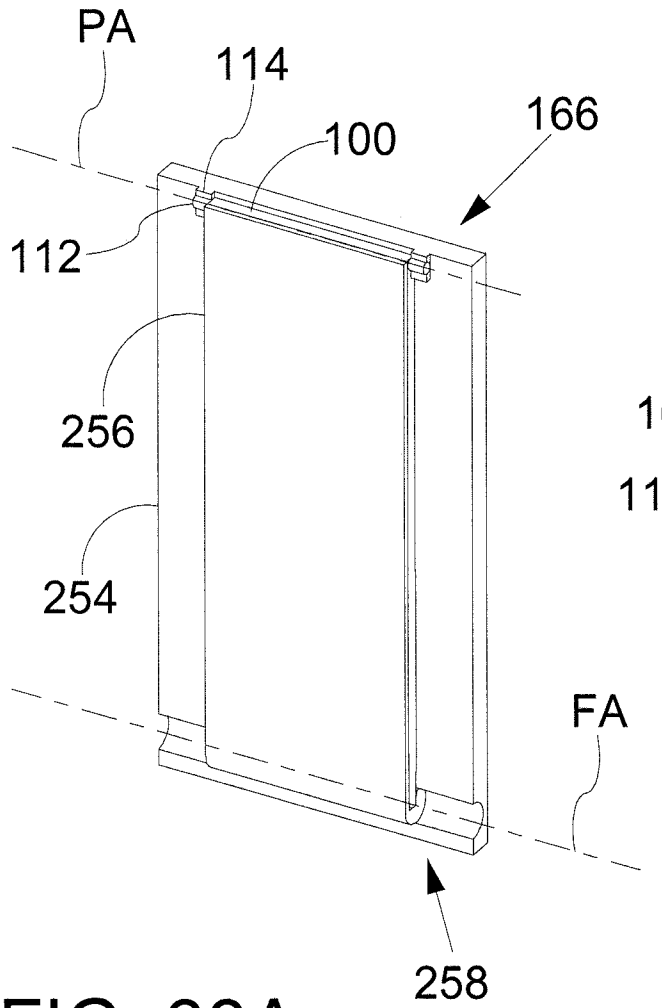

FIGS. 33A and 33B are perspective views showing a device for detachable attachment to a ferromagnetic object or surface. In the example embodiment shown in FIGS. 33A and 33B, the device comprises a base housing 254 defining a pocket that receives a magnet. In some embodiments, a baseplate 100 is fixed to the magnet and portions of the baseplate 100 extending beyond the periphery of the magnet overlay a front surface of the base housing 254. In some embodiments, the baseplate 100 has the pivot portion 112 that engages a corresponding portion 114 of the base housing 254 to form a hinge joint 166. In some embodiments, the baseplate 100 and the magnet selectively pivot about a pivot axis PA of a hinge joint 166 relative to the base housing 254. In some embodiments, the device includes a lever body 256 including a camming portion 258 that engages a portion of the baseplate 100. In some embodiments, the lever body 256 is rotatable about a fulcrum axis FA relative to the base housing 254. In some embodiments, forces applied to the baseplate by the camming portion 258 of the lever body 256 urging the magnet and the baseplate 100 to pivot about the pivot axis PA. In some embodiments, the magnet and the baseplate 100 rotate about the pivot axis PA as the lever body 256 pivots about the fulcrum axis FA.

Figure 34A:
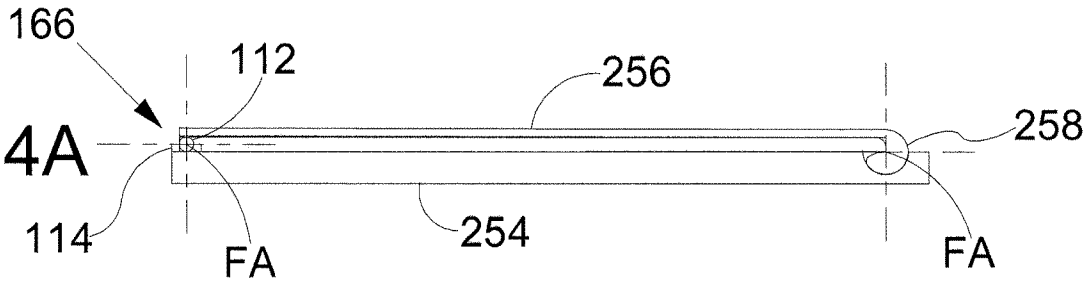
FIGS. 34A, 34B and 34C are a series of side views showing a device for detachable attachment to a ferromagnetic object or surface.
Figure 34B:
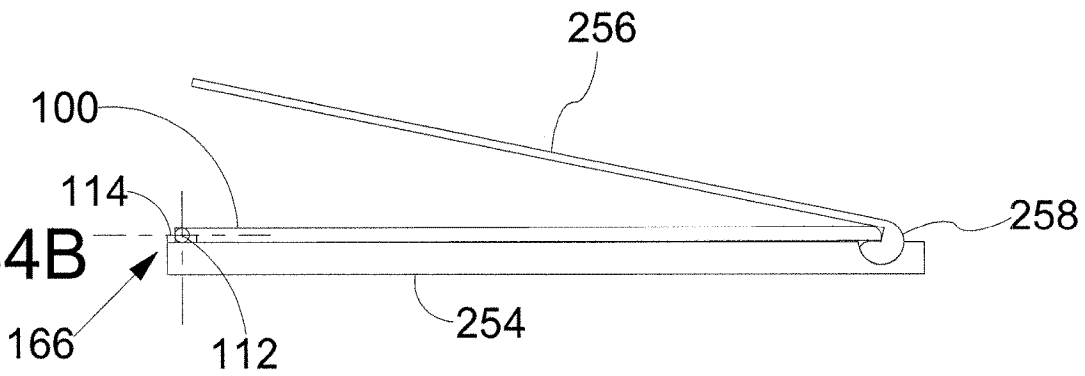
Figure 34C:
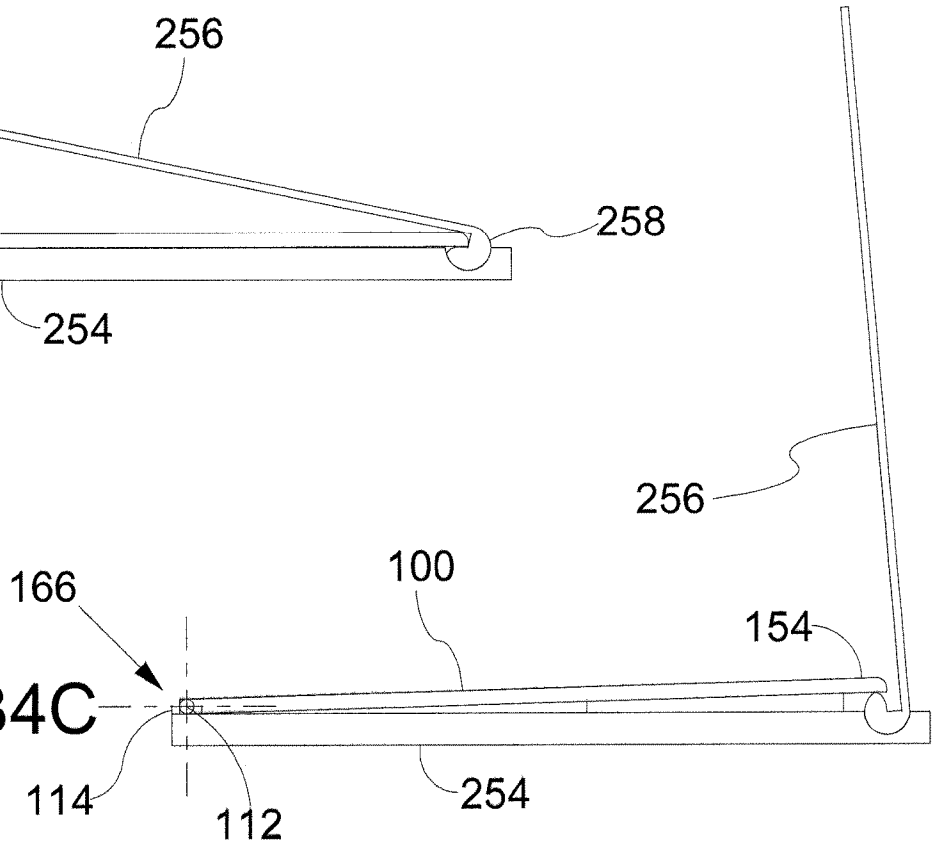
Figure 35A:
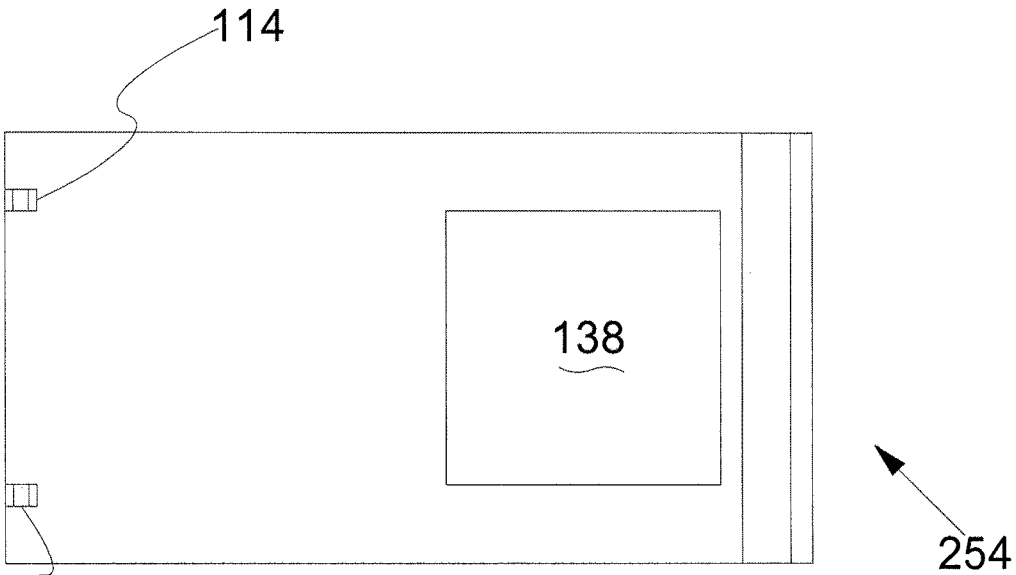
FIG. 35A through FIG. 35F are front, rear, top, bottom and side views showing six sides of a base housing.
Figure 35B:
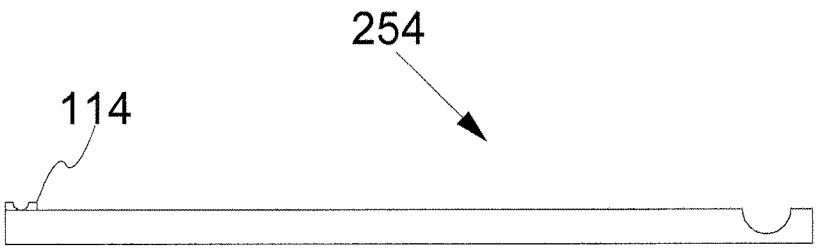
Figure 35C:
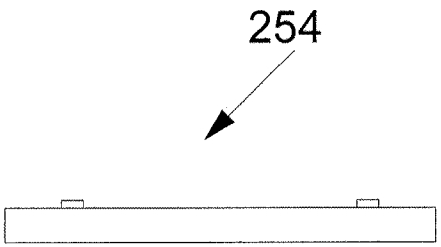
Figure 35D:
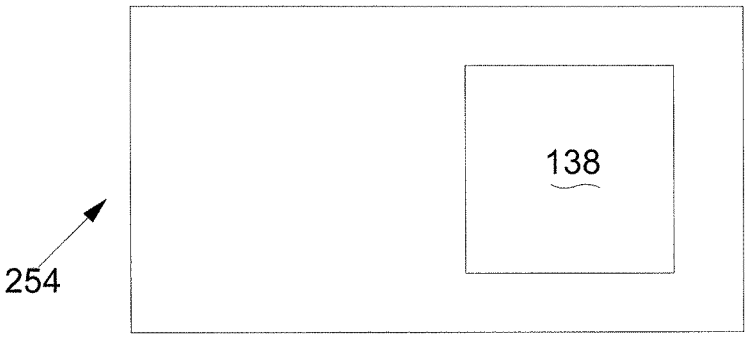
Figure 35E:
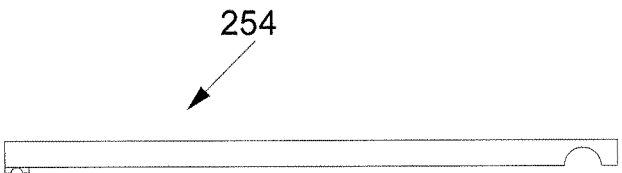
Figure 35F:
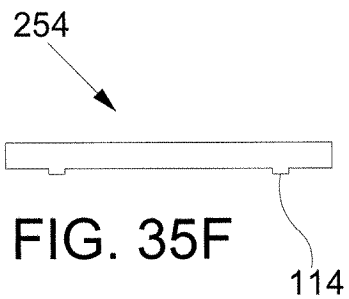
Figure 36A:
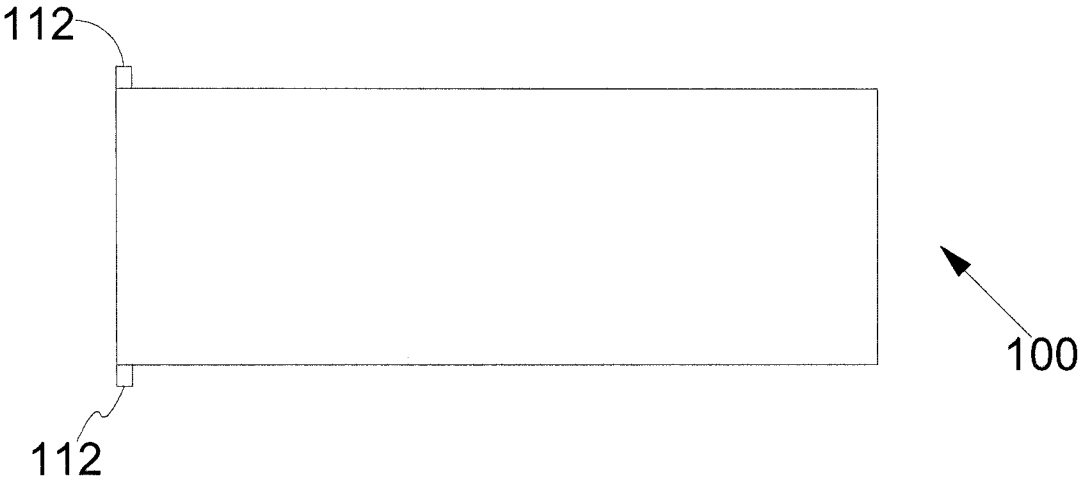
FIG. 36A through FIG. 36F are front, rear, top, bottom and side views showing six sides of an assembly including a magnet and a baseplate.
Figure 36B:
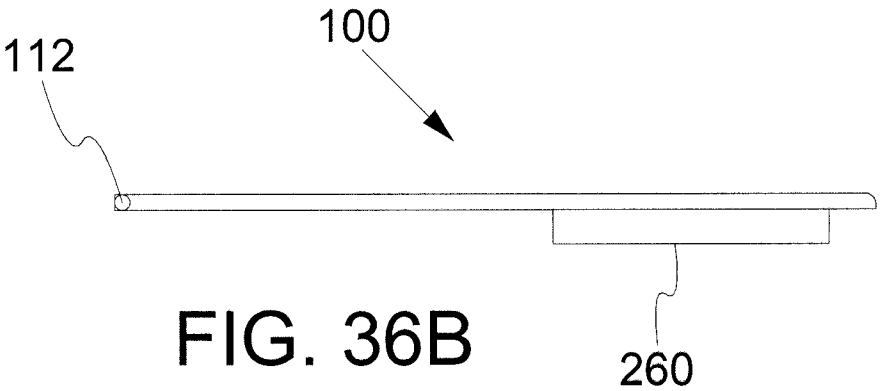
Figure 36C:
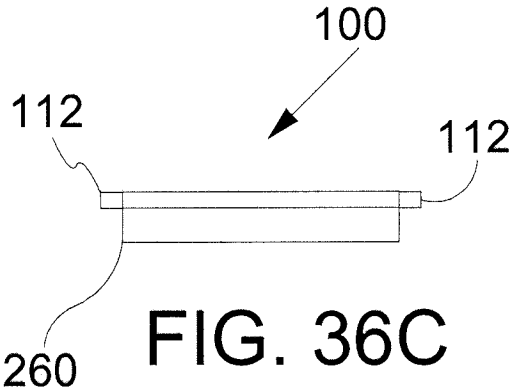
Figure 36D:
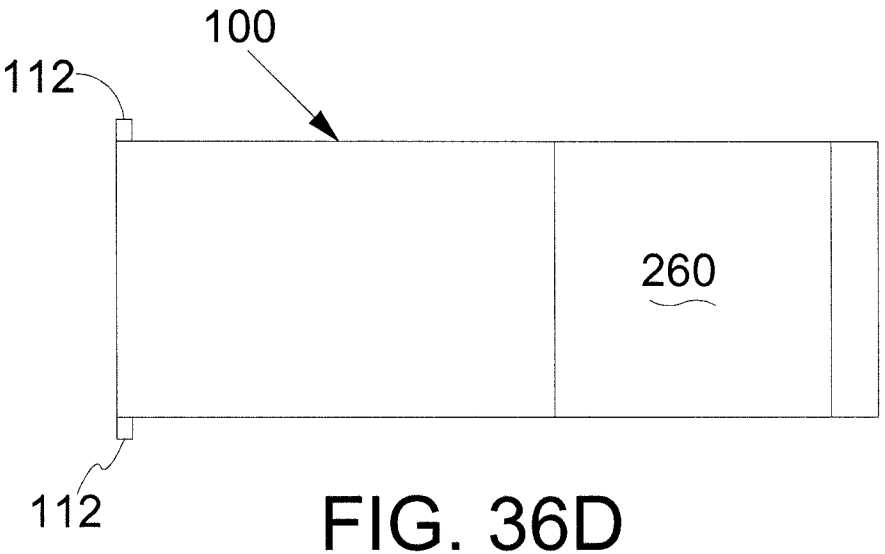
Figure 36E:
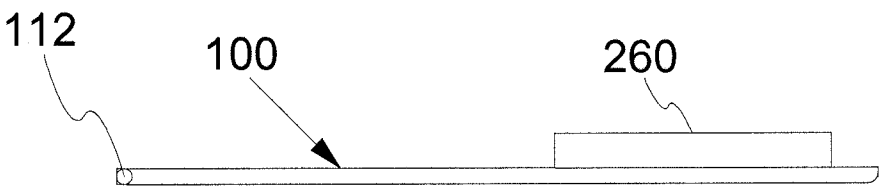
Figure 36F:
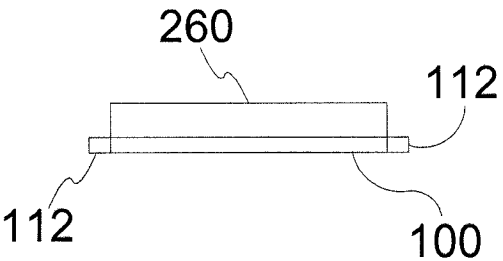
Figure 37A:
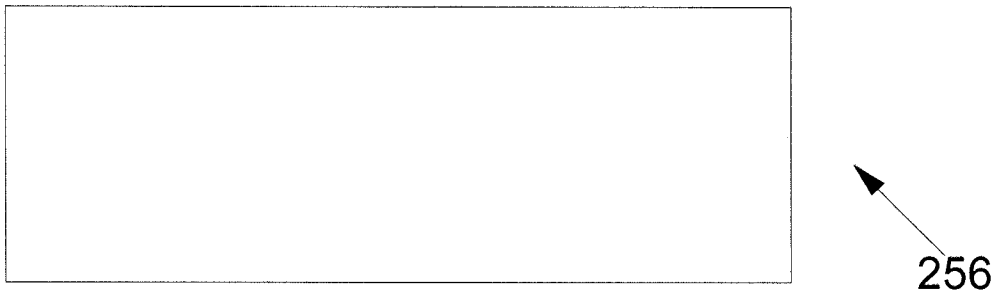
FIG. 37A through FIG. 37F are front, rear, top, bottom and side views showing six sides of a lever body.
Figure 37B:
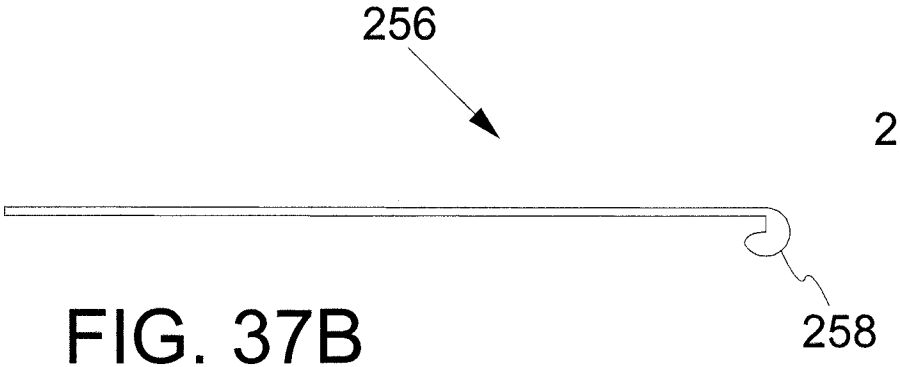
Figure 37C:
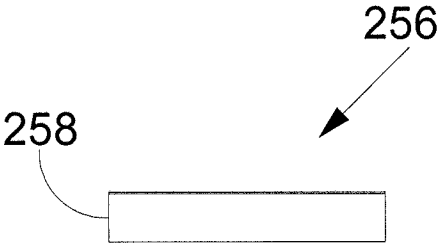
Figure 37D:
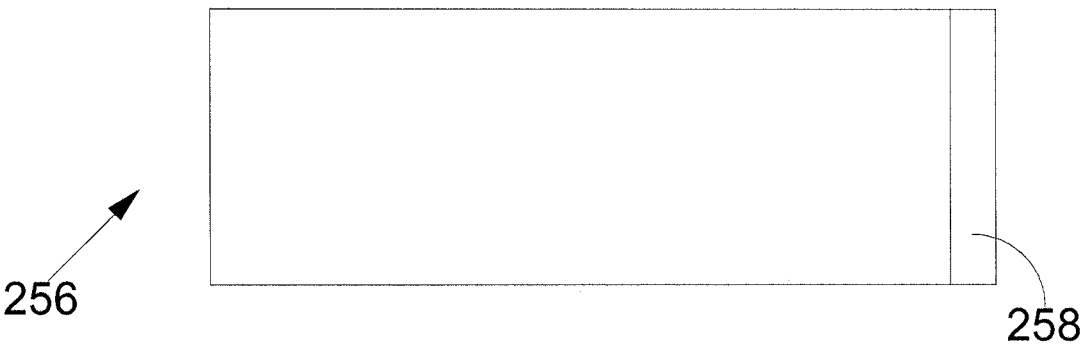
Figure 37E:
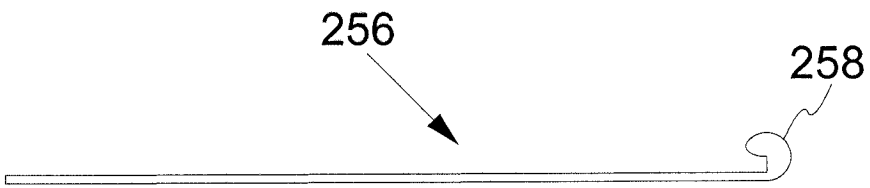
Figure 37F:
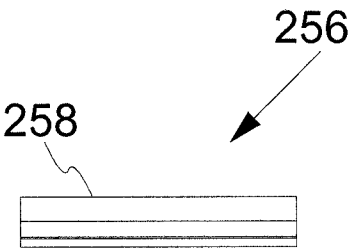

FIGS. 34A, 34B and 34C are a series of side views showing a device for detachable attachment to a ferromagnetic object or surface. FIGS. 34A, 34B and 34C may be collectively referred to as FIG. 34. In the example embodiment shown in FIG. 34, the device comprises a base housing 254 defining a pocket that receives a magnet and a baseplate 100 that is fixed to the magnet. With reference to FIG. 34 it will be appreciated that portions of the baseplate 100 extending beyond the periphery of the magnet overlay a front surface of the base housing 254. The baseplate 100 has the pivot portion 112 that engages a corresponding portion 114 of the base housing 254 to form a hinge joint 166 in the example embodiment of FIG. 34. The device also includes a lever body 256 including a camming portion 258 that engages a portion of the baseplate 100 in the example embodiment of FIG. 34. By comparing the positions of the lever body 256 in each of FIGS. 34A, 34B and 34C, it will be appreciated that the lever body 256 is rotatable about a fulcrum axis FA relative to the base housing 254. In the example embodiment of FIG. 34, the magnet and the baseplate 100 rotate about the pivot axis PA as the lever body 256 pivots about the fulcrum axis FA. In some embodiments, forces applied to the baseplate by the camming portion 258 of the lever body 256 urging the magnet and the baseplate 100 to pivot about the pivot axis PA.'

FIG. 35A through FIG. 35F are front, rear, top, bottom and side views showing six sides of a base housing 254. FIG. 36A through FIG. 36F are front, rear, top, bottom and side views showing six sides of an assembly including a magnet 260 and a baseplate 100. FIG. 35A through FIG. 35F and FIG. 36A through FIG. 36F may be referred to collectively as FIG. 35 and FIG. 36, respectively. Terms such as front view and top view are used herein as a convenient method for differentiating between the views shown in FIG. 35 and FIG. 36. It will be appreciated that the elements shown in FIG. 35 and FIG. 36 may assume various orientations without deviating from the spirit and scope of this detailed description. Accordingly, the terms front view, right side view, top view, rear view, left side view, bottom view, and the like should not be interpreted to limit the scope of the invention recited in the attached claims. In the example embodiment shown in FIG. 35, the base housing 254 defines a pocket that is dimensioned and configured to receive a magnet such as magnet 260 shown in FIG. 36. With reference to FIG. 35 it will be appreciated that portions of the baseplate 100 extending beyond the periphery of the magnet 260. The baseplate 100 (shown in FIG. 36) has the pivot portions 112 that may engage corresponding portions 114 of the base housing 254 (shown in FIG. 35) to form a hinge joint.

FIG. 37A through FIG. 37F are front, rear, top, bottom and side views showing six sides of a lever body 256. FIG. 37A through FIG. 37F may be collectively referred to as FIG. 37. In the example embodiment of FIG. 37, the lever body 256 includes a camming portion 258 may engage a portion of the baseplate 100 (shown in FIG. 36) and a cam receiving portion of the base housing 254 (shown in FIG. 5). In some embodiments, the lever body 256 is rotatable about a fulcrum axis relative to the base housing 254. In some embodiments, forces applied to the baseplate by the camming portion 258 of the lever body 256 urging the magnet and the baseplate 100 to pivot about pivot axis defined by a hinge joint.

Referring to FIGS. 33A through 37F, in some example embodiments, a device for detachable attachment to a ferromagnetic object or surface comprises a base housing 254 defining a pocket 138 and a magnet 260 disposed in the pocket 138 defined by the base housing 254. The magnet 260 may generate a magnetic field and the magnetic field may produce a magnetic attraction force between the magnet 260 and the ferromagnetic object. In some embodiments, a baseplate 100 is fixed to the magnet 260. In some embodiments, the baseplate 100 includes a tab portion 154 extending beyond a first side of a periphery of the magnet 260 and a pivot portion 112 located beyond a second side of the periphery of the magnet 260 opposite the tab portion 154. In some embodiments, the pivot portion 112 of the baseplate 100 engages a corresponding portion 114 of the base housing 254 to form a hinge joint 166. In some embodiments, the baseplate 100 and the magnet 260 selectively pivot about a pivot axis PA of a hinge joint 166 relative to the base housing 254. In some embodiments, the device includes a lever body 256 including a camming portion 258 that engages the tab portion 154 of the baseplate. In some embodiments, the lever body 256 is rotatable about a fulcrum axis FA relative to the base housing. In some embodiments, the camming portion 258 of the lever body 256 applies a force to the tab portion 154 of the baseplate 100 upon rotation of the lever body 256 relative to the base housing 254. In some embodiments, forces applied to the tab portion 154 of the baseplate by the camming portion 258 of the lever body 256 urging the magnet 260 and the baseplate 100 to pivot about the pivot axis PA. In some embodiments, the magnet 260 and the baseplate 100 rotate about the pivot axis PA as the lever body 256 pivots about the fulcrum axis FA.

Figure 38B:
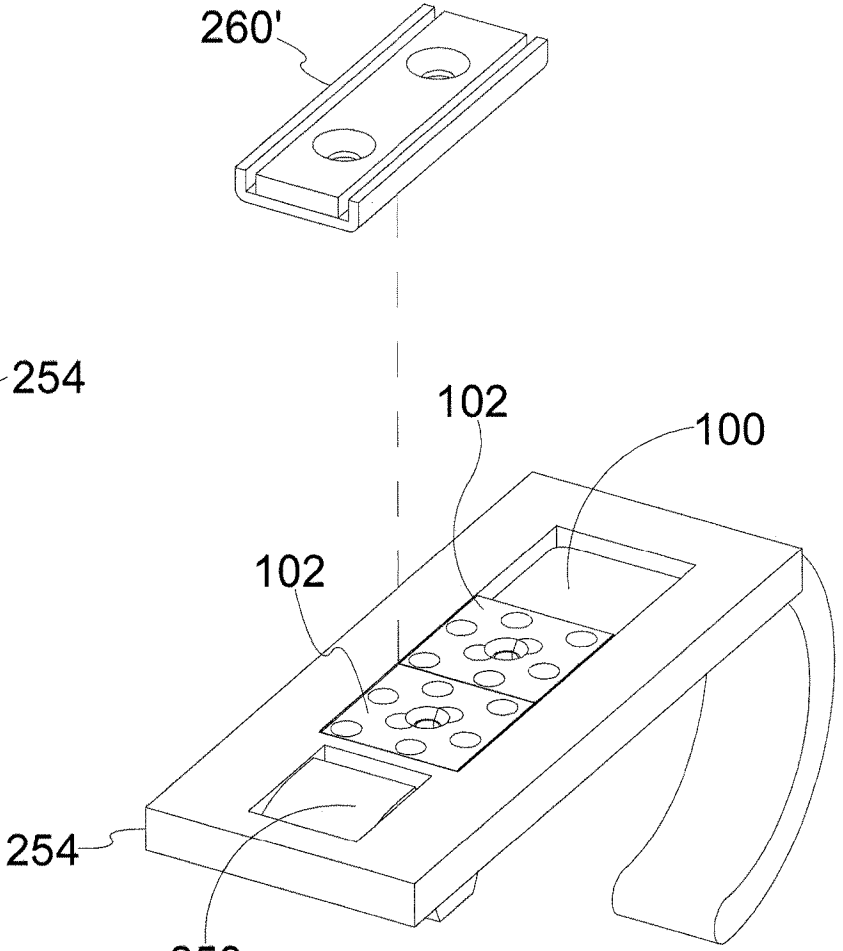
FIGS. 38A and 38B are perspective views showing a device for detachable attachment to a ferromagnetic object or surface.
Figure 38A:
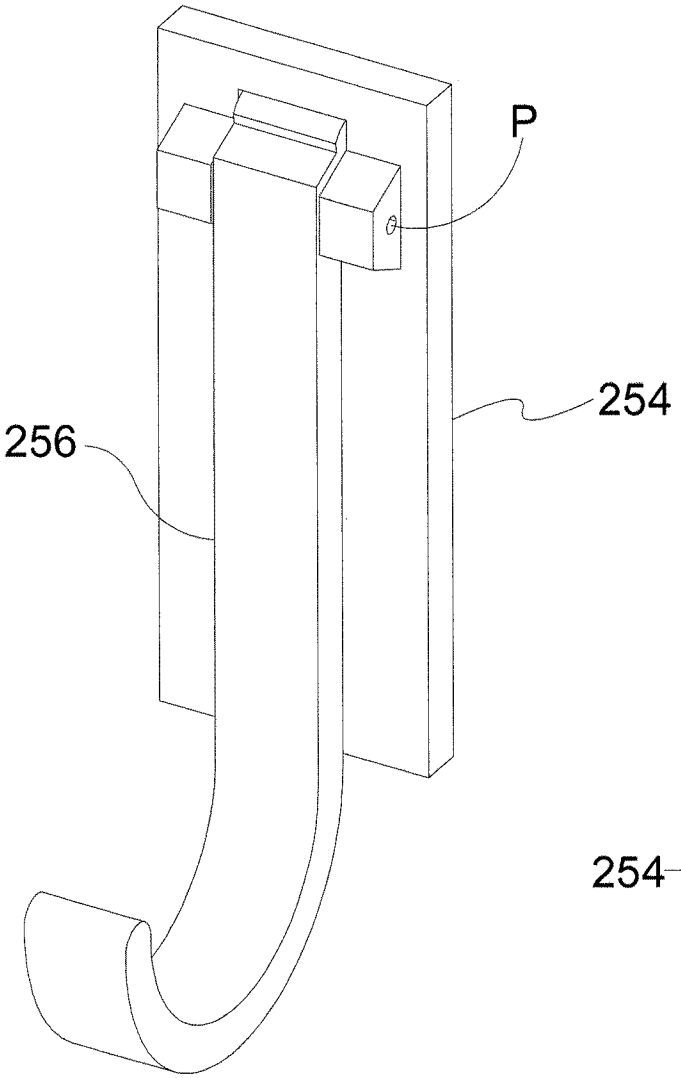

FIGS. 38A and 38B are perspective views showing a device for detachable attachment to a ferromagnetic object or surface. FIGS. 38A and 38B may be collectively referred to as FIG. 38. In the example embodiment shown in FIG. 38, the device comprises a base housing 254 defining a pocket 138 and a magnet 260 that is located inside the pocket 138 defined by the base housing 254. In some embodiments, the device includes a magnet 260 comprising two magnetic sheets 102. In other embodiments, the device includes a magnet 260' comprising a channel magnet. In the example embodiment of FIG. 38, the device includes a lever body 256 that is pivotally coupled to the base housing 254 by a pin P. In the example embodiment of FIG. 38, the lever body 256 includes a hook portion and a camming portion 258. In some embodiments, the lever body 256 is rotatable about the pin P relative to the base housing 254. In some embodiments, forces applied to an adjacent object or surface by the camming portion 258 of the lever body 256 urge the magnet 260 away from the object or surface.

Figure 39A:
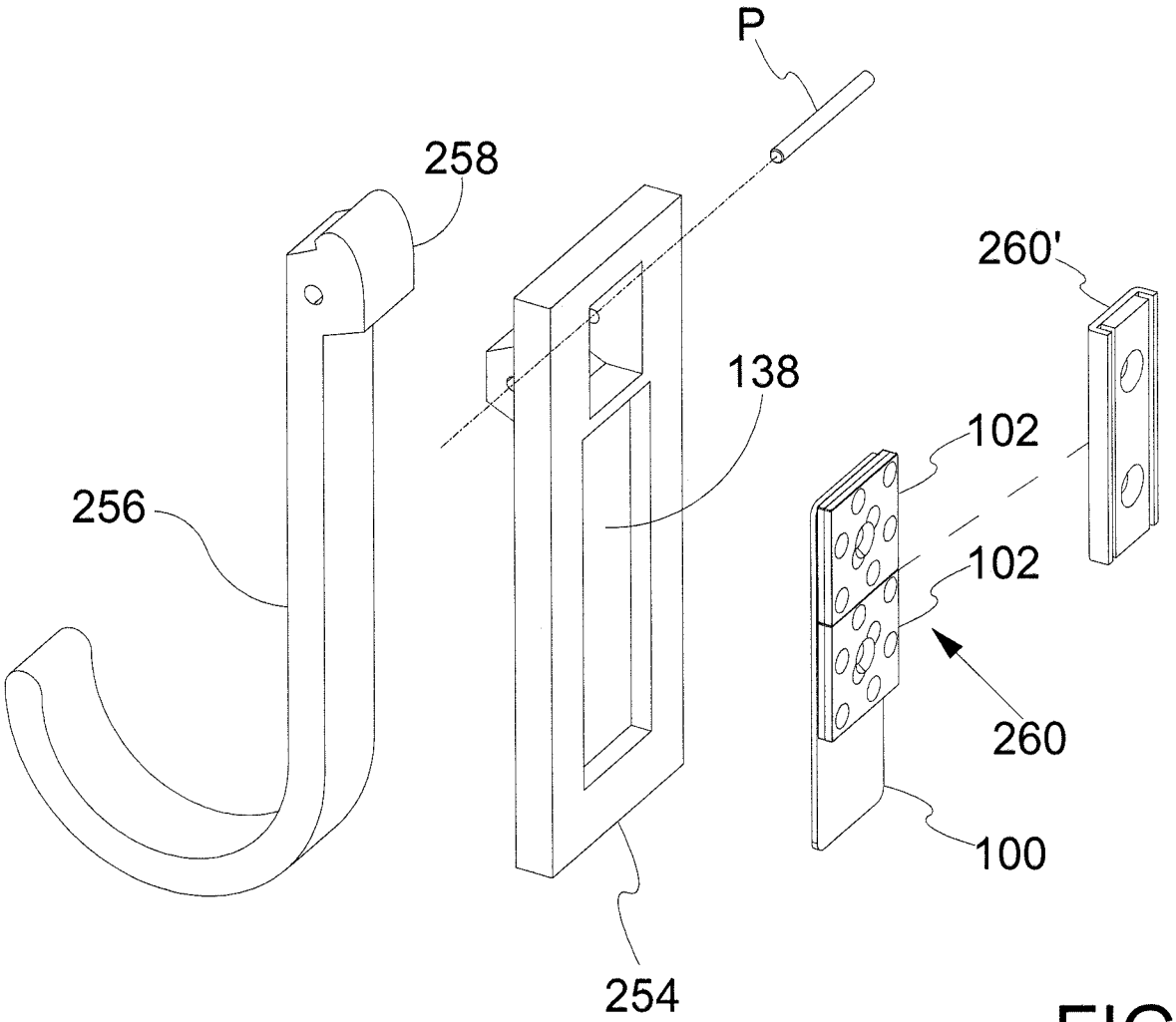
FIGS. 39A and 39B are exploded perspective views showing a device for detachable attachment to a ferromagnetic object or surface.
Figure 39B:
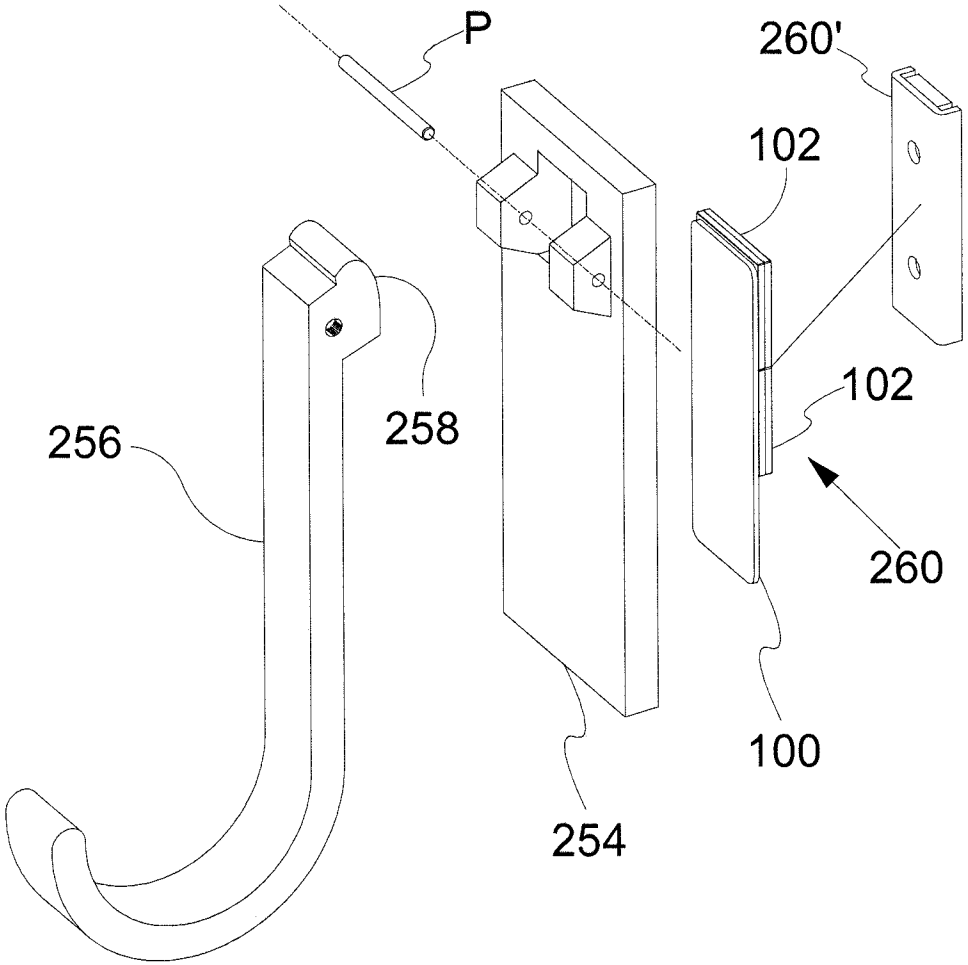

FIGS. 39A and 39B are exploded perspective views showing a device for detachable attachment to a ferromagnetic object or surface. FIGS. 39A and 39B may be collectively referred to as FIG. 39. In the example embodiment shown in FIG. 39, the device comprises a base housing 254 defining a pocket 138 that receives a magnet 260. In some embodiments, the device includes a magnet 260 comprising two magnetic sheets 102. In other embodiments, the device includes a magnet 260' comprising a channel magnet. In the example embodiment of FIG. 39, a baseplate 100 is fixed to the magnet 260 and portions of the baseplate 100 extend beyond the periphery of the magnet 260. In the example embodiment of FIG. 39, the device includes a lever body 256 that is pivotally coupled to the base housing 254 by a pin P. In the example embodiment of FIG. 39, the lever body 256 includes a hook portion and a camming portion 258. In some embodiments, the lever body 256 is rotatable about the pin P relative to the base housing 254. In some embodiments, forces applied to an adjacent object or surface by the camming portion 258 of the lever body 256 urge the magnet 260 away from the object or surface.

Figure 40:
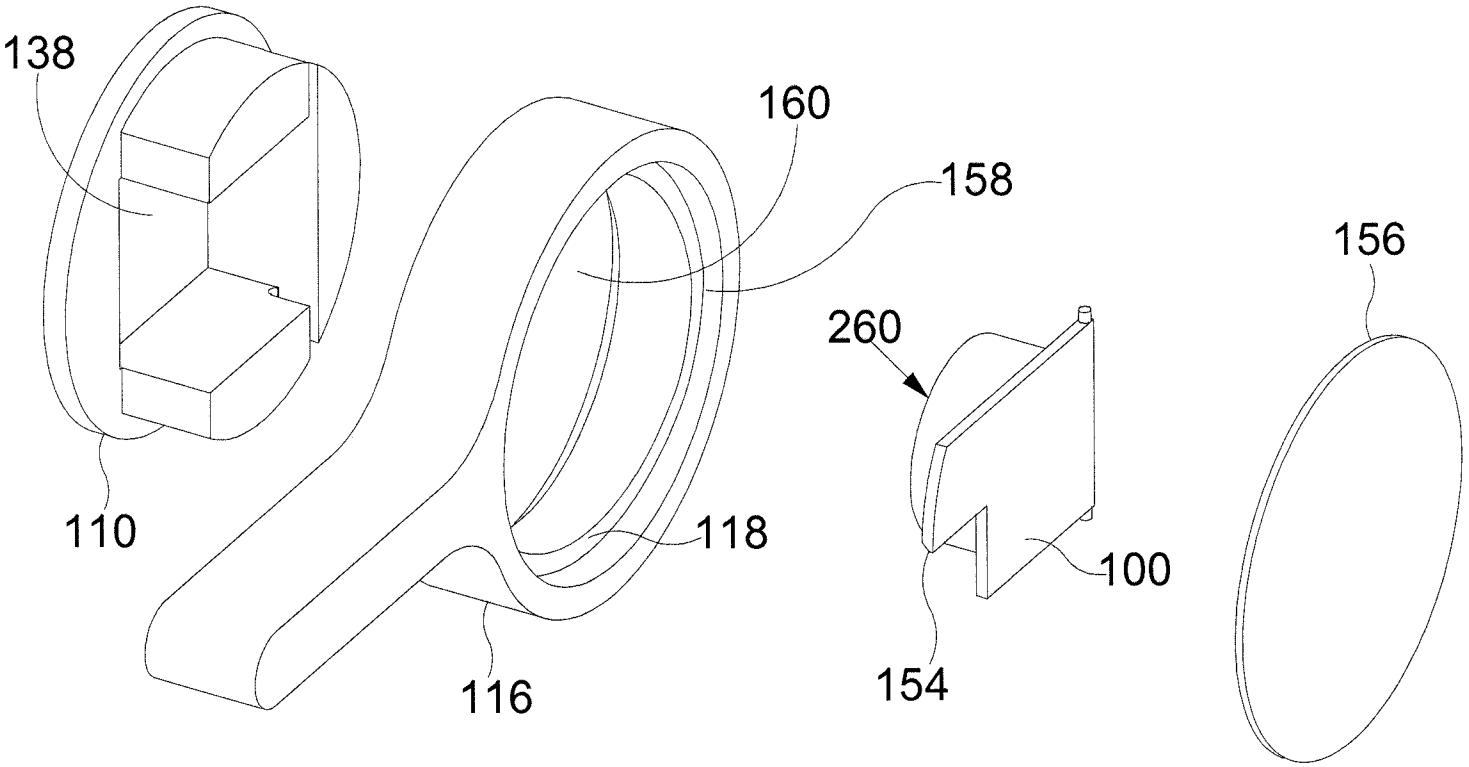
FIGS. 40 and 41 are exploded perspective views showing a detachable magnet device in accordance with an additional example embodiment.
Figure 41:
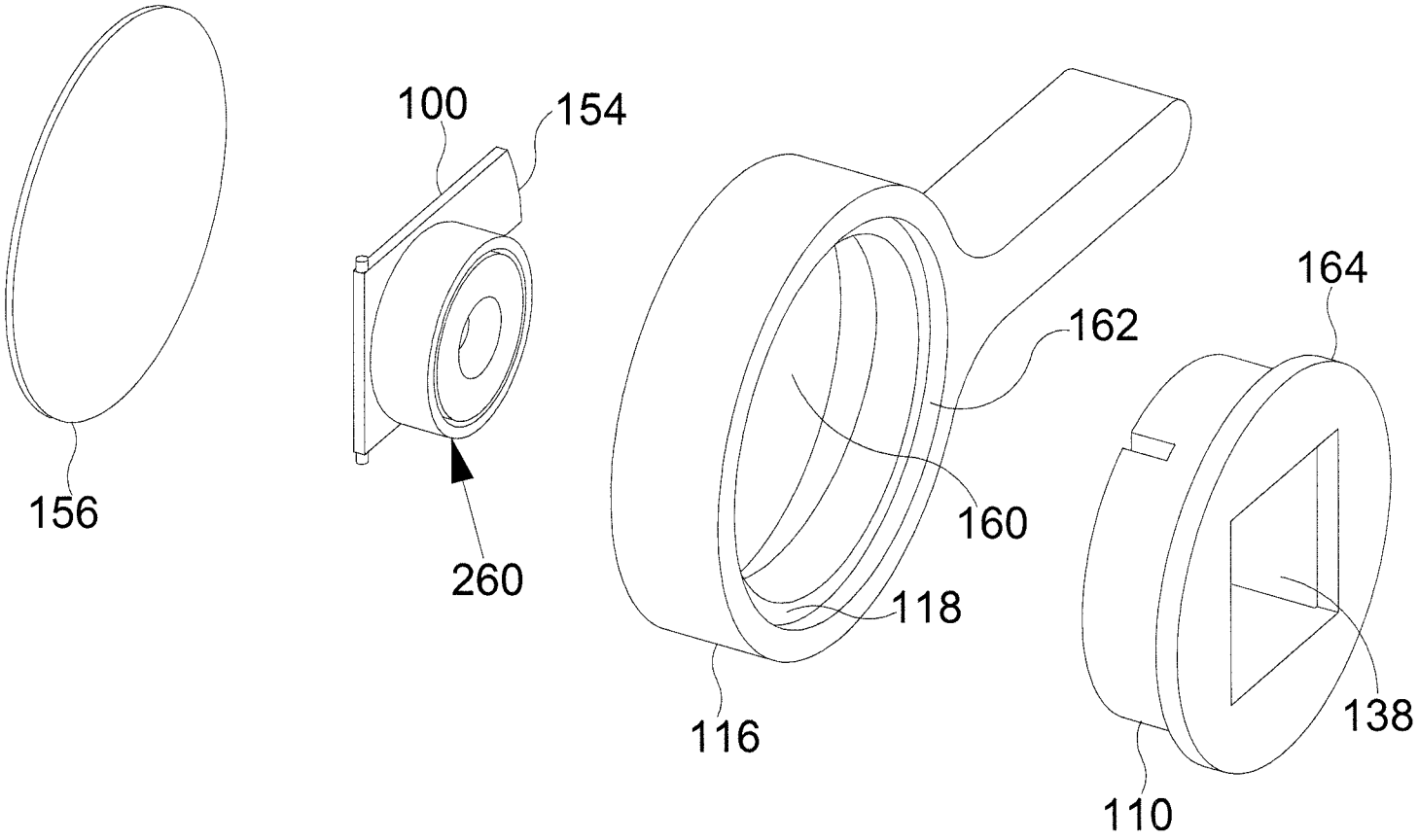

FIGS. 40 and 41 are exploded perspective views showing a detachable magnet device in accordance with an additional example embodiment. In the example embodiment of FIGS. 40 and 41, the detachable magnet device comprises a core housing 110 defining a pocket 138, a magnet 260 that is received in the pocket 138, and a baseplate 100 that is fixed to the magnet 260. In the example embodiment of FIGS. 40 and 41, the magnet 260 comprises a cup magnet. With reference to FIGS. 40 and 41, it will be appreciated that the baseplate 100 includes a tab portion 154 that extends beyond a periphery of the magnet 260 in the example embodiment shown. Also in the example embodiment of FIGS. 40 and 41, the baseplate 100 also includes a pivot portion 112 that is received in a corresponding portion 114 of the core housing 110 to form a hinge joint such that the baseplate 100 and the magnet 260 selectively pivot relative to the core housing 110.

In the example embodiment of FIGS. 40 and 41, the device includes a cap member 156 that can be fixed to the core housing 110 with the camming rib 118 disposed between the cap member 156 and a flange portion 164 of the core housing 110. In the example embodiment of FIGS. 40 and 41, the annular body 116 defines a counterbore 162 and the flange portion 164 of the core housing 110 is disposed at least partially in the counterbore 162 defined by the annular body 116 when the device is assembled. Also in the example embodiment of FIGS. 40 and 41, the annular body 116 defines a relief 158 and a portion of the cap member 156 is disposed in the relief 158 defined by the annular body 116 when the device is assembled. In some embodiments, the annular body 116 has a counterbore 162 opening in a first direction, a relief 158 opening in a second direction, and a camming rib 118 disposed between the counterbore 162 and the relief 158. In some embodiments, the cap member 156 has a disk-shaped body. In some embodiments, the cap member 156 has a circular shape when viewed as an orthographic projection.

The following United States patents are hereby incorporated by reference herein: U.S. patent Ser. Nos. 10/204,727, 10/194,246, 10/173,292, 10/008,817, U.S. Pat. Nos. 9,711,268, 9,588,599, 9,536,650, 9,412,506, 9,406,424, 9,404,776, 9,371,923, 9,367,783, 9,365,049, 9,312,634, 9,298,281, 9,275,783, 9,269,482, 9,257,219, 9,245,677, 9,219,403, 9,202,616, 9,202,615, 9,111,673, 9,111,672, 9,105,384, 9,105,380, 9,093,207, 9,082,539, 8,963,668, 8,963,380, 8,957,751, 8,947,185, 8,937,521, 8,917,154, 8,872,608, 8,857,044, 8,848,973, 8,844,121, 8,841,981, 8,816,805, 8,810,348, 8,779,879, 8,779,877, 8,760,252, 8,760,251, 8,760,250, 8,717,131, 8,704,626, 8,702,437, and 8,698,583. The above references to U.S. patents in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A device for detachable attachment to a ferromagnetic surface, the device comprising:

a core housing defining a pocket;

a magnet disposed in the pocket defined by the core housing;

a baseplate fixed to the magnet, the baseplate including a tab portion extending beyond a periphery of the magnet, a pivot portion of the baseplate engaging a corresponding portion of the core housing to form a hinge joint, the baseplate and the magnet selectively pivoting about a pivot axis of the hinge joint relative to the core housing;

an annular body disposed about the core housing, the annular body being rotatable about a rotational axis relative to the core housing, the annular body defining an aperture, and the annular body including a camming rib that extends inwardly into the aperture;

wherein the camming rib applies a camming force to the tab portion of the baseplate upon rotation of the annular body relative to the core housing, the camming force urging the magnet and the baseplate to pivot about the pivot axis.

2. The device of claim 1, wherein the camming force moves one edge of the baseplate and the magnet by a cam displacement distance, and the cam displacement distance is less than an effective zone thickness of a magnetic field produced by the magnet.

3. The device of claim 1, wherein the camming force moves one edge of the baseplate and the magnet by a cam displacement distance, and the cam displacement distance is greater than a baseplate wall thickness of the baseplate.

4. The device of claim 1, further comprising a cap member fixed to the core housing with the camming rib disposed between the cap member and a flange portion of the core housing.

5. The device of claim 1, wherein the annular body defines a counter bore and a flange portion of the core housing is disposed at least partially in the counter bore defined by the annular body.

6. The device of claim 1, further comprising a handle portion having a proximal end, a distal end, and a shaft portion extending between the proximal end and the distal end, the proximal end being coupled to or fixed to the annular body.

7. The device of claim 6, wherein:

the handle portion has an elongate shape; and the handle portion has a handle aspect ratio of length to width, the handle aspect ratio being greater than 5.

8. The device of claim 1, wherein:

the camming rib has a minimum thickness and a maximum thickness; and a displacement distance of the camming rib is equal to the difference between the maximum thickness and the minimum thickness.

9. The device of claim 1, further comprising an adhesive layer disposed between the baseplate and the magnet, the adhesive layer being adhered to the rearward facing surface of the baseplate wall and the forward face of the magnet.

10. The device of claim 1, wherein magnet has a thickness of 0.040 inches plus or minus 0.020 inches.

11. The device of claim 1, wherein magnet has a thickness of 0.063 inches plus or minus 0.020 inches.

12. The device of claim 1, further comprising an interface member overlaying the rearward face of the magnet.

13. The device of claim 12, further comprising an adhesive layer disposed between the interface member and the magnet, the adhesive layer being adhered to the rearward face of the magnet.

14. The device of claim 1, wherein:

the magnet has polygon shape; and the pocket defined by the core housing has a corresponding polygon shape, the corresponding polygon shape being dimensioned and configured so that relative rotation between the magnet and the core housing is precluded.

15. The device of claim 1, wherein the magnet comprises a magnetic sheet or a cup magnet or a channel magnet.

16. The device of claim 1, further comprising an actuator operatively coupled to the annular body, the actuator being capable of selectively rotating the annular body.

17. The device of claim 1, further comprising a mounting stud fixed to the baseplate.

18. A device for detachable attachment to a ferromagnetic object or surface, the device comprising:

a magnet that generates a magnetic field, the magnetic field producing a magnetic attraction force between the magnet and the ferromagnetic object, the magnet comprising a cup magnet or a channel magnet or a magnetic sheet having a plurality of island portions with interstitial portions of the magnetic sheet disposed about each island portion, each island portion having a north pole and a south pole, the north pole and the south pole of each island portion being positioned so that each island portion has a first magnetic polarity, and the interstitial portions of the magnetic sheet having a second magnetic polarity that is opposite the first magnetic polarity;

a baseplate fixed to the magnet, the baseplate including a tab portion extending beyond a periphery of the magnet;

an annular body defining an aperture, the annular body being disposed about the magnet such that the magnet is located inside the aperture, the annular body being rotatable about a rotational axis relative to the magnet, and the annular body including a camming rib that extends inwardly into the aperture;

a core housing defining a pocket that receives the magnet, the pocket having a corresponding polygon shape, polygon shape of the magnet and the corresponding polygon shape of the pocket being dimensioned and configured so that relative rotation between the magnet and the core housing is precluded;

a pivot portion of the baseplate engaging a corresponding portion of the core housing to form a hinge joint, the baseplate and the magnet selectively pivoting about a pivot axis of the hinge joint relative to the core housing, the pivot axis being orthogonal to the rotational axis;

wherein the camming rib applies a camming force to the baseplate upon rotation of the annular body relative to the magnet, the camming force urging the magnet and the baseplate to pivot about the pivot axis.

19. A device for detachable attachment to a ferromagnetic surface, the device comprising:

a core housing defining a pocket;

a magnet disposed in the pocket defined by the core housing, the magnet comprising a cup magnet or a channel magnet or a magnetic sheet having a plurality of island portions with interstitial portions of the magnetic sheet disposed about each island portion, each island portion having a north pole and a south pole, the north pole and the south pole of each island portion being positioned so that each island portion has a first magnetic polarity, and the interstitial portions of the magnetic sheet having a second magnetic polarity that is opposite the first magnetic polarity;

a baseplate fixed to the magnet, the baseplate including a tab portion extending beyond a periphery of the magnet, a pivot portion of the baseplate engaging a corresponding portion of the core housing to form a hinge joint, the baseplate and the magnet selectively pivoting about a pivot axis of the hinge joint relative to the core housing;

an annular body disposed about the core housing, the annular body being rotatable about a rotational axis relative to the core housing, the annular body defining an aperture, and the annular body including a camming rib that extends inwardly into the aperture;

wherein the camming rib applies a camming force to the tab portion of the baseplate upon rotation of the annular body relative to the core housing, the camming force urging the magnet and the baseplate to pivot about the pivot axis; and wherein the pivot axis is orthogonal to the rotational axis.

20. The device of claim 19, wherein:

the magnet has polygon shape; and the pocket defined by the core housing has a corresponding polygon shape, the corresponding polygon shape being dimensioned and configured so that relative rotation between the magnet and the core housing is precluded.

* * * * *